US008232437B2

(12) United States Patent
Clark et al.

(10) Patent No.: US 8,232,437 B2
(45) Date of Patent: Jul. 31, 2012

(54) FUEL COMPOSITION

(75) Inventors: Alisdair Quentin Clark, Puttenham Surrey (GB); Philip Howard, Berkshire (GB); Anthony George William Parker, Hook (GB)

(73) Assignee: BP Oil International Limited, London (GB)

( * ) Notice: Subject to any disclaimer, the term of this patent is extended or adjusted under 35 U.S.C. 154(b) by 1272 days.

(21) Appl. No.: 11/980,783

(22) Filed: Oct. 31, 2007

(65) Prior Publication Data

US 2008/0295388 A1 Dec. 4, 2008

Related U.S. Application Data

(60) Division of application No. 10/324,133, filed on Dec. 20, 2002, now Pat. No. 7,462,207, which is a continuation-in-part of application No. 09/592,856, filed on Jun. 12, 2000, now abandoned, and a continuation-in-part of application No. 09/796,745, filed on Mar. 2, 2001, now abandoned, and a continuation-in-part of application No. 09/667,767, filed on Sep. 22, 2000, now abandoned, said application No. 09/796,745 is a continuation-in-part of application No. 09/721,751, filed on Nov. 27, 2000, now abandoned, and a continuation-in-part of application No. 09/313,643, filed on May 18, 1999, now abandoned, and a continuation-in-part of application No. 09/276,685, filed on Mar. 26, 1999, now abandoned, and a continuation-in-part of application No. PCT/GB97/03084, filed on Nov. 11, 1997.

(60) Provisional application No. 60/191,495, filed on Mar. 23, 2000, provisional application No. 60/191,496, filed on Mar. 23, 2000.

(30) Foreign Application Priority Data

| | | |
|---|---|---|
| Nov. 18, 1996 | (GB) | 9623934.8 |
| Mar. 26, 1998 | (GB) | 9806440.5 |
| Oct. 14, 1998 | (GB) | 9822277.1 |
| Jun. 11, 1999 | (GB) | 9913650.9 |
| Sep. 23, 1999 | (GB) | 9922549.2 |
| Sep. 23, 1999 | (GB) | 9922552.6 |
| Sep. 23, 1999 | (GB) | 9922553.4 |
| Mar. 23, 2000 | (GB) | 0007095.3 |

(51) Int. Cl.
*C10L 1/10* (2006.01)

(52) U.S. Cl. ..... 585/14; 44/300

(58) Field of Classification Search ..... 44/300; 585/14
See application file for complete search history.

(56) References Cited

U.S. PATENT DOCUMENTS

| | | | | |
|---|---|---|---|---|
| 2,334,006 | A | 11/1943 | Holm | 44/356 |
| 2,363,300 | A | 11/1944 | Dunstan et al. | |
| 2,363,301 | A | 11/1944 | Dunstan et al. | |
| 2,401,649 | A | 6/1946 | Leffer | |
| 2,401,983 | A | 6/1946 | Albert et al. | 585/14 |
| 2,409,157 | A | 10/1946 | Schulze et al. | 44/454 |
| 2,409,746 | A | 10/1946 | Evans | 44/449 |
| 2,417,119 | A | 3/1947 | Miller et al. | |
| 2,485,897 | A | 10/1949 | Marschner | |
| 2,657,985 | A | 11/1953 | Schutze et al. | |
| 2,676,094 | A | 4/1954 | Denison | 44/450 |
| 2,684,325 | A | 7/1954 | Deanesly | |
| 2,759,031 | A | 8/1956 | Benoit et al. | |
| 2,890,995 | A | 6/1959 | Findlay | |
| 3,000,995 | A | 9/1961 | Hofmann et al. | |
| 3,211,803 | A | 10/1965 | Chapman | |
| 3,992,474 | A | 11/1976 | Sobel | |
| 4,059,646 | A | 11/1977 | Wald et al. | |
| 4,633,028 | A | 12/1986 | Owen et al. | |
| 4,812,146 | A | 3/1989 | Jessup | |
| 5,032,144 | A | 7/1991 | Jessup et al. | |
| 5,258,048 | A | 11/1993 | Whewell | |
| 5,312,542 | A | 5/1994 | Talbert | |

(Continued)

FOREIGN PATENT DOCUMENTS

CL 576-99 8/1999

(Continued)

OTHER PUBLICATIONS

Butler et al; U.S. Appl. No. 09/667,767, filed Sep. 2, 2000.

(Continued)

*Primary Examiner* — Cephia D Toomer
(74) *Attorney, Agent, or Firm* — Nixon & Vanderhye

(57) ABSTRACT

Unleaded blend compositions, as well as formulated gasolines containing them have a Motor Octane Number (MON) of at least 80 comprising either:

(i) component (a) at least 5% (by volume of the total composition) of at least one hydrocarbon having the following formula I $$R—CH_2—CH(CH_3)—C(CH_3)_2—CH_3 \quad \text{I}$$

wherein R is hydrogen or methyl, especially triptane, or (ii) at least 2% of component (a'), which is at least one branched chain alkane of MON value of at least 90 and of boiling point 15-160° C. or a substantially aliphatic hydrocarbon refinery stream, of MON value of at least 85, at least 70% in total of said stream being branched chain alkanes, said stream being obtainable or obtained by distillation from a refinery material as a cut having Initial Boiling Point of at least 15° C. and Final Boiling Point of at most 160° C., said Boiling Points being measured according to ASTMD2892, or (iii) at least 10% of component (a"), which is at least one branched chain alkane of 8-12 carbons with at least 4 methyl or ethyl branches The components (a), (a') and (a") give rise to reduced emissions to the composition or gasoline on combustion.

22 Claims, No Drawings

U.S. PATENT DOCUMENTS

| | | | | |
|---|---|---|---|---|
| 5,470,358 | A | 11/1995 | Gaughan | |
| 5,530,172 | A | 6/1996 | Funk et al. | |
| 5,851,241 | A | 12/1998 | Studzinski et al. | |
| 6,187,064 | B1 | 2/2001 | Henderson | |
| 6,238,446 | B1 | 5/2001 | Henderson | 44/359 |
| 6,258,134 | B1 | 7/2001 | Studzinski et al. | |
| 6,451,075 | B1 | 9/2002 | Schoppe et al. | 44/454 |
| 7,462,207 | B2 | 12/2008 | Clark | |
| 7,833,295 | B2 | 11/2010 | Clark | |
| 2002/0045785 | A1 | 4/2002 | Bazzani et al. | |
| 2002/0055663 | A1 * | 5/2002 | Barnes et al. | 585/14 |
| 2005/0044778 | A1 | 3/2005 | Orr | |

FOREIGN PATENT DOCUMENTS

| | | | |
|---|---|---|---|
| CN | 1249330 | | 4/2000 |
| CS | 246429 | B1 | 10/1986 |
| DE | 249 380 | A3 | 9/1980 |
| DE | 197 44 109 | | 4/1999 |
| DE | 197 44 109 | A1 | 4/1999 |
| EP | 0 121 738 | A2 | 10/1984 |
| EP | 0 994 088 | | 4/2000 |
| FR | 2081245 | | 3/1974 |
| FR | 2771419 | A1 | 5/1999 |
| GB | 479 345 | | 1/1938 |
| GB | 1293085 | | 10/1972 |
| GB | 2 106 933 | | 7/1981 |
| IR | 26290 | | 10/1999 |
| JP | 01009293 | | 1/1989 |
| JP | 09111263 | | 4/1997 |
| WO | 98/22556 | | 5/1998 |
| WO | WO 98/22556 | A | 5/1998 |
| WO | WO 98/22556 | A1 | 5/1998 |
| WO | 99/49003 | | 9/1999 |
| WO | WO 9949003 | A1 | 9/1999 |
| WO | 00/77130 | | 12/2000 |
| WO | WO 01/21738 | A | 3/2001 |
| WO | WO 02/22766 | A1 | 3/2002 |
| WO | WO 0240620 | A2 | 5/2002 |
| WO | WO 04/000441 | A1 | 12/2003 |

OTHER PUBLICATIONS

Derwent Abstract No. 89-057369.
Tosh et al, "The octane number increase . . . " Abstract No. 2209010.
Abstract No. 1988-029327, of DD 249 380 A3. Sep. 1980.
Brown, J.E., "Octane Numbers of Pure Hydrocarbon Blends" Division of Refining, vol. 42 [III], 1962, pp. 515-516.
Hong Wang, Synthesized gasoline; CN1107175 A 950823; 1996:115345.
Sherman et al., Catalyst for liq. phase alkylation or isomerisation of hydrocarbon feed—is formed from Lewis acid, hydrogen halide and paraffin, olefin or ether, in soln. in liq. paraffin; WO9414734; 94234538/28, 1994.
Nippon Oil KK, Lead tetra:ethyl-free gasoline giving improved engine performance—contains specified amts. of paraffinic, olefinic and aromatic hydrocarbon(s); JP 01009293 A; 89-057369/08, 1989.
Wald et al., Hydrocarbon mixtures contg. tri:methyl-butane—prepared by contacting methanol and-or di:methyl ether with zinc iodide or bromide at elevated temp.; ZA7706651; 78-68885A/38, 1978
Shell Oil Co., Triatane prepn.—from methanol and/or dimethyl ether using zinc iodide catalyst, US 4059647-A; 7786470Y/48, Nov. 1977.
Shigenobu Fujimoto; Stable and homogeneous fuel composition for internal combustion engine and process for preparing the same; Ph 18493; 13952630 INPADOC.
Proc. of Am. Pet. Inst., Sect. III, 42, 515-46 (1962).
Ind. Chem. Eng., 39, 853-7 (1947).
Internet Article 1.
Internet Article 2.
Appl. Catal., A (1997), 159(1-2), 119-132.
Appl. Catal., A (1997), 152(1), 53-62.
Energy Fuels (1990), 4(4) 372-9.
Sekiyu Gakkaishi (1988), 31(4), 342-9.
Appl. Catal., (1988), 38(2), 211-24.
Bull. Soc. Chim. Fr. N.5 760-66 (Sep.-Oct. 1987) ISSN: 0037-8968.
Derwent Abstract No. 96-220407, "Aviation condensed fuel . . . ".
Genco et al; Knock-Limited Performance . . . Paraffins and Olefins; NACA Report 1616; Jun. 1948.
Barnett et al; An Evaluation of Proposed . . . For Knock Rating; NACA Report 1619; Jul. 1948.
J. Robert Branstetter; Comparison of the Knock-Limited . . . Purified Hydrocarbons; NACA Report E5E15; May 1945.
20$^{th}$ API Meeting, Chicago, Nov. 9-17, 1939, pp. 78-88.
Chilean Patent Application No. 576-99, Aug. 1999.
API Technical Data Book (1970), pp. 1-21 to 1-50.
U.S. Appl. No. 09/667,767, Butler et al, "Fuel Compositions" filed Sep. 22, 2000.
Caplus Abstract No. 1948:22168, "Knock-limited performance . . . ".
Jonash et al. Knock-limited performance tests of 2,2,3,4-tetramethylpentane, 2,3,3,4tetramethylpentane, 3,4,4,-trimethyl-2-pentene, and 2,3,4-trimethyl-2-pentente in small-scale and full-scale cylinders. Natl. Advisory Comm. Aeronautics Rept. (1946).
Schlaifer, Robert; "Development of Aircraft Engines"; and Heron, S.D.; "Development of Aviation Fuels"; 1950; Harvard University; pp. 656-659.
NACA Report E4E25; "Aviation Fuels and their effects on Engine Performance"; 17pgs.; May 1944.
Aviation Fuels; U.S. Dept. of Interior Bureau of Mines (in part); 5pgs; 1960.
Jones, A.W., et al; Aviation Fuels; "Knock-Limited Performance of Pure Hydrocarbons Blended with a Base Fuel in a Full-Scale Aircraft-Engine Cylinder I-Eight Paraffins, Two Olefins"; National Advisory Committee for Aeronautics; 32pgs.; 1951.
Perander, J. et al; "No Major Backsliding in Air Quality when Replacing MTBE with Isooctane in CARB Gasoline"; Abstract, Accession No. 2001:812809; Answer 4 of 39.
Spencer, A. et al; "Combustion Performance of Methane, Iso-octane, Toluene and Methanol in a Spark Ignition Engine"; Abstract, Accession No. 2000:71635; Answer 18 of 39.
Zervas, E. et al; "The Influence of Gasoline Formulation on Specific Pollutant Emission"; Abstract, Accession No. 1999:809012; Answer 20 of 39.
Eng, J.A. et al; "The Effect of Fuel Composition on Hydrocarbon Emissions from a Spark Ignition Engine: Iso-octane/toluene and n-octane/toluene Fuel Mixtures"; Abstract, Accession No. 1999:15734, Answer 22 of 39.
Kaiser, E.W. et al; "Effect of Fuel Dissolved in Crankcase Oil on Engine-out Hydrocarbon Emissions from a Spark-Ignited Engine"; Abstract, Accession No. 1998:245476; Answer 27 of 39.
Kaiser, E.W.; "Impact of Operating Conditions and Fuel Composition on Vehicle Emissions"; Abstract, Accession No. 1997:578524; Answer 32 of 39.
Zervas, E. et al; "The Influence of Gasoline Formulation on Specific Pollutant Emissions"; Journal of the Air and Waste Management Association 49/11 1304-1314 (Nov. 1999), AN #L20003422, Abstract.
Eng, J.A., "The Effect of Fuel Composition on Hydrocarbon Emissions from a Spark Ignition Engine: Iso-octane/toluene and n-octane/toluene Fuel Mixtures"; SAE Int'l Fall Fuels & Lubricants Meeting (San Francisco 1/1922/98) SAE Special Publ. N.SP-1393 107-24 (1998) (SAE Paper #982557); AN #4600179, Abstract.
Kaiser, E.W.; "[A Discussion of the] Impact of Operating Conditions and Fuel Composition on Vehicle Emissions"; ACS 214$^{th}$ National Meeting (Las Vegas Sep. 8-11, 1997) ACS Division of Fuel Chemistry Preprints V42 N.3 885-89 (1997); AN #4407186; Abstract.
Callahan, C.V. et al; "Autoignition and Emissions Chemistry of Real Gasolines and Primary Reference Fuel Mixtures and Components from 1 to 12.5 atm and 500 to 1200 K"; Combustion Institute 26$^{th}$ Intl Combustion Symposium (Naples Jul. 28-Aug. 2, 1996) Abstracts of Works-in-Progress Posters 329 (1996); AN #4307440; Abstract.
Jackson, R.A. et al; "Interaction Between Fuel Components: Routes to Exhaust Emissions Species, Including Benzene, from an Internal Combustion Engine Fuelled by Isooctane and/or Cyclopentadiene"; Combustion Institute 26$^{th}$ Intl Combustion Symposium (Naples Jul. 28-Aug. 2, 1996) Abstracts of Works-in-Progress Posters 288 (1996); AN #4307246; Abstract.

Brink, P.J. van den; et al; "Influence of the Fuel Hydrocarbon Composition on Nitric Oxide Conversion in 3-way Catalysts: the NOx/aromatics Effect"; Applied Catalysis B: Environmental V6 N.2 L97-L103 (Jul. 1, 1995); AN #4233195; Abstract.
Harpster, M.O. et al; "An Experimental Study of Fuel Composition and Combustion Chamber Deposit Effects on Emissions from a Spark Ignition Engine"; SAE Intl Congress (Detroit Feb. 27-Mar. 2, 1995) SAE Special Publ. N.SP-1095 1-18 (1995); AN #4203608; Abstract.
Alkidas, A.C.; "The Effects of Fuel Preparation on Hydrocarbon Emissoins of a S.I. [(Spark Ignition)] Engine Operating Under Steady-State Conditions"; SAE Fuels & Lubricants Meeting (Baltimore, MD Oct. 17-20, 1994) SAE Mtg. Paper N.941959 (1994) 17P; AN #4200632; Abstract.
Bower, S.L. et al; "The Effect of Fuel Composition and Engine Deposits on Emissions from a Spark Ignition Engine"; SAE Fuels & Lubricants Mtg. (Philadelpha Oct. 18-21, 1993) SAE Mtg. Paper N.932707 (1993) 11P; AN #4103540; Abstract.
Kataoka, K. et al; "The Effect[s] of Fuel Properties on the Combustion Process and NO Emissions in a Spark Ignition Engine"; SAE 7$^{th}$ Intl Pacific Automotive Engineering Conf. (Phoenix, AZ Nov. 15-19, 1993) SAE Mtg Paper N.931940 (1993) 13P; AN #4103386; Abstract.
Petit, A. et al; "Effects of Gasoline Composition on the Exhaust Emissions of Regulated and Speciated Pollutants"; SAE Fuels & Lubricants Mtg. (Philadelphia Oct. 18-21, 1993) SAE Mtg. Paper N.932681 (1993) 13P; AN #4103287; Abstract.
Kaiser, E.W. et al; "Fuel Structure Effects on HC [(Hydrocarbon)] Emissions form a Spark-Ignited Engine"; ACS 204$^{th}$ Natl Mtg. (Washington, DC Aug. 23-28, 1992) ACS Division of Petroleum Chemistry Preprints V37 N.4 1473-78 (Aug. 1992); AN #3906056; Abstract.
Bower, S.L. et al; "Fuel Composition Effects on Emissions from a Spark Ignition Engine"; ACS 204$^{th}$ Natl Mtg. (Washington, DC Aug. 23-28, 1992) ACS Division of Petroleum Chemistry Preprints V37 N.4 1461-66 (Aug. 1992); AN #3906054; Abstract.
McCabe, R.w. et al; "Speciated Hydrocarbon [(HC)] Emissions from the Combustion of Single Component Fuels—2. [Automotive, Pollution Control] Catalyst Effects"; Journal of the Air & Waste Management Assoc. V42 N.8 1071-77 (Aug. 1992); AN #3932683; Abstract.
Siegel, W.O. et al; "Speciated Hydrocarbon [(HC)] Emissions from the Combustions of Single Component Fuels—1. Effect of Fuel Structure"; Journal of the Air & Waste Management Assoc. V42 N.7 912-20 (Jul. 1992); AN #3905104; Abstract.
Guibet, J.C. et al; "Gasoline Composition Effects on Exhaust Emissions"; 13$^{th}$ World Petroleum Congress (Buenos Aires 1991) Petrole et Techniques N.372 6-13 (Apr.-May 1992); AN 3903960; Abstract.
Guibet, J.C. et al; "Gasoline Composition Effects on Exhaust Emissions"; 13$^{th}$ World Petroleum Contress (Buenos Aires 1991) Proceedings V3 45-55 (1992); AN 3903796; Abstract.
Kaiser, E.W. et al; "Effect of Fuel Structure o Emissions from Spark-Ignited Engine"; Environmental Science Technology V25 N.12 2005-12 (Dec. 1991); AN #3900491; Abstract.
Guibet, J.C. et al; "Gasoline Composition Effects on Exhaust Emissions"; 13$^{th}$ World Petroleum Congress (Buenos Aires 1991) Preprint N.15.2 11P; AN #3807842; Abstract.
Dempster, N.M. et al; "An Investigation into the production of Hydrocarbon Emissions from a Gasoline Engine Tested on Chemically Defined Fuels"; SAE Intl Congress (Detroit Feb. 26-Mar. 2, 1990) Paper N.900354 18P; AN #3703449; Abstract.
James, E.H.; "Laminar Burning Velocities of Isooctane/Air Mixtures. A Literature Review"; SAE Int. Congr. (Detroit Feb. 23-27, 1987) Pap. (ISSN 0148-7191) N. 870170 21P; AN #3402656; Abstract.
Kaiser, E.W. et al; "The Effects of Fuel and Operating Variables on Hydrocarbon Species Distributions in the Exhaust from a Multicylinder Engine"; Combust. Sci. Technol., 32 (5-6) 245-65 (1983) Chem. Abstr. Abstr. No. 142700 V99 N.18; AN #2089039.
Ryan T.W. et al; "The Laminar Burning Velocity of Isooctane, N-Heptane, Methanol, Methane, and Propane at Elevated Temperature and Pressure in the Presence of a Diluent"; SAE Automot. Eng. congr. (Detroit Feb. 25-29, 1980) Pap. N. 800103 13P; AN #2705072; Abstract.
Ebersole, G.D.; "Power, Fuel Consumption and Exhaust Emission Characeristics of an Internal Combustion (Single-Cylinder) Engine Using Isooctane and Methanol"; Univ. Tulsa Diss (1971) 161P (Abstr) Diss. Abstr. Int B V32 N.3 1525B; AN #1809033; Abstract.
Fleming, R.D.; "The Effect of Fuel Composition on Exhaust Emission From a Spark-Ignition Engine"; Purdue Univ Diss (1970) 131P (Abstr) Diss. Abstr. Int B V31 N.4 1997B; AN #1800969; Abstract.
Eccleston, D.C. et al; "The Effects of Fuel Composition, Equivalence Ratio, and Mixture Temperature on Exhaust Emissions"; SAE Automot. Eng. Congr. (Detroit Jan. 11-15, 1971) Pap. N.710012 10P; AN #1800740; Abstract.
U.S. Bureau of Mines; U.S. National Air Pollution Control A; Fleming R.D.; U.S. Bureau of Mines Rep. Invest N.7423 (Sep. 1970) 68P; AN #1712397; Abstract.
Kaiser, E.W. et al; "Effect of Fuel Structure on Emissions from a Spark-Ignited Engine"; Environ. Sci. Technol., vol. 25, No. 12, 1991; pp. 2005-2012.
Dempster, N.M. et al; "An Investigation into the Production of Hydrocarbon Emissions from a Gasoline Engine Tested on Chemically Defined Fuels"; 900354; Ricardo Consulting Engineers Ltd.; 16 pages; Abstract.
Guibet, J.C. et al; "Gasoline Composition Effects on Exhaust Emissions"; Fuels-Gasoline; vol. 15, No. 2; pp. 45-55.
Specification and Claims of Application U.S. Appl. No. 10/104,490, filed Mar. 25, 2002.
Austin, G.T. "Manual de Procesos Químicos en la Industria"; pp. 848-851; Ref. # D1 (1988).
Rakoff, H. et al; "Química Orgánica Fundamental"; pp. 74-77; Ref. #D2 (1965).
Morrison, Robert T., et al; "Química Orgánica"; pp. 93-94; pp. 116-118; Ref. D3 (1996).
http://omega.ilce.edu.mx:3000/sites/ciencia/volumen3/ciencia3/159/htm/sec_6.htm; "H. La energía"; pp. 1-25; Ref. #D5 (2004).
Yepsen, G. et al; "Refiners Have Options to Deal with Reformulated Gasoline"; *Oil & Gas Journal*; Apr. 8, 1991; 5 pgs.
Hoek, A., et al; "New Catalyst Improves Heavy Feedstock Hydro-Cracking"; *Oil & Gas Journal*; Apr. 22, 1991; 5 pgs.
"Industry Analysts Focus on U.S., Asian, Latin American Markets"; *Oil & Gas Journal*; Apr. 25, 1994; 7 pgs.
"NPRA Q&A-3 High-Octane Gasoline Reqires High-Quality Alkylate"; *Oil & Gas Journal*; Apr. 30, 1990; 6 pgs.
"Contact!"—Aircraft preservation comment and analysis, with Paul Coggan; *Aeroplane*; Nov. 2002; p. 17.
The Title Page and the report of the session on Tuesday Oct. 1, 2002, Panel Session III The Loss of AVGAS 100LL. Lars Hjelmberg, Hjelmco Oil and the associated presentations (41 pgs).
Website http://purvisbros.com/afi/; "AviatinoFuel.info"; (18 pgs).
Owen, K. et al; "Automotive Fuels Reference Book"; (1995); pp. 827, 829.
Scheel, "Kraft-und Schmierstoffe in der Landwirtschaft"; (1958); p. 23.
Rompp Chemie Lexikon 8. Auflage; (1988); p. 4354.
Rompp Chemie Lexikon 9. Auflage; (1990); Band 3, pp. 2071-2072.
ASTM Designation D910-96; "Standard Specification for Aviation Gasolines"; (Sep. 1996); pp. 288-294.
"Gewinnung und Transport von Erdol und Erdags", reprinted from Winnacker/Kuchler, Ghemische Technologie, vol. 5: Organic Technology I, 4$^{th}$ Edition; (1982); pp. 106-109 (with English Translation).
Industrial and Engineering Chemistry; (1948); vol. 40, No. 6; pp. 1138-1150.
Industrial and Engineering Chemistry; (1944); vol. 36, No. 12, pp. 1078-1085.
J. Org. Chem.; (1978); vol. 43, No. 17, pp. 3432-3433.
Boord, "The Synthesis, Purification and Properties of Hydrocarbons of Low Molecular Weight"; Proc. Third World Pet. Con., Sec. VI, pp. 247-258.

Petrol. Ref. (1951), vol. 30, No. 9, pp. 107-111.
Rec. Tray. Chim.; (1939), vol. 58, pp. 329-377.
Cook Cleland; "Famous American Racers"; 1949 Thompson Trophy Winner; http://aviationartstore.com/1949__winner__2.htm; pp. 1-11, (Feb. 13, 2009).
Scott Germain, Warbird Aero Press; "Scoopless Mustang"; The Story of Anson Johnson's Race 45 and Where it is Now; http://www.warbirdareopress.com/articles/race45.html; pp. 1-8 (Feb. 13, 2009).

* cited by examiner

FUEL COMPOSITION

This application is a division of Ser. No. 10/324,133 filed Dec. 20, 2002 (U.S. Pat. No. 7,462,207); Ser. No. 10/324,133 filed Dec. 20, 2002 (U.S. Pat. No. 7,462,207) is a continuation-in-part of:

(I) Ser. No. 09/796,745 filed Mar. 2, 2001 (abandoned), (II) Ser. No. 09/667,767 filed Sep. 22, 2000 (abandoned) and (III) Ser. No. 09/592,856 filed Jun. 12, 2000 (abandoned) and claims priority from:

PCT/GB97/03084 filed Nov. 11, 1997 and from:

60/191,495 filed Mar. 23, 2000 and from:

GB 9623934.8 filed Nov. 18, 1996,
GB9806440.5 filed Mar. 26, 1998,
GB9822277.1 filed Oct. 14, 1998,
GB9913650.9 filed Jun. 11, 1999,
GB9922552.6 filed Sep. 23, 1999,
GB9922549.2 filed Sep. 23, 1999,
GB9922553.4 filed Sep. 23, 1999 and
GB0007095.3 filed Mar. 24, 2000;

I. Ser. No. 10/324,133 filed Dec. 20, 2002 (U.S. Pat. No. 7,462,207) is a continuation-in-part of Ser. No. 09/796,745 filed Mar. 2, 2001 (abandoned);

Ser. No. 09/796,745 filed Mar. 2, 2001 (abandoned) is a continuation-in-part of Ser. No. 09/721,751 filed Nov. 27, 2000 (abandoned) and claims priority from:

Ser. No. 09/721,751 filed Nov. 27, 2000 (abandoned),
Ser. No. 09/313,643 filed May 18, 1999 (abandoned),
Ser. No. 09/276,685 filed Mar. 26, 1999 (abandoned),
PCT/GB97/03084 filed Nov. 11, 1997 (abandoned),
Ser. No. 09/662,789 filed Sep. 15, 2000 (abandoned)

and from:

60/191,496 filed Mar. 23, 2000 and from:

GB9623934.8 filed Nov. 18, 1996,
GB9806440.5 filed Mar. 26, 1998,
GB9822277.1 filed Oct. 14, 1998,
GB9922552.6 filed Sep. 23, 1999 and
GB0007095.3 filed Mar. 24, 2000;

Ser. No. 09/662,789 filed Sep. 15, 2000 (abandoned) claims priority from 60/191,496 filed Mar. 23, 2000 and claims priority from GB 9922552.6 filed Sep. 23, 1999;

Ser. No. 09/796,745 filed Mar. 2, 2001 (abandoned) is a continuation-in-part of Ser. No. 09/721,751 filed Nov. 27, 2000 (abandoned);

Ser. No. 09/721,751 filed Nov. 27, 2000 (abandoned) is a continuation of Ser. No. Ser. No. 09/313,643 filed May 18, 1999 (abandoned);

Ser. No. 09/313,643 filed May 18, 1999 (abandoned) is a continuation-in-part of Ser. No. 09/276,685 filed Mar. 26, 1999 (abandoned) and of PCT/GB97/03084 filed Nov. 11, 1997 (abandoned) and claims priority from:

GB9623934.8 filed Nov. 18, 1996,
GB9806440.5 filed Mar. 26, 1998,
GB9822277.1 filed Oct. 14, 1998 and from:

Ser. No. 09/276,685 (608-152) filed Mar. 26, 1999 (abandoned) and

PCT/GB97/03084 filed Nov. 11, 1997 (abandoned);

Ser. No. 09/276,685 filed Mar. 26, 1999 (abandoned) claims priority from GB 9806440.5 filed Mar. 26, 1998 and GB 9822277.1 filed Oct. 14, 1998;

PCT/GB97/03084 filed Nov. 11, 1997 (abandoned) claims priority from GB9623934.8 filed Nov. 18, 1996;

II. Ser. No. 10/324,133 filed Dec. 20, 2002 (U.S. Pat. No. 7,462,207) is also a continuation-in-part of Ser. No. 09/667,767 filed Sep. 22, 2000 (abandoned);

Ser. No. 09/667,767 claims priority from 60/191,495 filed Mar. 23, 2000 and GB 9922553.4 filed Sep. 23, 1999;

III. Ser. No. 10/324,133 filed Dec. 20, 2002 (U.S. Pat. No. 7,462,207) is also a continuation-in-part of Ser. No. 09/592,856 filed Jun. 12, 2000 (abandoned);

Ser. No. 09/592,856 filed Jun. 12, 2000 (abandoned) claims priority from 60/191,495 filed Mar. 23, 2000 which is a REI of U.S. Ser. No. 60/191,494 filed Mar. 23, 2000 and claims priority from GB 9913650.9 filed Jun. 11, 1999, GB 9922549.2 filed Sep. 23, 1999 and GB 9922553.4 filed Sep. 23, 1999 the entire contents of each of which are hereby incorporated by reference.

This invention relates to a fuel composition, in particular a gasoline composition for use in motor vehicles or for use in aircraft.

If a gasoline engine is run on a fuel which has an octane number lower than the minimum requirement for the engine, knocking will occur. Straight run gasoline has a low motor octane number but may be boosted to the required motor octane number of 82-88 for automotive use by the addition of octane boosters such as tetraethyl lead either alone or with refinery components such as reformate, alkylate, cracked spirit or chemical streams such as toluene, xylene, methyl tertiary butyl ether or ethanol.

For many years manufacturers of spark ignition combustion engines have been striving for higher efficiency to make optimum use of the hydrocarbon fuels. But such engines require gasolines of higher octane number, which has been achieved in particular by addition of organo lead additives, and latterly with the advent of unleaded gasolines, by addition of MTBE. But combustion of any gasoline gives rise to emissions in the exhaust gases, e.g. of carbon dioxide, carbon monoxide, nitrogen oxides (NOx) and toxic hydrocarbons and such emissions are undesirable.

For clarity, the present invention is described in three parts, (a), (b) and (c). The description and examples for each part relate to that part of the invention. Hence the description under part (a) relates to part (a) of the invention, and the examples of part (a) exemplify part (a) of the present invention. Similarly, the description under part (b) relates to part (b) of the present invention, and the examples of part (b) exemplify part (b) of the present invention, and the description under part (c) relates to part (c) of the present invention, and the examples of part (c) exemplify part (c) of the present invention.

Part (a)

Motor gasolines have been discovered having high Octane Number but producing low emissions on combustion.

Aircraft piston-driven engines operate under extreme conditions to deliver the desired power e.g. high compression ratios. Due to the severity of the conditions e.g. with turbo charging or super charging the engine, aviation piston-driven engines require fuel of a minimum octane level higher than that for automotive internal combustion gasoline engines, in particular at least 98-100. The base fuel of an aviation gasoline has a motor octane number of 90-93. To boost the motor octane number sufficiently to the required level, tetraethyl lead is added to the aviation base fuel. The fuel may contain the organolead and also other octane boosters, such as those described above. Industrial and Engineering Chemistry Vol. 36 No. 12 p 1079-1084 dated 1944 describes the use of triptane (2,2,3-trimethylbutane) in combination with tetraethyl lead in aviation gasoline. However, the presence of tetraethyl lead is the key to achieving high octane quality in aviation gasolines.

In modern day formulations tetraethyl lead is always used to boost the octane quality of the aviation gasoline to the desired level. However due to environmental concerns of the effect of lead and its compounds attempts are being made to find an alternative to the use of tetraethyl lead in aviation gasoline. Conventional octane boosters such as ethers, aromatics, such as toluene, and non-lead metal compounds can boost the motor octane number of unleaded motor gasoline sufficiently high enough to achieve the desired value but they do not boost the motor octane number of an unleaded aviation gasoline sufficiently high enough to ensure satisfactory performance or suffer from other significant technical limitations.

U.S. Pat. No. 5,470,358 describes the use of aromatic amines to boost the motor octane number of unleaded aviation gasoline to at least 98 but many aromatic amines are known to be toxic. They have high boiling points, no supercharge properties and high freezing points; they are also prone to produce gums.

There remains a need for an unleaded aviation gasoline of sufficiently high octane number suitable for use in piston driven aircraft Part (a) of the present invention provides an unleaded blend composition, particularly for automobile use having a Motor Octane Number (MON) of at least 80 comprising component (a) at least 5% or preferably at least 8 or 10% (by volume of the total composition) of at least one hydrocarbon having the following formula I $$R—CH_2—CH(CH_3)—C(CH_3)_2—CH_3 \quad \text{I}$$

wherein R is hydrogen or methyl and component (b) at least one saturated liquid aliphatic hydrocarbon having 4 to 12, 4-10 such as 5-10 e.g. 5-8 carbon atoms. In another embodiment component (b) is contained in at least one of isomerate, alkylate, straight run gasoline, light reformate, light hydrocrackate and aviation alkylate. Preferably the composition comprises at least one of an olefin (e.g. in amount of 1-30%) and/or at least one aromatic hydrocarbon (e.g. in amount of 1-50%, especially 3-28%) and/or less than 5% of benzene. The composition may preferably comprise 10-40% triptane, less than 5% benzene and have a Reid Vapour Pressure at 37.8° C. measured according to ASTMD323 of 30-120 kPa. This composition of part (a) of the invention is usually an unleaded motor gasoline base blend composition.

Part (a) of the present invention also provides an unleaded formulated motor gasoline which comprises said base composition and at least one motor gasoline additive.

According to part (a) of the present invention there is provided an unleaded composition, (especially for use in aviation fuel) having a Motor Octane Number of at least 98, and usually a final Boiling Point of less than 170° C., and preferably a Reid Vapour Pressure at 37.8° C. of between 38–60 kPascals, which comprises:

component (a) at least one hydrocarbon of formula I and component (b) at least one saturated liquid aliphatic hydrocarbon having 4 to 10 in particular 5 or 6 carbon atoms optionally with at least one other saturated liquid aliphatic hydrocarbon having from 5 to 10 carbon atoms wherein at least 20% or at least 30% by volume of the total composition is a hydrocarbon of formula I. Part (a) of the present invention also provides an unleaded aviation fuel having a Motor Octane Number of at least 98, and having a final boiling point of less than 170° C. which comprises:

component (a) comprising at least one hydrocarbon of formula I and component (b) at least one saturated liquid aliphatic hydrocarbon having 5 or 6 carbon atoms wherein at least 20% by volume of the total composition is a hydrocarbon of formula I, together with at least one aviation gasoline additive selected from anti-oxidants, corrosion inhibitors, anti-icing additives and anti-static additives.

If R is hydrogen the hydrocarbon is triptane. If R is methyl the hydrocarbon is 2,2,3 trimethylpentane. Especially preferred is triptane. Triptane and 2,2,3 trimethylpentane may be used individually or in combination with each other, for example, in a weight ratio of 10:90-90:10, preferably, 30:70-70:30.

The hydrocarbon of formula I, preferably triptane may be present in amount of 5-95% or 8-90% such as 10-90%, or 15-65%, e.g. 10-40% such as 20-35% by volume or 40-90% such as 40-55% or 55-80% or 8-35% such as 8-20% by volume. Unless otherwise stated all percentages in this specification are by volume, and disclosures of a number of ranges of amounts in the composition or gasoline for 2 or more ingredients includes disclosures of all sub-combinations of all the ranges with all the ingredients.

Triptane or 2,2,3 trimethylpentane may be used in a purity of at least 95% but is preferably used as part of a hydrocarbon mixture e.g. with at least 50% of the compound of formula I. This mixture may be obtained for example by alkylation of an isoalkane e.g. reaction of propene and iso butane or obtained via distillation of the product of a catalytic cracking reaction, e.g. a cracked residue which is an atmospheric or vacuum residue from crude oil distillation, to give a $C_4$ fraction containing olefin and hydrocarbon, alkylation to produce a $C_{4-9}$ especially a $C_{6-9}$ fraction which is distilled to give a predominantly $C_8$ fraction, which usually contains trimethyl pentanes including 2,2,3 trimethyl pentane and/or 2,3,3 trimethyl pentane. To produce triptane this fraction can be demethylated to give a crude product comprising at least 5% of triptane, which can be distilled to increase the triptane content in the mixture; such a distillate may comprise at least 10% or 20% of triptane and 2,2,3 trimethylpentane but especially at least 50% e.g. 50-90% the rest being predominantly of other aliphatic C7 and C8 hydrocarbons e.g. in amount 10-50% by volume. Triptane may be prepared generally as described in Rec. Trav. Chim. 1939, Vol. 58 pp 347-348 by J. P. Wibaut et al, which involves reaction of pinacolone with methyl magnesium iodide followed by dehydration (e.g. with sulphuric acid) to form triptene, which is hydrogenated e.g. by catalytic hydrogenation to triptane. Alternatively triptane and 2,2,3 trimethylpentane may be used in any commercially available form.

Part (a) of the invention will be further described with triptane exemplifying the compound of formula I but 2,2,3 trimethylpentane may be used instead or as well. The terms mogas and avgas will be used herein for convenience to represent motor gasoline and aviation gasoline respectively.

The gasoline composition for mogas or avgas use also contains as component (b) at least one liquid saturated hydrocarbon of 4-10 e.g. 5-10 carbons especially predominantly branched chain $C_7$ or $C_8$ compounds e.g. iso $C_7$ or iso $C_8$. This hydrocarbon may be substantially pure e.g. n-heptane, isooctane or isopentane or a mixture e.g. a distillation product or a reaction product from a refinery reaction e.g. alkylate. The hydrocarbon may have a Motor Octane Number (MON) of 0-60 but preferably has a MON value of 60-96 such as isomerate (bp 25-80° C.). Research Octane Number RON may be 80-105 e.g. 95-105, while the ROAD value (average of MON and RON) may be 60-100.

For avgas use component (b) is preferably at least one saturated aliphatic liquid hydrocarbon of 4 to 10 preferably 5 to 8 in particular 5 or 6 carbon atoms, alone or with at least one saturated aliphatic liquid hydrocarbon (different from component (a)) having from 4 to 10 carbons in particular 5 to 10 carbon atoms, preferably 5 to 8 carbon atoms, especially in combination with one of 4 carbons.

Component (b) for use in mogas or avgas may comprise a hydrocarbon component (IV) for mogas or avgas use having boiling point (preferably a final boiling point) higher than, preferably one boiling at least 20° C. more than, the compound of formula I e.g. triptane such as 20-60° C. more than triptane but less than 225° C. e.g. less than 170° C. and usually is of Motor Octane Number of at least 92 e.g. 92-100; such components are usually alkanes of 7-10 carbons especially 7 or 8 carbons, and in particular have at least one branch in their alkyl chain, in particular 1-3 branches, and preferably on an internal carbon atom and especially contain at least one —$C(CH_3)_2$— group, e.g. isooctane The volume amount of the component (b) in total in mogas (or the volume amount of mixtures comprising component (b), such as the total of each of the following (if present) (i)-(iv)) (i) catalytic reformate, (ii) heavy catalytic cracked spirit, (iii) light catalytic cracked spirit and (iv) straight run gasoline in the composition is usually 10-80% e.g. 25-70%, 40-65% or 20-40%, the higher percentages being usually used with lower percentages of component (a).

Component (b) may be a mixture of the liquid saturated hydrocarbons e.g. a distillation product e.g. naphtha or straight run gasoline or a reaction product from a refinery reaction e.g. alkylate including aviation alkylate (bp 30-190° C.) isomerate (bp 25-80° C.), light reformate (bp 20-79° C.) or light hydrocrackate or a mixture thereof e.g. alkylate and isomerate. The mixture may contain at least 60% or at least 70% w/w e.g. 60-95 or 70-90% w/w liquid saturated aliphatic hydrocarbon.

Volume amounts in the composition of part (a) of the invention of the component (b) mixtures (primarily saturated liquid aliphatic hydrocarbon fractions e.g. the total of isomerate, alkylate, naphtha and straight run gasoline (in each case (if any) present in the composition) may be 4-60%, such as 4-25% or preferably 10-55% such as 25-45%. Alkylate or straight run gasoline are preferably present, optionally together but preferably in the absence of the other, in particular in amount of 2-50% such as 10-45 e.g. 10-25%, 25-45% or 25-40%. The compositions of part (a) of the invention may also comprise naphtha e.g. in volume amount of 0-25% such as 2-25%, 10-25% or 2-10%.

The compositions may comprise a hydrocarbon component (b) e.g. for avgas a component III which is at least one saturated aliphatic hydrocarbon of 4-6 carbons and which is more volatile and has a lower boiling point (preferably a lower final boiling point) than the compound of Formula I in particular one boiling at least 30° C. such as 30-60° C. below that of triptane at atmospheric pressure, and especially is itself of Motor Octane Number greater than 88 in particular at least 90 e.g. 88-93 or 90-92. Examples of the hydrocarbon component e.g. component III include alkanes of 4 or 5 carbons in particular iso-pentane, which may be substantially pure or crude hydrocarbon fraction from alkylate or isomerate containing at least 30% e.g. 30-80% such as 50-70%, the main contaminant being up to 40% mono methyl pentanes and up to 50% dimethyl butanes. The hydrocarbon component e.g. for avgas a component III may be an alkane of boiling point (at atmospheric pressure) 30-60° C. less than that of triptane may be used as sole component III but may be mixed with an alkane of boiling point 60-100° C. less than that of triptane e.g. n and/or iso butane optionally in blends with the $C_5$ alkane of 99.5:0.5 to 0.5:99.5, e.g. 99.5:0.5 to 70:30 such as 88:12 to 75:25. n Butane alone or mixed with isopentane is preferred for mogas use, especially in the above proportions, and in particular with a volume amount of butane in the composition of up to 20% such (as 1-15% e.g. 1-8, 3-8 or 0.8-15%. For avgas use Iso-pentane alone or mixed with n-butane is preferred, especially in the above proportions, and in particular with a volume amount of butane in the composition of up to 3.5% e.g. 1-3.5% or 2-3.5%.

Cycloaliphatic hydrocarbons e.g. of 5-7 carbons such as cyclopentane or cyclohexane may be present for mogas but usually in amounts of less than 15% of the total e.g. 1-10%.

Volume amounts in the composition for mogas of the total of isomerate, alkylate, naphtha, straight run gasoline, 4-6 carbon liquid aliphatic hydrocarbon (as defined above) and cycloaliphatic hydrocarbon (in each case if present) may be 5-60%, such as 8-25%, 15-55% such as 30-50%.

The gasoline compositions of part (a) of the invention, in particular the ones for mogas use, also preferably contain at least one olefin, (in particular with one double bond per molecule) which is a liquid alkene of 5-10 e.g. 6-8 carbons, such as a linear or branched alkene e.g. pentene, isopentene hexene, isohexene or heptene or 2 methyl 2 pentene, or a mixture comprising alkenes which may be made by cracking e.g. catalytically or thermally cracking a residue from crude oil, e.g. atmospheric or vacuum residue; the mixture may be heavy or light catalytically cracked spirit (or a mixture there of).

The cracking may be steam assisted. Other examples of olefin containing mixtures are "C6 bisomer", catalytic polymerate, and dimate. The olefinic mixtures usually contain at least 10% w/w olefins, such as at least 40% such as 40-80% w/w. Preferred mixtures are (xi) steam cracked spirit (xii) catalytically cracked spirit (xiii) C6 bisomer and (xiv) catalytic polymerate, though the optionally cracked catalytically spirits are most advantageous. Amounts in the total composition of the olefinic mixtures especially the sum of (xi)-(xiv) (if any present) maybe 0-55, e.g. 10-55 or 18-37 such as 23-35 or 20-55 such as 40-55% Amounts of (xi) and (xii) (if present) in total in the composition are preferably 18-55, such as 18-35, 18-30 or 35-55% (by volume).

The olefin or mixture of olefins usually has an MON value of 70-90, usually a RON value of 85-95 and a ROAD value of 80-92.

The volume amount of olefin(s) in total in the motor gasoline composition of part (a) of the invention may be 0% or 0-30%, e.g. 0.1-30% such as 1-30% in particular 2-25, 5-30, (especially 3-10), 5-18.5, 5-18 or 10-20%. Preferably the composition contains at least 1% olefin and a maximum of 18% or especially a maximum of 14%, but may be substantially free of olefin.

The compositions suitable for mogas or avgas use may also contain at least one aromatic compound, e.g. a liquid one of 6-9 e.g. 6-8 or 7-9 carbons preferably an alkyl aromatic compound such as toluene (which is preferred) or o, m, or p xylene or a mixture thereof or a trimethyl benzene. The aromatics may have been added as single compounds e.g. toluene, or may be added as an aromatics mixture containing at least 30% w/w aromatic compounds such as 30-100% especially 50-90%. Such mixtures may be made from catalytically reformed or cracked gasoline obtained from heavy naphtha. Example of such mixtures are (xxi) catalytic reformate and (xxii) heavy reformate. Amounts of the single compounds e.g. toluene in the composition suitable for mogas use may be 0-35%, such as 2-33% e.g. 10-33%, while amounts of the aromatics mixtures especially the total of the reformates (xxi) & (xxii) (if any) in such a composition may be 0-50%, such as 1-33% e.g. 2-15% or 2-10% or 15-32% v/v, and total amount of reformates (xxi), (xxii) and added single compounds (e.g. toluene) may be 0-50% e.g. 0.5-20% or 5-40, such as 15-35 or 5-25% v/v. In compositions especially suitable for avgas use the amount of liquid aromatic compound in the composition may be up to 30% by volume of the total e.g. 1-30% or 5-15%.

The aromatics usually have a MON value of 90-110 e.g. 100-110 and a RON value of 100-120 such as 110-120 and a ROAD value of 95-110. The volume amount of aromatic compounds in the composition suitable for mogas use is usually 0% or 0-50% such as less than 40% or less than 28% or less than 20% such as 1-50%, 2-40%, 3-28%, 4-25%, 5-20% (especially 10-20%), 4-10% or 20-35% especially of toluene. The gasoline composition suitable for mogas or avgas may also be substantially free of aromatic compound. Amounts of aromatic compounds of less than 42%, e.g. less than 35% or especially less than 30% are preferred. Preferably the amount of benzene is less than 5% preferably less than 1.5% or 1% e.g. 0.1-1% of the total volume or less than 0.1% of the total weight of the composition.

The compositions suitable for mogas or avgas use may also contain at least one oxygenate octane booster, usually an ether, usually of Motor Octane Number of at least 96-105 e.g. 98-103. The ether octane booster is usually a dialkyl ether, in particular an asymmetric one, preferably wherein each alkyl has 1-6 carbons, in particular one alkyl being a branched chain alkyl of 3-6 carbons in particular a tertiary alkyl especially of 4-6 carbons such as tert-butyl or tert-amyl, and with the other alkyl being of 1-6 e.g. 1-3 carbons, especially linear, such as methyl or ethyl. Examples of such oxygenates include methyl tertiary butyl ether (MTBE), ethyl tertiary butyl ether and methyl tertiary amyl ether. The oxygenate may also be an alcohol of 1-6 carbons e.g. ethanol.

The volume amount of the oxygenate in the mogas composition may be 0 or 0-25% such as 1-25%, 2-20%, 2-10% or 5-20% especially 5-15%, but advantageously less than 3% such as 1-3% (especially of MTBE and/or ethanol). The oxygenate may also be substantially absent from the mogas composition or motor gasoline of part (a) of the invention.

The composition for avgas use may comprise, apart from a component (I), the hydrocarbon of formula I, a component (II) which is at least one of the known octane boosters described above especially an oxygenate octane booster, as described above.

At least one component (I) may be present in the composition for avgas use together with at least one component (II) in a combination. The combination may be, for example, triptane together with methyl tertiary butyl ether. The combination may be in a volume ratio of 40:60 to 99:1 e.g. 50:50 to 90:10, preferably 60:40 to 85:15. The volume percentage of ether may be up to 30% of the total composition e.g. 1-30%, such as 1-15% or 5-25%.

The motor octane number of the aviation gasoline of part (a) of the invention is at least 98, for example 98-103, preferably 99 to 102. Motor Octane Numbers are determined according to ASTM D 2700-92. The hydrocarbons of formula I may also, especially when present in amount of at least 30% by volume, be used to provide aviation gasolines of part (a) of the invention with a Performance Number (according to ASTM D909) of at least 130 e.g. 130-170.

The amount of the hydrocarbon of Formula I alone or with component II may be present in the composition suitable for avgas use in an effective amount to boost the Motor Octane Number to at least 98 and may be in a percentage of from 35-92%, preferably 60-90%, especially 70-90% by volume, based on the total volume of the composition. In particular the compound of formula I is usually in the composition in a percentage of 5-90%, 10-80%, 20-60% more especially 30-50% by volume, based on the total composition, though amounts of the compound of formula I of 10-45% are also very valuable; preferred are 20-90% or 40-90% or 50-90% by volume.

Component (b) may be a combination of at least one component (III) together with at least one component (IV). The combination may be, for example, butane or isopentane together with iso-octane, and the combination may be in a volume ratio of 10:90 to 90:10, preferably 10:50 to 50:90, especially 15:85 to 35:65, in particular with butane or especially isopentane together with iso-octane. Especially preferred is the combination of isopentane together with iso-octane, in particular, in the above proportions, and optionally butane.

In another preferred embodiment, triptane and isopentane and optionally n-butane are present in the composition of part (a) of the invention suitable for avgas use with 80-90% triptane and in particular in relative volume ratios of 80-90:10-15:0-3.5.

In a preferred embodiment of part (a) of this invention component (a) e.g. for avgas use is 2,2,3 trimethylbutane and component (b) is isopentane in combination with iso-octane, preferably in relative volume ratios of 10-80:5-25:10:80 in particular 30-50:5-25:35-60 or 15-45:10-18:45-75 or 60-80:10-18:10-25. Especially the composition contains 30-80% of triptane and the isopentane and iso-octane are in a volume ratio of 35-15:65-85.

In a further preferred embodiment of part (a) of this invention the composition suitable for avgas use comprises component (a) as 2,2,3 trimethylbutane, methyl tertiary butyl ether and component (b) as isopentane in combination with n-butane, preferably in relative volume ratios of 50-90:5-30:10-15:0.1-3.5 in particular 50-80:10-25:10-15:0.1-3.5.

For use in avgas preferred compositions may contain 50-95% e.g. 50-80% triptane, 5-25% e.g. 10-25% component (b) e.g. isopentane and 5-30%, for example toluene. The benzene content of the composition is preferably less than 0.1% by volume.

In another preferred embodiment the composition suitable for avgas may comprise both the aromatic hydrocarbon and the ether. In this case a preferred composition may comprise 45-80% triptane 5-30% ether (with a preferred total of both of 70-85%), 10-25% component (b) (III) e.g. iso-pentane (optionally containing butane) and 5-20% toluene, all by volume.

The compositions suitable for avgas may also comprise 10-90% e.g. 25-85%, 35-80%, or 35-90% by volume of triptane, 5-75% e.g. 8-55% by volume of a mixture predominantly of iso $C_7$ and iso $C_8$ hydrocarbons, but usually with small amounts of iso $C_6$ and iso $C_9$ hydrocarbons and 5-40% e.g. 8-40% or 5-35% or 8-25% by volume isopentane. The triptane and mixture may be obtained as a distillation fraction obtained by the processing of crude oil and subsequent reactions as described above.

Composition suitable for use in formulated avgas may comprise the compound of formula 1 e.g. triptane with as component (b) at least one of isomerate and alkylate especially a cut boiling at 90-170° C. e.g. 95-125° C., especially both, and in particular in volume ratios of 1:4 to 4:1 e.g. 1:1 to 1:3. Examples of such compositions contain (and preferably consist essentially of 40-80% such as 50-70% triptane and 20-60% of said component (b), in particular both isomerate and the alkylate, especially with at least 5% of each e.g. 5-40% such as 5-20% (e.g. of isomerate) and 15-35% (e.g. of alkylate cut).

Aromatic amines e.g. liquid ones such as aniline or alkyl ones e.g. m-toluidine may be present, if at all, in amount of less than 5% by volume for mogas or avgas, and are preferably substantially absent in compositions for mogas or avgas e.g. less than 100 ppm. The relative volume ratio of the amine to triptane is usually less than 3:1 e.g. less than 1:2.

The compositions of part (a) of the invention contains components (a) and (b), and the formulated unleaded motor gasoline also contains at least one motor gasoline additive, for example as listed in ASTM D-4814 the contents of which is herein incorporated by reference or specified by a regulatory body, e.g. US California Air Resources Board (CARB) or Environmental Protection Agency (EPA). These additives are distinct from the liquid fuel ingredients, such as MTBE. Such additives may be the lead free ones described in Gasoline and Diesel Fuel Additives, K Owen, Publ. By J. Wiley, Chichester, UK, 1989, Chapters 1 and 2, U.S. Pat. No. 3,955,938, EP 0233250 or EP 288296, the contents of which are herein incorporated by reference. The additives maybe pre-combustion or combustion additives. Examples of additives are anti-oxidants, such as one of the amino or phenolic type, corrosion inhibitors, anti-icing additives e.g. glycol ethers or alcohols, engine detergent additives such as ones of the succinic acid imide, polyalkylene amine or polyether amine type and anti-static additives such as ampholytic surface active agents, metal deactivators, such as one of thioamide type, surface ignition inhibitors such as organic phosphorus compounds, combustion improvers such as alkali metal salts and alkaline earth metal salts of organic acids or sulphuric acid monoesters of higher alcohols, anti valve seat recession and additives such as alkali metal compounds, e.g. sodium or potassium salts such as borates or carboxylates, and colouring agents, such as azodyes. One or more additives (e.g. 2-4) of the same or different types may be used, especially combinations of at least one antioxidant and at least one detergent additive. Anti-oxidants such as one or more hindered phenols e.g. ones with a tertiary butyl group in one or both ortho positions to the phenolic hydroxyl group are preferred in particular as described in Ex. 1 hereafter. In particular the additives may be present in the composition in amounts of 0.1-100 ppm e.g. 1-20 ppm of each, usually of an antioxidant especially one or more hindered phenols. Total amounts of additive are usually not more than 1000 ppm e.g. 1-1000 ppm.

The compositions whether for mogas or avgas and corresponding gasolines are free of organolead compounds e.g. are free of added lead such as less than 0.013 gPb/l, and usually of manganese additives such as manganese carbonyls.

The composition of part (a) of the invention for use in avgas may contain at least (one aviation gasoline additive, for example as listed in ASTM D-910 or DEF-STAN 91-90; examples of additives are anti-oxidants, corrosion inhibitors, anti-icing additives e.g. glycol ethers or alcohols and anti-static additives, especially antioxidants such as one or more hindered phenols; in particular the additives may be present in the composition in amounts of 0.1-100 ppm e.g. 1-20 ppm, usually of an antioxidant especially one or more hindered phenols. A coloured dye may also be present to differentiate the aviation gasoline from other grades of fuel. The formulated avgas is suitable for use to power piston engine aircraft.

The compositions and gasolines, especially for mogas may contain up to 0.1% sulphur, e.g. 0.000-0.02% such as 0.002-0.01% w/w.

The motor gasoline compositions of part (a) of the invention usually have a MON value of at least 80 e.g. 80-110 or 80-105 such as 98-105 or preferably 80 to less than 98, such as 80-95, 83-93 or 93-98. The RON value is usually 90-120 e.g. 102-120 or preferably 90-102 preferably 90-100 e.g. 90-99, such as 90-93 e.g. 91, or 93-98 e.g. 94.5-97.5, or 97-101 while the ROAD value is usually 85-115 e.g. 98-115 or preferably 85-98 such as 85-95 e.g. 85-90, or 90-95 or 95-98. Preferred gasoline compositions have MON 80-83, RON 90-93, and ROAD 85-90, or MON 83-93, RON 93-98 and ROAD 85-95 or MON 83-93, RON 97-101 and ROAD 90-95. The Net calorific value of the gasoline (also called the Specific Energy) is usually at least 18000 Btu/lb e.g. at least 18500, 18700 or 18,900 such as 18500-19500, such as 18700-19300 or 18900-19200; the calorific value may be at least 42 MJ/kg e.g. at least 43.5 MJ/kg such as 42-45 or 43-45 such as 43.5-44.5 MJ/kg. The gasoline usually has a boiling range (ASTM D86) of 20-225° C., in particular with at least 2% e.g. 2-15% boiling in the range 171-225° C. The gasoline is usually such that at 70° C. at least 10% is evaporated while 50% is evaporated on reaching a temperature in the range 77-120° C. preferably 77-116° C. and by 185° C., a minimum of 90% is evaporated. The gasoline is also usually that 10-50% may be evaporated at 70° C., 40-74% at 100° C., 70-97% at 150° C. and 90-99% may be evaporated at 180° C. The Reid Vapour Pressure of the gasoline at 37.8° C. measured according to ASTM D323 is usually 30-120, e.g. 40-100 such as 61-80 or preferably 50-80, 40-65, e.g. 40-60 or 40-50 Kpa.

The gasoline compositions, when free of any oxygenates usually have a H:C atom ratio of at least 1.8:1 e.g. at least 2.0:1 or at least 2.1 or 2.2:1, such as 1.8-2.3:1 or 2.0-2.2:1. Advantageously the gasoline composition meets the following criteria.

$$\text{Atom } H{:}C \times [1 + oxy] \times \left[\text{Net } \frac{\text{Heat of}}{200} \text{ Combustion} + \text{ROAD}\right] \geq y,$$

wherein Atom H:C is the fraction of hydrogen to carbon in the hydrocarbons in the composition, oxy means the molar fraction of oxygenate, if any in the composition, Net Heat of Combustion is the energy derived from burning 1 lb (454 g) weight of fuel (in gaseous form) in oxygen to give gaseous water and carbon dioxide expressed in Btu/lb units [MJ/kg times 430.35], and y is at least 350, 380, 410 or 430, in particular 350-440 e.g. 380420 especially 400-420.

The unleaded aviation gasoline composition of part (a) of the invention usually has a calorific value (also called Specific Energy) of at least 42 MJ/kg (18075 BTU/lb) e.g. at least 43.5 MJ/kg (18720 BTU/lb) such as 42-46 or 43.5-45 MJ/kg. The gasoline usually has a boiling range (ASTM D86) of 25-170° C. and is usually such that at 75° C. 10-40% by volume is evaporated, at 105° C. a minimum of 50% is evaporated, at 135° C. a minimum of 90% is evaporated; the final boiling point is usually not more than 170° C. preferably 80-130° C. The gasoline usually has a maximum freezing point of −60° C. in particular −40° C. The Reid Vapour Pressure of the gasoline at 37.8° C. measured according to ASTM D323 is usually 30-60 kPa preferably 38-60 e.g. 38-55 or especially 38-49 or 45-55 kPa.

Preferably the motor gasoline of part (a) of this invention comprises 10-90% of triptane, 10-80% of component (b), 0-25% naphtha, 0-15% of butane, 5-20% of olefin, 3-28% aromatics and 0-25% oxygenate, in particular with 5-20% aromatics and 5-15% olefins.

In a preferred embodiment of part (a) of this invention the motor gasoline of part (a) of this invention contains 8-65% of triptane (especially 15-35%), 0.1-30% such as 2-25% olefins, especially 3-14% and 0-35% aromatics such as 0-30% e.g. 5-35, 5-20 (especially 5-15%) or 20-30%, and 5-50% component (b) mixtures e.g. 10-45% such as 20-40%. Such gasolines may also contain oxygenates, such as MTBE especially in amount of less than 3% e.g. 0.1-3% and especially contain less than 1.5% benzene e.g. 0.1-1%. Such gasolines preferably have RON of 97-99, MON 87-90 and ROAD values of 92-94.5.

Examples of motor gasolines of part (a) of the invention are ones with 5-25% triptane, 5-15% olefins, 15-35% aromatics and 40-65% component (b), in particular 15-25% triptane, 7-15%, olefins 15-25% aromatics and 45-52% component (b) mixture of RON value 96.5-97.5, or 5-15% triptane, 7-15% olefins, 15-25% aromatics and 55-65% compound (b) of RON value 94.5-95.5.

Examples of motor gasolines of part (a) of the invention are ones having 1-15% e.g. 3-12% butane, 0-20% e.g. 5-15% ether e.g. MTBE, 20-80 e.g. 25-70% of refinery mixed liquid (usually $C_6$-$C_9$) streams (apart from naphtha) (such as mixtures of (i)-(iv) above), 0-25% e.g. 2-25% naphtha, 5-70% e.g. 15-65% triptane, with RON 93-100 e.g. 94-98, MON 80-98 e.g. 83-93 or 93-98, and RVP 40-80 such as 40-65 Kpa. Such gasolines usually contain 1-30% e.g. 2-25% olefins and 2-30% e.g. 4-25% aromatics. Amounts of olefins of 15-25% are preferred for RON values of 94-98 e.g. 94-96 and 2-15% e.g. 2-7% for RON values of 96-100 such as 96-98.

Other examples of motor fuel compositions of part (a) of the invention contain 8-18% triptane, 10-50% e.g. 25-40% of total component (b) mixture, 5-40% e.g. 20-35% of total aromatics mixture 15-60, e.g. 15-30% or 40-60% of total olefinic mixture and 0-15% total oxygenate e.g. 3-8% or 8-15%. Especially preferred compositions have 8-18% triptane, 25-40% total mixed component (b) mixture, 20-35% total aromatics, and 15-30% total olefinics, or 8-18% triptane, 15-40% total mixed component (b) mixture, 3-25% total aromatics mixture, and 40-60% total olefinic mixture.

Further examples of motor fuel compositions contain 20-40% triptane, 8-55% of the total component (b) mixture, e.g. 5-25% or 35-55%, and 0 or 5-25% e.g. 18-25% total aromatics mixture, 0-55 especially 10-55 or 40-55% total olefin mixture, especially preferred compositions having 20-40% triptane, 5-25% total component (b) mixtures, 3-25% total aromatics mixture and 40-60% total olefinic mixture, or 20-40% triptane, 35-55% total component (b) mixture 15-30% total aromatics mixture and 0-15% e.g. 5-15% total olefin mixture, or in particular 20-40% triptane, 25-45% or 30-50% total component (b) mixture, 2-15% total aromatics mixture 18-35% total olefins mixture, and especially 3-10% or 5-18% olefins, and 10-35% such as 10-20% aromatics (e.g. 10-18%).

Example of motor fuel compositions contain 30-55% e.g. 40-55% triptane, 5-30% total component (b) mixture 0-10% total aromatic mixture, 10-45% olefinic mixture and 0-15% oxygenates especially with the total of oxygenates and olefinic mixture of 20-45%. Other examples of fuel compositions contain 55-70% triptane, 10-45% total component b, e.g. 10-25% or 35-45%, and 0-10% e.g. 0 or 0.5-5% total aromatics Mixture, and 0-30% total olefinics mixtures, e.g. 0 or 15-30%, especially 55-70% triptane 10-25% total component (b) 0 or 0.5-5% total aromatics mixture and 15-30% total olefinic mixture.

Particularly preferred examples of motor fuel composition comprise 15-35% e.g. 20-35% triptane, 0-18.5% e.g. 2-18.5% olefin, 5-40% e.g. 5-35% aromatics 25-65% saturates and less than 1% benzene, and 18-65% e.g 40-65% triptane, 0-18-5% e.g. 5-18.5% olefins, 5-42% e.g. 5-28% aromatics, 35-55% saturates and less than 1% benzene.

Another motor fuel composition may comprise 25-40% e.g. 30-40% such as 35% of alkylate, 10-25% e.g. 15-25% such as 20% of isomerate, 10-25% e.g. 15-25% such as 20% of light hydrocrackate and 20-35% e.g. 20-30% such as 25% of triptane and optionally 0-5% butane. Such a composition is preferably substantially paraffinic and is substantially free of olefins and aromatics.

Other motor fuel compositions of part (a) of the invention may have different ranges of the Antiknock Index (also known as The ROAD Index), which is the average of MON and RON.

For ROAD Indexes of 85.5-88.5, the compositions suitable for mogas use may comprise 8-30% triptane e.g. 15-30%, and 10-50% e.g. 20-40% total component (b) mixture, 5-30%, e.g. 5-20% total olefins and 10-40 e.g. 15-35% total aromatics, or 8-30% triptane, 10-50% total component (b) mixture, 5-40% total aromatic mixtures e.g. 20-30% and 10-60% e.g. 30-55% total olefinic mixtures.

For ROAD Indexes of 88.5-91.0 the compositions suitable for mogas use may comprise 5-25% (or 5-15%) triptane, 20-45% total component (b) mixture, 0-25% e.g. 1-10 or 10-25% total olefins, and 10-35% e.g. 10-20% or 20-35% total aromatics or 5-25% (5-15%) triptane, 20-45% total component (b) mixture, 0-35% total aromatic mixtures e.g. 1-15 or 15-35%, and 5-65% e.g. 5-30 or 30-65% total olefinic mixtures.

For ROAD Indexes of 91.0-94.0 the motor fuel compositions of part (a) of the invention may comprise 5-65% e.g. 5-20, 20-30, 30-65 or 40-65% triptane and 5-40% (5-35%) e.g. 5-12 or 12-40% (12-30%) total component (b) mixture 1-30% e.g. 1-10 or 10-25% total olefins and 5-55% e.g. 5-15 or 15-35 or 35-55% total aromatics, or the above amounts of triptane with 0-55 e.g. 0.5-25% e.g. 10-25% or 25-55% of aromatic fractions and 0 or 10-60% e.g. 10-30% or 35-60% total olefin fractions.

For ROAD values of 94-97.9, the motor fuel compositions may comprise 20-65% triptane e.g. 40-65% triptane, 0-15% e.g. 5-15% total olefins, 0-20% e.g. 5-20% total aromatics and 5-50 e.g. 30-50% total component (b) mixture, or the above amounts of triptane and total component (b) mixture with 0-30% e.g. 10-30% aromatic fractions and 0-30 e.g. 5-30% olefinic fraction, or the above amounts of triptane e.g. 20-40% triptane, total component b mixture, total olefins and total aromatics, with 2-15% aromatic fractions and 18-35% olefinic fractions.

Part (a) of the invention can provide motor gasolines, in particular of 91, 95, 97, 98 and 110 RON values and aviation gasoline in particular of 99-102 MON values, with desired high Octane Levels but low emission values on combustion in particular of at least one of total hydrocarbons, total air toxics, NOx, carbon monoxide, and carbon dioxide, especially of both total hydrocarbons and NOx. Thus part (a) of the invention also provides the use of a compound of formula I, in particular triptane, in unleaded motor gasoline of MON at least 80 e.g. 80 to less than 98 or in unleaded aviation gasoline of MON of at least 98, e.g. as an additive to or component therein, to reduce the emission levels on combustion, especially of at least one of total hydrocarbons, total air toxics NOx, carbon monoxide and carbon dioxide especially both of total hydrocarbons and NOx. Part (a) of the invention also provides a method of reducing emissions of exhaust gases in the combustion of unleaded motor gasoline fuels of MON of at least 80 or in unleaded aviation gasoline of MON of at least 98 which comprises having a compound of formula I present in the fuel which is a gasoline of part (a) of the invention. Part (a) of the invention also provides use of an unleaded gasoline of part (a) of the invention in a spark ignition combustion engine to reduce emissions of exhaust gases. While the compositions of part (a) of the invention may be used in supercharged or turbocharged engines, they are preferably not so used, but are used in normally aspirated ones. The compound of formula I e.g. triptane can reduce one or more of the above emission levels especially in mogas better than amounts of alkylate or a mixture of aromatics and oxygenate at similar Octane Number and usually decrease the fuel consumption as well. The compositions and gasolines of part (a) of the invention are (unleaded and can have reduced toxicity compared to ones with aromatic amines or organo leads.

According to another aspect of part (a) of the present invention there is provided an unleaded aviation fuel composition, having a Motor Octane Number of at least 98, and usually a final Boiling Point of less than 200° C. or especially 170° C., and preferably a Reid Vapour Pressure at 37.8° C. of between 35-60 especially 38-60 kPascals, which comprises:

component (a) at least one hydrocarbon having the following formula I $$R—CH_2—CH(CH_3)—C(CH_3)_2—CH_3 \quad I$$

wherein R is hydrogen or methyl and component (b) at least one saturated liquid aliphatic hydrocarbon having 4 to 10 in particular 5 or 6 carbon atoms optionally with at least one other saturated liquid aliphatic hydrocarbon having from 5 to 10 carbon atoms wherein 35-92% especially 40-78% by volume of the total composition is a hydrocarbon of formula I. Unless otherwise stated all percentages in this specification are by volume, and disclosures of a number of ranges of amounts in the composition or gasoline for 2 or more ingredients includes disclosures of all sub-combinations of all the ranges with the ingredients.

If R is hydrogen the hydrocarbon is triptane. If R is methyl the hydrocarbon is 2,2,3 trimethylpentane. Especially preferred is triptane. Triptane and 2,2,3 trimethylpentane may be used individually or in combination with each other, for example, in a weight ratio of 10:90-90:10, preferably, 30:70-70:30.

The composition may comprise apart from a component (I), the hydrocarbon of formula I, a component (II) which is at least one of the known octane boosters described above especially an oxygenate octane booster, usually an ether, usually of Motor Octane Number of at least 96-105 e.g. 98-103. The ether octane booster is usually a dialkyl ether, in particular an asymmetric one, preferably wherein each alkyl has 1-6 carbons, in particular one alkyl being a branched chain alkyl of 3-6 carbons in particular a tertiary alkyl especially of 4-6 carbons such as tert-butyl or tert-amyl, and with the other alkyl being of 1-6 e.g. 1-3 carbons, especially linear, such as methyl or ethyl. Examples of component (II) include methyl tertiary butyl ether, ethyl tertiary butyl ether and methyl tertiary amyl ether. Cyclic ethers such as furan, tetrahydro furan and their lower alkyl e.g. methyl derivatives may also be used. The oxygenate may also be an alcohol of 1-6 carbons e.g. ethanol.

At least one component (I) may be present together with at least one component (II) in a combination. The combination may be, for example, triptane together with methyl tertiary butyl ether. The combination may be in a volume ratio of 40:60 to 99:1 e.g. 50:50 to 90:10, preferably 60:40 to 85:15. The volume percentage of ether may be up to 30% of the total composition e.g. 1-30%, such as 1-15% or 5-25%. The unleaded blend composition may also be substantially free of any oxygenate octane booster e.g. ether or alcohol.

The motor octane number of the aviation gasoline of part (a) of the invention is at least 98, for example 98-103, preferably 99 to 102 or especially 100-101.5. Motor Octane Numbers are determined according to ASTM D 2700-92. The hydrocarbons of formula I may also, especially when present in amount of at least 30% by volume, be used to provide gasolines of part (a) of the invention with a Performance Number (according to ASTM D909) of at least 130 e.g. 130-170.

Triptane or 2,2,3 trimethylpentane may be used in a purity of at least 95% but is preferably used as part of a hydrocarbon mixture obtained, via distillation of a cracked residue, which is an atmospheric or vacuum residue from crude oil distillation, to give a $C_4$ fraction containing olefin and hydrocarbon, alkylation to produce a $C_{4-9}$ especially a $C_{6-9}$ fraction which is distilled to give a predominantly $C_8$ fraction, which usually contains trimethyl pentanes including 223 trimethyl pentane and/or 233 trimethyl pentane. To produce triptane this fraction can be demethylated to give a crude product comprising at least 5% of triptane, which can be distilled to increase the triptane content in the mixture; such a distillate may comprise at least 10% or 20% of triptane and 2,2,3 trimethylpentane but especially at least 50% e.g. 50-90% the rest being predominantly of other aliphatic C7 and C8 hydrocarbons e.g. in amount 10-50% by volume.

Triptane may be prepared generally as described in Rec. Trav. Chim. 1939, Vol. 58 pp 347-348 by J P Wibaut et al, which involves reaction of pinacolone with methyl magnesium iodide followed by dehydration (e.g. with sulphuric acid) to form triptene, which is hydrogenated e.g. by catalytic hydrogenation to triptane. Alternatively triptane and 2,2,3 trimethylpentane may be used in any commercially available form.

Part (a) of the invention will be further described with triptane exemplifying the compound of formula I but 2,2,3 trimethylpentane may be used instead or as well.

The amount of the hydrocarbon of Formula I alone or with component II may be present in the composition in an effective amount to boost the Motor Octane Number to at least 98 and may be in a percentage of from 35-92%, preferably 60-90%, especially 70-90% by volume, based on the total volume of the composition. In particular the compound of formula I is usually in the composition in a percentage of 30-60% more especially 30-50% by volume, but based on the total composition, preferred are 40-90% or 50-90% or most especially 45-70%.

The composition also comprises a component (b). Component (b) is at least one saturated aliphatic liquid hydrocarbon of 4 to 10 preferably 5 to 8 in particular 5 or 6 carbon atoms, alone or with at least one saturated aliphatic liquid hydrocarbon (different from component (a)) having from 4 to 10 carbons in particular 5 to 10 carbon atoms, preferably 5 to 8 carbon atoms, especially in combination with one of 4 carbons. Component (b) may comprise a component (III) which is more volatile and has a lower boiling point than component (a) in particular one boiling at least 30° C. such as 30-60° C. below that of triptane at atmospheric pressure, and especially is itself of Motor Octane Number greater than 88 in particular at least 90 e.g. 88-93 or 90-92. Examples of component (III) include alkanes of 5 carbons in particular isopentane, which may be substantially pure or a crude hydrocarbon fraction from alkylate or isomerate (eg of Bp 25-80° C.) containing at least 30% e.g. 30-80% such as 50-70%, the main contaminant being up to 40% mono methyl pentanes and up to 50% dimethyl butanes. The amount of isopentane in the composition is usually 3-35% eg 5-35, 5-25, 5-15, 10-18% or 1-10% such as 3-10%. When the isopentane is added to make the composition in the form of the crude fraction from alkylate or isomerate with at least 30% isopentane, the volume amount of alkylate fraction or isomerate may be 6-70%, eg 7-50% especially 6-44, eg 6-17 or 10-44%. Component (III) of boiling point 30-60° C. less than that of triptane may be used as sole component (III) but may be mixed with an alkane of boiling point 60-100° C. less than that of triptane e.g. n and/or iso butane in blends of 99.5:0.5 to 50:50 such as 88:12 to 70:30, e.g. 88:12 to 75:25 or 70:30 to 50:50. Iso-pentane alone or mixed with n-butane is preferred, especially in the above proportions. In particular a volume amount of butane in the composition is up to 7% such as up to 6.5 or 5.5% e.g. up to 3.5% e.g. 1-3.5% or 2-3.5%, or 1.5-5.5% or 2-7 such as 3.5-5.5%

Component (b) may also comprise a component (IV) having a boiling point higher than component (a) preferably one boiling at least 18° C. more than the compound of formula I e.g. triptane such as 20-60° C. more than triptane but less than 170° C. and usually is of Motor Octane Number of at least 92 e.g. 92-100; such components (IV) are usually alkanes of 7-10 carbons especially 7 or 8 carbons, and in particular have at least one branch in their alkyl chain, in particular 1-3 branches, and preferably on an internal carbon atom and especially contain at least one —$C(CH_3)_2$— group. An example of component (IV) is iso-octane.

The amount of component IV in particular isooctane (224 trimethylpentane) in the composition may be zero, but is usually 10-80% eg 12-48%, 10-35, 10-25, 35-60 or 45-75% but may be 1-25% e.g. 1-10% or 5-20%. The component IV especially isooctane may be added as such to form the composition, and/or may be added in the form of a fraction comprising at least 30% of said component IV especially isooctane such as 30-80% such as 40-60%; examples of such as fractions are alkylate fractions eg bp (1 bar pressure) of 85-135° C. and 90-115° C. or 95-105° C. Such fractions may be mixtures predominantly of branched chain eg iso $C_8$ hydrocarbons (eg at least 50% or 60% of the mixture) especially mixtures predominantly of iso $C_7$ and iso $C_8$ hydrocarbons and usually with small amounts (eg 1-20% (of the mixture) of either or both) of iso $C_6$ and iso $C_9$ hydrocarbons. Amounts of such fractions in the composition may be 2-55% e.g. be 8-55% e.g. 12-52% or 2-15 or 5-15%. Blends of such fractions with added component IV eg isooctane may be used, in particular with 10-35% IV (eg isooctane) and 5-55% fractions eg alkylate fractions (especially predominantly iso $C_8$ hydrocarbon) such as 8-25%.

Component (b) may be a combination of at least one component (III) together with at least one component (IV). The combination may be, for example, butane or isopentane together with iso-octane, and the combination may be in a volume ratio of 10:90 to 90:10, preferably 10:50 to 50:90, especially 15:85 to 35:65 or 15-50:85-50, in particular with butane or especially isopentane together with iso-octane. Especially preferred is the combination of isopentane together with iso-octane, in particular, in the above proportions, and optionally butane.

In another preferred embodiment, triptane and isopentane and optionally n-butane are present in the composition of part (a) of the invention with 80-90% triptane and in particular in relative volume ratios of 80-90:10-15:0-3.5.

In a preferred embodiment of part (a) of this invention component (a) is 2,2,3 trimethylbutane and component (b) is isopentane in combination with iso-octane, preferably in relative volume ratios of 10-80: 5-25:10-80 in particular 30-50: 5-25:35-60 or 1545: 10-18:45-75 or 60-80:10-18: 10-25. Especially the composition contains 30-80% of triptane and the isopentane and iso-octane are in a volume ratio of 35-15: 65-85.

In a most preferred embodiment the composition of part (a) of the invention comprises as Component (a) 223 trimethyl butane in an amount of 40-90% and as component (b) an isomerate fraction comprising 30-70% isopentane (the amount of isomerate being 6-47% in the composition, isooctane in amount of 10-35% and 1-3.5% butane, the isooctane being present as such and/or mixed with other hydrocarbons in an isooctane containing fraction. Especially preferred compositions comprise 40-60% triptane, 6-17% isomerate, 10-35% isooctane, 1-3.5% butane, the isooctane being especially at least partly (eg at least 20% such as 30-60%) present in a mixture predominantly of iso $C_7$ and iso $C_8$ hydrocarbons, with small amounts of iso $C_6$ and iso $C_9$ hydrocarbons (said mixture providing 8-55% of the total volume of the composition).

In a further preferred embodiment of part (a) of this invention the composition comprises component (a) as 2,2,3 trimethylbutane, methyl tertiary butyl ether and component (b) as isopentane in combination with n-butane, preferably in relative volume ratios of 50-90:5-30:10-15:0.1-3.5 in particular 50-80:10-25:10-15:0.1-3.5.

If desired the composition may comprise an aromatic liquid hydrocarbon of 6-9 e.g. 6-8 or 7-9 carbons, such as xylene or a trimethyl benzene, preferably toluene, in particular in amounts of up to 30% by volume of the total composition e.g. 1-30% or 5-30%, such as 5-20% or 5-15% or 1-15% such as 2-15% e.g. 2-10%. In this case a preferred embodiment is a composition that may thus contain 15-95% or 15-90%, 50-95% e.g. 15-80% or 50-80% triptane, 5-25% e.g. 10-25% component (b) e.g. isopentane and 5-30%, for example toluene. The benzene content of the composition is preferably less than 0.1% by volume. The gasoline composition suitable for avgas may also be substantially free of aromatic compound. Amounts of aromatic compounds of less than 42% or 40%, e.g. less than 35% or especially less than 30% or 20% are preferred. Preferably the amount of benzene is less than 5% preferably less than 1.5% or 1% e.g. 0.1-1% of the total volume or less than 0.1% of the total weight of the composition. The aromatic hydrocarbon(s) is preferably in an reformate fraction e.g. of bp100-140° C.

In another preferred embodiment the composition may comprise both the aromatic hydrocarbon and the ether or just the aromatic hydrocarbon. In this case a preferred composition may comprise 45-80% triptane 0% or 5-30% ether (with a preferred total of both of 70-85%), and either with 10-25% component (b) (III) e.g. iso-pentane (optionally containing butane) and 5-20% toluene, all by volume, or with 3-15% component (b) III of the total of isopentane and butane (if present) and 2-15% toluene and 1-20% such as 5-15% tert-butyl benzene.

The compositions may also comprise 10-90% e.g. 25-85%, 35-80%, or 35-90% by volume of triptane, 5-75% e.g. 8-55% by volume of a mixture predominantly of iso $C_7$ and iso $C_8$ hydrocarbons, but usually with small amounts of iso $C_6$ and iso $C_9$ hydrocarbons and 5-40% e.g. 8-40% or 5-35% or 8-25% by volume isopentane. The triptane and mixture may be obtained as a distillation fraction obtained by the processing of crude oil and subsequent reactions as described above.

Other compositions of part (a) of the invention comprise by volume (i) 60-90% e.g. 70-85% triptane, (ii) 2-20% of component III or an alkane of 4-7 carbons (or mixture thereof), at least the majority of which boils below triptane, such as 2-10% isomerate or 5-20% isopentane, (iii) 0 or up to 15% such as 2-15% liquid aromatic hydrocarbon e.g. toluene or xylene or a mixture of hydrocarbons containing at least a majority thereof, e.g. substantially all aromatics as in a reformate fraction (e.g. of boiling point 105-135° C.) and (iv) 0 or up to 15% e.g. 2-15% of component IV which may be isooctane or an alkylate fraction (e.g. of bp 95-105° C.), and (v) 0 or up to 7% e.g. 2-7% butane.

Composition suitable for use in formulated avgas may comprise the compound of formula 1 e.g. triptane with as component (b) at least one of isomerate and alkylate especially a cut boiling at 90-170° C. e.g. 95-125° C., especially both, and in particular in volume ratios of 1:4 to 4:1 e.g. 1:1 to 1:3. Examples of such compositions contain (and preferably consist essentially of 40-80% such as 50-70% triptane and 20-60% of said component (b), in particular both isomerate and the alkylate, especially with at least 5% of each e.g. 5-40% such as 5-20% (e.g. of isomerate) and 15-35% (e.g. of alkylate cut).

The compositions of part (a) of the invention may also contain an aromatic compound containing a benzene nucleus substituted by at least 1 (e.g. 1 or 2 especially 1) branched chain alkyl substituent of 3-5 carbon atoms i.e. a secondary or especially tertiary alkyl group hereinafter called component $I^1$. More than 1 group may be present of the same or a different type and in o, m or p position. Examples of such groups are isopropyl, isobutyl, secbutyl, tertbutyl, isoamyl, sec amyl, neopentyl and tertamyl; tertiary butyl is preferred, so the preferred compound is tert butyl benzene. The volume amount of this substituted aromatic compound may be 0% or 1-30% such as 2-25 e.g. 5-15%.

Examples of unleaded aviation gasoline compositions with such or substituted aromatic compound are ones with 2-7% e.g. 3.5-5.5% butane 0% or 1-15 such as 3-10% isopentane, 50-90% triptane especially 50-70% or 70-90%, 0% or 1-25% e.g. 1-10 or 5-20% or 10-25% isooctane, 0%, 1-15% or 2-15% e.g. 2-10% toluene, 0% or 5-30% asymmetric dialkylether such as methyl tert butyl ether or especially ethyl tert butyl ether, and 1-20% eg. 5-15% tert butyl benzene. Such compositions can have Reid Vapour Pressure at 37.8° C. of 35–50 kPa, while MON is usually 99.5-104 e.g. 100-102.

Such branched chain alkyl substituted benzenes are commercial available materials and may be made by known means. Thus they may be made by alkylation of benzene with an olefin of 3-5 carbons especially one with a branch methyl or ethyl group or an internal olefinic carbon atom e.g. a 2-alkyl substituted olefin e.g. 2-methyl butene 1 (isobutene) or 2 ethyl butene-1 (iso pentene) or propylene. The alkylation is usually in the presence of a Friedel Crafts or Bronsted Acid catalyst e.g. iron or aluminium chloride or sulphuric acid or boron trifluoride. The alkylation gives predominantly monosubstitution especially with the tert butyl group, but there may be some e.g. up to 10% di-substituted product e.g. in o or p position; the crude alkylation product may be used in the gasolines as such or after purification to 95%+purity.

The unleaded aviation gasoline composition of part (a) of the invention usually has a net calorific value (also called Specific Energy) of at least 42 MJ/kg (18075 BTU/lb) e.g. at least 43.5 MJ/kg (18720 BTU/lb) such as 4246 or 43.5-45 MJ/kg. The gasoline usually has a boiling range (ASTM D86) of 25-170° C. and is usually such that at 75° C., 8-40% such as 10-40% or 8-25% by volume is evaporated, at 105° C. a minimum of 50% is evaporated e.g. 50-100 especially 85-100%, at 135° C. a minimum of 90% e.g. 90-100% such as 96-100% is evaporated; the final boiling point is usually not more than 170° C. preferably 80-140° or 80-130° C. The gasoline usually has a maximum freezing point of −40° C., in particular −55 or −60° C. e.g. a freezing point of −40° to −90° C. such as −70 to −90° C. The Reid Vapour Pressure of the gasoline at 37.8° C. measured according to ASTM D323 is usually 30-60 kPa preferably 35-60 e.g. 38-55 or especially 38-49 or 45-55 kPa.

Unleaded gasoline compositions of part (a) of the invention comprising a branched chain alkyl substituted benzene as described above usually have a boiling range (ASTM D86) of 30-200° C. e.g. 35-190° C. with an initial boiling point of 35-45° C., and are usually such that the temperature for distillation of 10% of the gasoline is 60-100° C. e.g. 65-80° C. or 80-90° C. the 40% distillation temperature is at least 0.5-8° C. greater e.g. 8-15° C. greater, e.g. 75-110 such as 80-90 or 90-105° C., the 50% distillation temperature is usually at least 0.5° C. higher e.g. 0.5-3° C. higher such as 80-110 such as 81-91 or 95-105° C. the 90% distillation temperature is at least 20° C. higher still e.g. 20-120° C. or 20-45° C. or 40-90° C. higher, such as 105-190° C. e.g. 105-130° C. or 130-190° C. such as 105-120° C. or 115-130° C., the sum of the 10% and 50% distillation temperatures are usually 150-200, such as 150-165 or 180-195° C. and the final boiling point of at least 50-75° C. such as 50-65° C. higher than the 90% distillation figure, such as 175-195 e.g. 178-190° C. The freezing point and RVP are usually as described above. These values for the gasolines with the substituted alkyl benzene usually apply whether the gasoline also contains compound (a) e.g. triptane or not.

The composition of part (a) of the invention may contain at least one aviation gasoline additive, for example as listed in ASTM D-910 or DEF-STAN 91-90; examples of additives are anti-oxidants, corrosion inhibitors, anti-icing additives e.g. glycol ethers or alcohols and anti-static additives, especially antioxidants such as one or more hindered phenols; in particular the additives may be present in the composition in amounts of 0.1-100 ppm e.g. 1-20 ppm, usually of an antioxidant especially one or more hindered phenols. A coloured dye may also be present to differentiate the aviation gasoline from other grades of fuel.

Aromatic amines e.g. liquid ones such as aniline or alkyl ones e.g. m-toluidine may be present, if at all, in amount of less than 5% by volume, and are preferably substantially absent in the avgas compositions e.g. less than 100 ppm. The relative volume ratio of the amine to triptane is usually less than 3:1 e.g. less than 1:2. The compositions of part (a) of the invention may also contain other engine performance enhancing fluids, such as methanol/water mixtures (though these are preferably absent) or maybe used with nitrous oxide injection in the combustion air or cylinder.

Part (a) of the invention can provide aviation gasoline in particular of 99-102 MON values, with desired high Octane Levels but low emission values on combustion in particular of at least one of total hydrocarbons, total air toxics, NOx, carbon monoxide, and carbon dioxide, especially of both total hydrocarbons and NOx. Thus part (a) of the invention also provides the use of a compound of formula I, in particular triptane, in unleaded aviation gasoline of MON of at least 98, e.g. as an additive to or component therein, to reduce the emission levels on combustion, especially of at least one of total hydrocarbons, total air toxics NOx, carbon monoxide and carbon dioxide especially both of total hydrocarbons and NOx. Part (a) of the invention also provides a method of reducing emissions of exhaust gases in the combustion of unleaded aviation gasoline of MON of at least 98 which comprises having a compound of formula I present in the fuel which is a gasoline of part (a) of the invention. Part (a) of the invention also provides use of an unleaded gasoline of part (a) of the invention in a spark ignition combustion engine to reduce emissions of exhaust gases. Part (a) of the invention also provides a method of reducing the exhaust gas temperature of a spark ignition combustion engine (e.g. an aviation engine) which comprises having a compound of formula I in the fuel which is combusted. Part (a) of the invention also provides the use of said compound to reduce the exhaust gas temperature of said engine in particular an air cooled aviation engine. In the compositions, gasolines, methods and uses of part (a) of the invention the hydrocarbon of formula 1, in particular triptane is preferably used in a emission-reducing effective amount, and/or in a exhaust-gas-temperature-reducing effective amount. While the compositions of part (a) of the invention may be used in supercharged or turbocharged engines, they are preferably not so used, but are used in normally aspirated ones. The compound of formula I e.g. triptane may reduce one or more of the above emission levels better than amounts of alkylate or a mixture of aromatics and oxygenate at similar Octane Number and usually decrease the fuel consumption as well. The compositions and gasolines of part (a) of the invention are unleaded and can have reduced toxicity compared to ones with aromatic amines or organo leads. In addition, contamination of the engine oil by toxic materials (e.g. lead compounds) is reduced and the fuel can be formulated to be highly immiscible with ground water.

As described above, the compound component I e.g. triptane or 2,2,3-trimethyl pentane may be used with the branched chain alkyl substituted benzene component $I^1$. The ratio of component I to $I^1$ being 0:1 to 100:1, such as 0:1 or 1:10 to 20:1 especially 5-10:1. Thus in a modification, component $I^1$ may be used in the substantial absence of compound I. Part (a) of the present invention also provides an unleaded aviation fuel composition having a MON value of at least 98, such as 99-102 and usually a final boiling point of less than 200° C. e.g. 180-190° C. and preferably an RVP at 37.8° C. of between 38-60 kPa, which comprises component $a^1$ which is component $I^1$ and component (b) as defined above, wherein 1-30% of the composition by volume is said component $I^1$. Part (a) of the present invention also provides a formulated unleaded aviation gasoline, which comprises at least one aviation gasoline additive and said aviation fuel composition. In addition part (a) of the present invention also provides the use of the compound component $I^1$ in unleaded aviation gasoline of MON at least 98 as an additive to or component therein to boost octane number of said gasoline. Part (a) of the present invention also provides a method of boosting octane number of an unleaded aviation gasoline, which comprising having said component I present in said gasoline.

The composition and formulated gasoline containing component $I^1$ may contain the component II, II, IV and/or an aromatic liquid hydrocarbon of 6-9 carbons, each substantially as described above.

The volume percentage of the component $I^1$ is usually 1-30% e.g. 5-28% such as 8-18 or 12-28%. The volume percentage of the ether may be to 30% of the total composition e.g. 1-30% such as 1-15% or 5-25%. The unleaded composition may also be substantially free of any oxygenate octane booster e.g. the ether or an alcohol. The MON level of this modified gasoline is at least 98 e.g. 98-103, 99-102 or especially 101 and the Performance Number (measured according to ASTM D909) at least for those gasolines with 15-30% component $I^1$ of at least 130 e.g. 130-170. Component (b) may comprise component III which has a boiling point less than 80° C., e.g. 30-60° C. below at atmospheric pressure e.g. one described above, preferably an alkane of 5 carbons e.g. isopentane, which is usually present in the composition in 0% or 1-15 such as 3-10%. This component III may be present with or substituted by an alkane of boiling point −20° to 20° C. e.g. n or isobutane in blends of 0:1 to 10:1, such as 1:3 to 3:1 or 1:2 to 2:1. The volume amount of the butane(s) in the composition is usually 1.5-10% e.g. 4-9%. The volume amount of component IV, preferably isooctane, is usually 35-80%, 45-75% such as 45-62% or 62-75%; the isooctane is preferably used substantially pure, rather than in a crude refinery fraction e.g. alkylate. Preferred blends contain butane(s):isopentane:isooctane in the volume ratios of 4-9:0-8:45-80, while preferred blends of these with tert butyl benzene are in the volume ratios 4-9:0-8:45-80:5-30. Blends of butane(s), isooctane and tert butylbenzene contain these in the volume ratio 4-9:55-75:15-30, and these blends may contain 10-20% of the ether component II.

The volume percentage of the aromatic liquid hydrocarbon (different from the branched chain component $I^1$) is usually 5-40% e.g. 8-35% such as 8-17% or 17-30%, with amounts of benzene less than 5% or 1% e.g. less than 0.1%. The total of the percentage of said liquid hydrocarbon and component $I^1$ is usually 10-35% e.g. 17-27%.

Preferred compositions and gasolines of part (a) of the invention with component $I^1$ but without component I comprise 1.5-10% of n and/or iso butane e.g. 4-9%, 0% or 1-15% such as 3-10% component III e.g. isopentane, 35-80% e.g. 35-60 or 45-75% component IV e.g. isooctane, 5-40% e.g. 8-35 or 8-20% of one or more aromatic liquid hydrocarbons e.g. toluene and/or xylene (especially with less than 1% of benzene), 0 or 1-25% such as 5-25% of one or more asymmetric dialkylethers such as MTBE and ETBE and 1-25% such as 5-15% of component $I^1$ especially tertbutyl benzene. The pure aromatic hydrocarbon e.g. toluene or xylene may be replaced by a refinery fraction containing it e.g. a reformate fraction.

The physical properties of the unleaded gasolines with component $I^1$ are usually within the same ranges as those given above for gasolines with component I and $I^1$.

The unleaded gasolines with component $I^1$ may be converted into unleaded formulated gasolines of part (a) of the invention by addition of the aviation gasoline additive as described above in the described amounts.

The gasolines of part (a) of the invention may be used in internal combustion spark ignition engines. They may be used to power moving vehicles on land and/or sea and/or in the air; part (a) of the invention also provides a method of moving such vehicles by combustion of a gasoline of part (a) of the invention. The vehicle usually has a driver and especially means to carry at least one passenger and/or freight.

The engine sizes for motor gasoline use are usually at least 45 e.g. 45-10000 e.g. at least 200 cc, such as 500-10000 cc, in particular 950-2550, such as 950-1550, or 1250-1850 cc, or 2500-10000 such as 2500-5000 or 5000-9000 cc. The engines have at least 1 cylinders, but preferably at least 2 or 3 cylinders, e.g. 3-16, especially 4-6 or 8 cylinders; each cylinder is usually of 45-1250 cc e.g. 200-1200 cc, in particular 240-520 cc or 500-1000 cc. The engines may be 2 stroke engines, but are preferably 4 stroke ones. Rotary engines e.g. of the Wankel type may be used. The motor engines may be used to power vehicles with at least 2 wheels e.g. 2-4 powered wheels, such as motor bicycles, tricycles, and 3 wheeled cars, vans and motor cars, in particular those vehicles legislated for use on a public highway but also off road e.g. 4 wheeled drive vehicles, sports cars for highway use, and racing cars, including drag racing cars and track racing cars. Engines will preferably be connected to the wheels via a gearbox and clutch system, or drive train system, to achieve the transition from a stationary to a mobile state. The engine and drive train will best allow a range of actual vehicle road speed of between 1-350 km/h, preferably between 5-130 km/h and allow for continuous variation of speed thereof. The road speed of the vehicle is usually reduced by a braking mechanism fitted to the vehicle, the braking being generally by friction. The engine may either by air or water cooled, the air motion induced by a moving vehicle being used to directly, or indirectly cool the engine. The vehicle comprises means to facilitate a change of vehicle direction, e.g. a steering wheel or stick. Usually at least 10% of the vehicle distance traveled is carried out at greater than 5 km/h.

The engines using aviation gasoline are usually in piston driven aircraft, i.e. with at least one engine driving a means for mechanically moving air such as at least one propeller. Each engine usually drives at least one propeller driving shaft with 1 or 2 propellers. The aircraft may have 1-10 propellers e.g. 2-4. The aircraft engines usually have at least 2 cylinders, e.g. 2 to 28 cylinders, each of which is preferably greater than 700 cc in volume, such as 700-2000 cc e.g. 1310 cc. The total engine size is usually 3700-50000 cc e.g. 3700 to 12000 cc for single or twin engined passenger light aircraft, 12000 to 45000 cc for 2 or 4 engined freight or airline use (e.g. 15-200 passengers, such as 50 to 150 passengers). The engines may have an engine power to weight ratio of at least 0.3 Hp/lb wt of engine, e.g. 0.3-2 Hp/lb, and may have a power to cylinder volume of at least 0.5 (Hp/cu.in) e.g. 0.5-2. Cylinders may be arranged in rows, V formation, H formation, flat ('horizontally opposed') or radially around a common propeller drive shaft. One or more rows/circles of cylinders may be used, e.g. flat 2, flat 4, flat 6, V12, 2 or 3 circles of 7 cylinders etc. Every cylinder has one and more preferably at least two spark plugs. A gear system may optionally be used to drive the propeller and or a supercharger. Alternatively, an exhaust turbo charger may also be present. Exhaust outlets may be individual or run into a common manifold and preferably point in the opposite direction to forward flight. Fins may be present on the exterior of the engine for air cooling. Greater than 90% of the distance traveled by the engine, when in use, is usually spent at 500 feet or more above ground level. Typically, during greater than 90% of the time when the engine is running, the engine operates at above 1000 rpm e.g. between 1000 to 3500 rpm. Part (a) of the invention may be used in conjunction with a fuelling system to control at least one of the cylinder head and exhaust gas temperatures during operation by adjustment of the air:fuel ratio, e.g. reducing this reduces the temperature.

The aircraft usually has at least one tank having a capacity of at least 100 l, especially with a total capacity of at least 1000 l. Small and micro-light aircraft may have tanks substantially smaller in capacity but can operate on the unleaded aviation gasoline described.

The gasolines of part (a) of the invention may be made in a refinery by blending the ingredients to produce at least 200,000 l/day of gasoline such as 1-10 million l/day. The gasoline may be distributed to a plurality of retail outlets for motor gasoline, optionally via wholesale or bulk outlets e.g. holding tanks, such as ones of at least 2 million l capacity e.g. 5-15 million l. The distribution may be by pipeline or in tanks transported by road, rail or water, the tanks being of at least 5000 l capacity. At the retail sites e.g. filling station, the motor gasoline is dispensed to a plurality of users, i.e. the drivers of the vehicles, e.g. at a rate of at least 100 or 1000 different users per day. For aviation use, the gasoline is usually made in a refinery to produce at least 1000 barrels per day (or 100,000 l/day) such as 0.1-2 million l/day. The avgas is usually distributed by tanker by road, rail or water, or pipelines directly to the airport distribution or holding tanks, e.g. of at least 300,000 l capacity, from whence it is distributed by pipeline or tanker (e.g. a mobile refuelling bowser to fuel a plurality of aircraft, e.g. at least 50/day per tank; the aircraft may have one or more on-board tank each of at least 100 l capacity.

EXAMPLES OF PART (a)

Part (a) of the present invention is illustrated in the following Examples.

Examples 1-6

In these Examples 2,2,3 trimethylbutane (triptane) 99% purity was mixed with various refinery fractions and butane, and optionally methyl tertiary butyl ether, to produce a series of gasoline blends, for making unleaded motor gasolines.

Formulated gasolines were made by mixing each blend with a phenolic antioxidant 55% minimum 2,4 dimethyl-6-tertiary butyl phenol 15% minimum 4 methyl-2,6-ditertiary-butyl phenol with the remainder as a mixture of monomethyl and dimethyl-tertiary butyl phenols.

In each case the gasolines were tested for MON and RON, and their Reid Vapour Pressure at 37.8° C. and their calorific value, and their distillation properties. The results are shown in table 1.

TABLE 1

| | Example | | | | | |
|---|---|---|---|---|---|---|
| | 1 | 2 | 3 | 4 | 5 | 6 |
| Composition % v/v | | | | | | |
| Triptane | 10.0 | 50.0 | 50.0 | 25.0 | 25.0 | 60.0 |
| Butane | 10.0 | 5.0 | 5.0 | 5.0 | 5.0 | 5.0 |
| Mixed Fractions (apart from Naphtha) of which | 60.0 | 30.0 | 30.0 | 65.0 | 50.0 | 35.0 |
| Catalytic reformate | 5.0 | 0 | 0 | 18.1 | 0 | 1.3 |
| HCC | 6.48 | 18.62 | 17.68 | 0 | 9.31 | 22.73 |
| LCC | 48.52 | 0 | 19.05 | 46.90 | 36.41 | 0.00 |
| SRG | 0 | 11.38 | 3.27 | 0 | 4.28 | 10.85 |
| Isopentane | 0 | 0 | 0 | 0 | 0 | 0.12 |
| Naphtha | 20.0 | 5.0 | 5.0 | 5.0 | 20.0 | 0.00 |
| MTBE | 0 | 10.0 | 0 | 0 | 0 | 0 |
| Analysis, % v/v | | | | | | |
| Aromatics | 14.1 | 6.3 | 8.5 | 19.1 | 10.0 | 7.9 |
| Olefins | 23.5 | 3.2 | 11.7 | 21.4 | 18.5 | 3.8 |
| Antioxidant mg/l | 15 | 15 | 15 | 15 | 15 | 15 |
| Distillation ° C. | | | | | | |
| T 10% | 43.6 | 58.0 | 58.4 | 51.2 | 54.0 | 60.0 |
| T 50% | 89.1 | 93.2 | 97.1 | 85.5 | 91.9 | 99.2 |
| T 90% | 154.0 | 177.8 | 176.9 | 140.4 | 159.0 | 185.0 |
| Reid Vapour Pressure kPa | 78.1 | 46.9 | 47.4 | 63.9 | 57.3 | 42.9 |
| RON | 95.0 | 97.3 | 97.0 | 97.0 | 95.0 | 99.4 |
| MON | 85.9 | 97.2 | 95.4 | 90.0 | 89.0 | 87.3 |
| ROAD | 90.45 | 97.25 | 96.2 | 93.5 | 92.0 | 93.35 |

In the above table mixed fractions means a blend of refinery fractions in which HCC is heavy catalytically cracked spirit, LCC is light catalytically cracked spirit and SRG is straight run gasoline.

Example 7

The combustion characteristics of the gasolines of Ex. 1-6 were tested against standard unleaded gasolines. Combustion of the gasolines of Ex. 1-6 gave less carbon dioxide emissions than from equal volumes of the standard gasolines of similar ROAD Octane Number.

Example 8 and Comparative Ex A-C

The emission characteristics on combustion of a series of gasoline fuels with 25% of different components were compared, the components being heavy reformate (comp A), triptane (Ex8), alkylate (comp B) and a mix of 10% heavy reformate and 15% MTBE (comp C). The gasoline fuels and their properties were as follows. Formulated gasolines were made by addition of the phenolic antioxidant in amount and nature as in Ex1-7.

| | Example | | | |
|---|---|---|---|---|
| Composition | A | 8 | B | C |
| Butane | 3 | 3 | 3 | 3 |
| Reformate | 22 | 22 | 22 | 22 |
| Alkylate | 40 | 40 | 65 | 40 |
| Bisomer ('CCS') | 10 | 10 | 10 | 10 |
| Heavy Reformate | 25 | | | 10 |
| Triptane | | 25 | | |
| MTBE | | | | 15 |
| Density kg/l | 0.7623 | 0.7163 | 0.7191 | 0.7424 |
| RON | 101.2 | 100.2 | 98.5 | 101.1 |
| MON | 89.4 | 93.2 | 88.3 | 90.2 |
| ROAD | 95.3 | 96.7 | 93.4 | 95.65 |
| % Aromatics | 38.9 | 13.9 | 13.9 | 23.9 |
| % Olefins | 10.2 | 10.2 | 10.2 | 10.2 |
| % Saturates | 50.9 | 75.9 | 75.9 | 65.9 |
| % Benzene | 0.9 | 0.9 | 0.9 | 0.9 |

The fuels were tested in a single cylinder research engine at a number of different engine settings. The speed/load was 20/7.2 rps/Nm/, or 50/14.3 rps/Nm the LAMBDA setting was 1.01 or 0.95, and the ignition setting was set or optimized. The emissions of CO, $CO_2$, total hydrocarbons, NOx, and total air toxics (benzene, butadiene, formaldehyde and acetaldehyde) were measured from the exhaust gases. The results from the different engine settings were averaged and showed that, compared to the base blend (Comp. Ex. A) the emissions with the compositions containing heavy reformate and MTBE (Comp. C), 25% alkylate (Comp. B) and 25% triptane (Ex8) were reduced, the degrees of change being as follows.

TABLE 2

| Example | % CO | % $CO_2$ | % THC | % NO*x* | % TAT | % FC |
|---|---|---|---|---|---|---|
| Comp C (MTBE | −4.9 | −2.3 | −6.2 | −6.5 | −9.2 | +1.4 |
| Comp B (alkylate) | −7.9 | −4.5 | −4.0 | −8.0 | −13.1 | −2.9 |
| 8/triptane | −9.6 | −5.6 | −6.6 | −10.1 | −18.7 | −4.1 |

Where THC is total hydrocarbons, TAT is total air toxics. The Fuel Consumption (FC) was also measured in g/kWhr and the change relative to the base blend are also shown in Table 2.

Example 9-22

Gasolines were made up as in Ex 1-6 from components as shown in the table below, and had the properties shown. They gave low carbon dioxide emissions.

| | Example | | | | | | |
|---|---|---|---|---|---|---|---|
| | 9 | 10 | 11 | 12 | 13 | 14 | 15 |
| Composition % v/v | | | | | | | |
| Triptane | 10.0 | 25.0 | 60 | 10 | 18.0 | 10.0 | 24.0 |
| Butane | 4.7 | 4.7 | 4.71 | 0 | 0 | 0 | 0 |
| Mixed Fractions (apart from Naphtha) of which | 85.3 | 70.3 | 35.29 | 76.21 | 73.6 | 90.0 | 45.4 |
| Catalytic reformate | 10.0 | 10.0 | 0 | 21.28 | 10.0 | 15.3 | 25.2 |
| CCS | 0 | 0 | 0 | 10 | 0 | 0 | 0 |
| Steam cracked spirit | 0 | 0 | 0 | 9.7 | 41.1 | 48.7 | 10.0 |
| SRG | 35.3 | 35.3 | 35.29 | 15.72 | 22.5 | 26.0 | 0 |
| Isopentane | 0 | 0 | 0 | 0 | 0 | 0 | 0 |
| Naphtha | 0 | 0 | 0 | 13.79 | 8.4 | 0 | 30.6 |
| Ethanol | 0 | 0 | 0 | 5 | 0 | 0 | 0 |
| Heavy reformate | 10 | 10 | 0 | 9.51 | 0 | 0 | 0 |
| Toluene | 30 | 15 | 0 | 0 | 0 | 0 | 0 |
| Cyclohexane | 0 | 0 | 0 | 5 | 0 | 0 | 0 |
| Light hydrocrackate | 0 | 0 | 0 | 0 | 0 | 0 | 0 |
| C6 Bisomer | 0 | 0 | 0 | 0 | 0 | 0 | 10.2 |
| Analysis, % v/v | | | | | | | |
| Aromatics | 48.0 | 33.0 | 1 | 31 | 23.6 | 29.2 | 2.2 |
| Olefins | 0.1 | 0.1 | 0.1 | 6.1 | 8.8 | 10.4 | 12.5 |
| Sulphur % w/w | 0.000 | 0.000 | | | 0.002 | 0.001 | 0.004 |
| Benzene | 0.7 | 0.7 | | | 0.6 | 0.9 | 1.0 |
| Antioxidant mg/l | 15 | 15 | 15 | 15 | 15 | 15 | 15 |
| Distillation ° C. | | | | | | | |
| T 10% | 58.0 | 55.9 | | | 53.6 | 51.5 | 61.0 |
| T 50% | 95.9 | 89.9 | | | 77.0 | 77.0 | 89.6 |
| T 90% | 156.6 | 157.0 | | | 136.9 | 142.6 | 140.4 |
| Reid Vap. Pres. kPa | 51.6 | 54.0 | | | 56.9 | 60.0 | 50.0 |

-continued

| | | | | | | | |
|---|---|---|---|---|---|---|---|
| RON | 97.3 | 96.1 | 101.4 | 96.0 | 91.0 | 92.0 | 91.0 |
| MON | 88.1 | 87.8 | 88.8 | 83.8 | 81.6 | 81.8 | 82.0 |
| ROAD | 92.7 | 91.9 | 95.1 | 89.9 | 86.3 | 86.9 | 86.5 |

| | Example | | | | | | | |
|---|---|---|---|---|---|---|---|---|
| | 16 | 17 | 18 | 19 | 20 | 21 | 22 | 23 |
| Composition % v/v | | | | | | | | |
| Triptane | 10 | 25 | 60 | 10 | 25.0 | 25.0 | 25.0 | 25.0** |
| Butane | 2.96 | 2.96 | 2.96 | 0 | 3.32 | 1.07 | | 3 |
| Mixed Fractions (apart from Naphtha) | 87.04 | 72.04 | 37.04 | 76.21 | 54.95 | 65.42 | 75.0 | |
| Catalytic reformate* | 19.78 | 4.78 | | 21.28 | 23.42 | 8.21 | 7.53 | 40 |
| CCS | 5 | 5 | 5 | 10 | | | | |
| Steam cracked spirit* | 47.42 | 47.42 | 18.0 | 9.7 | | 30.01 | 30.00 | |
| SRG | | | | 15.72 | | | | |
| Alkylate | | | | | 31.53 | 27.20 | 37.47 | 22 |
| Naphtha | | | | 13.79 | 16.73 | 8.51 | | |
| Ethanol | | | | 5 | | | | |
| Heavy reformate | | | | 9.51 | | | | |
| Cyclohexane | 5 | 5 | 5 | 5 | | | | |
| Light hydrocrackate | 7.93 | 7.93 | 7.93 | 0 | | | | |
| C6 Bisomer | 1.91 | 1.91 | 1.91 | 0 | | | | 10 |
| Analysis, % v/v | | | | | | | | |
| Aromatics | 32.1 | 23 | 8 | 31 | 16.4 | 16.8 | 15.6 | 25.5 |
| Olefins | 14 | 13.9 | 7.3 | 6.1 | 0.2 | 7.8 | 7.8 | 10.2 |
| Benzene | | | | | 1.0 | 0.5 | 0.5 | 1.71 |
| Sulphur % w/w | | | | | 0.0002 | 0.0004 | 0.0004 | 0.0001 |
| Antioxidant mg/l | 10 | 10 | 10 | 10 | 10 | 10 | 10 | 10 |
| Distillation % 70° C. | | | | | 22.7 | 31.2 | 30.5 | 18.5 |
| % 100° C. | | | | | 53.3 | 60.0 | 59.2 | 42.5 |
| % 150° C. | | | | | 95.8 | 94.9 | 95.1 | 97.2 |
| % 180° C. | | | | | 98.7 | 98.1 | 98.1 | 100 |
| Reid Vap. Press. kPa | | | | | 60.0 | 55.0 | 52.7 | 62.2 |
| RON | 97.3 | 98.9 | 104.0 | 96.0 | 98.6 | 100.9 | 102.9 | 102.7 |
| MON | 85.5 | 87.2 | 93.4 | 83.8 | 87.5 | 87.5 | 89.5 | 90.5 |
| ROAD | 91.4 | 93.05 | 96.7 | 89.8 | 93.05 | 94.2 | 96.2 | 96.6 |

*In Ex. 20-22 different fractions were used, e.g. different reformates.
**In Ex. 23, the triptane was replaced by 2,2,3-trimethyl pentane.

Examples 24-8 and Comparative Example D

Emission characteristics were obtained as in Ex. 8 (apart from Lamba settings of 1.00 and 0.95 set for the base fuel (Comp. D) on combustion of a series of gasoline fuels with different components namely reformate, (high aromatics), (Comp. D), triptane, Ex. 24-27 and triptane/ethanol Ex. 28. Fuel consumption was also measured in g/kWhr. Formulated gasolines were made by addition of the phenolic antioxidant in amount and nature as in Ex. 1-7. The compositions were as shown in Table 3. The results were expressed in Table 4 as the percentage change in emissions or in fuel consumption compared to Ex. D.

TABLE 3

| | Example | | | | | |
|---|---|---|---|---|---|---|
| | 24 | 25 | 26 | 27 | 28 | D |
| Composition % v/v | | | | | | |
| Triptane | 40 | 10 | 25 | 60 | 10 | |
| Butane | 2.96 | 2.96 | 2.96 | 2.96 | | 2.96 |
| Mixed Fractions (apart from Naphtha) of which | | 87.04 | 72.04 | 37.04 | | |
| Catalytic reformate* | | 19.78 | 4.78 | | 21.28 | 25.25 |
| CCS | 5 | 5 | 5 | 5 | 10 | 5 |
| Steam cracked spirit* | 37.2 | 47.42 | 47.42 | 17.2 | 9.7 | 47.42 |
| SRG | | | | | 15.72 | |
| Toluene | | | | | | 4.53 |
| Naphtha | | | | | 13.79 | |
| Ethanol | | | | | 5 | |
| Heavy reformate | | | | | 9.51 | |
| Cyclohexane | 5 | 5 | 5 | 5 | 5 | 5 |
| Light hydrocrackate* | 7.93 | 7.93 | 7.93 | 7.93 | | 7.93 |

TABLE 3-continued

| | Example | | | | | |
|---|---|---|---|---|---|---|
| | 24 | 25 | 26 | 27 | 28 | D |
| C6 Bisomer* | 1.91 | 1.91 | 1.91 | 1.91 | | 1.91 |
| Analysis, % v/v | | | | | | |
| Aromatics | 15.0 | 31.2 | 21.7 | 7.8 | 31.1 | 39.2 |
| Olefins | 13.4 | 16.2 | 16.1 | 8.3 | 6.5 | 16.2 |
| Sulphur % w/w | 0.007 | 0.007 | 0.007 | 0.007 | 0.012 | 0.007 |
| Antioxidant mg/l | 10 | 10 | 10 | 10 | 10 | 10 |
| Distillation ° C. % | | | | | | |
| T 10% | | | | | | |
| T 50% | | | | | | |
| T 90% | | | | | | |
| Reid Vapour Pressure kPa | | | | | | |
| RON | 98.7 | 96.8 | 97.5 | 101.0 | 93.2 | 96.6 |
| MON | 86.1 | 82.8 | 83.7 | 89.6 | 82.4 | 82.5 |
| ROAD | 92.4 | 89.8 | 90.6 | 95.3 | 88.1 | 89.55 |

*Denotes that a different fraction was used, compared to the Examples in other Tables e.g. different raffinate.

TABLE 4

| Example | % CO | % CO2 | % THC | % NOx | % TAT | % Fuel Consumption |
|---|---|---|---|---|---|---|
| 25 | −3.3 | −2.1 | −4.7 | −4.0 | −5.0 | −1.4 |
| 26 | −8.6 | −3.8 | −8.7 | −7.0 | −19.1 | −2.5 |
| 27 | −17.4 | −6.8 | −10.5 | −18.0 | −35.3 | −4.5 |
| 24 | −14.9 | −5.0 | −7.9 | −12.2 | −28.7 | −3.4 |
| 28 | −11.7 | −2.2 | −3.2 | −10.3 | −10.1 | +0.1 |

TABLE 5

| | Example | |
|---|---|---|
| | F.G | 29 |
| Composition % v/v | | |
| Triptane | | 25 |
| Butane | 0.75 | 0 |
| Mixed Fractions (apart from Naphtha) of which | | |
| Catalytic reformate * | 11.0 | 7.5 |
| Steam cracked spirit * | 31.5 | 30.0 |
| Alkylate | 40.9 | 37.5 |
| Toluene | 15.8 | 0 |
| Analysis, % v/v | | |
| Aromatics | 34.2 | 15.6 |
| Olefins | 8.2 | 7.8 |
| Saturates | 57.6 | 76.6 |
| Sulphur ppm | 7.3 | 10 |
| Benzene % w/w | 0.75 | 0.64 |
| Antioxidant mg/l | 10 | 10 |
| Distillation % Evap. 70° C. | 18.8 | 21.6 |
| E % 100° C. | 44.4 | 64.5 |
| E % 150° C. | 92.8 | 93.3 |
| E % 180° C. | 96.4 | 98 |
| Reid Vapour Pressure kPa | 56.8 | 52.2 |
| RON | 99.5 | 99.7 |
| MON | 87.6 | 89.3 |
| ROAD | 93.05 | 94.5 |

Examples 29 and Comparative Ex. F, G 3 gasoline fuels (Ex. 29, F and G) were compared for production of emissions on combustion in cars. The gasoline fuels had the compositions and properties as shown in Table 5 and the formulated gasolines included antioxidant as in Ex. 1. The fuels met the requirements of 2005 Clean Fuel specification according to Directive 98/70 EC Annexe 3. The cars were regular production models, namely 1998 Ford Focus (1800 cc), 1996-7 VW Golf (1600 cc), 1998 Vauxhall Corsa (1000 cc), 1994-5 Peugeot 106 (1400 cc) and 1998 Mitsubishi GDI (1800 cc) each fitted with a catalytic converter. The Corsa had 3 cylinders, the rest 4 cylinders, while the 106 had single point injection the Mitsubishi had direct injection and the rest multipoint injection for their combustion.

2 separate base fuel experiments (comp F & G) were done. The emissions were tested in triplicate in a dynamometer on the European Drive Cycle test as described in the MVEG test cycle (EC. 15.04+EUDC) modified to start sampling on cranking and 11 sec. Idle as given in Directive 98/69 EC (the disclosure of which is hereby incorporated by reference). The EDC test over 11 km comprises the ECE cycle (City driving test) repeated 4 times followed by the Extended Urban Drive Cycle test (incorporating some driving at up to 120 km/hr). The emissions were measured out of the engine (i.e. upstream of the catalytic converter) and also as tailpipe emissions (i.e. downstream of the converter) and were sampled every second (except for the Focus) and cumulated over the test, the results being expressed as g emission per km traveled. The emissions of the first ECE cycle with the Focus were not measured. The emissions tested were for the total hydrocarbons, $CO_2$, CO and $NO_x$ and the fuel consumption was determined on a gravimetric basis. The geometric means of the emission and consumption results across the 5 cars were obtained. The values for the Comparative fuels were averaged.

In the following tests, the $CO_2$ emissions averaged over the 5 cars were lower with the triptane fuel (Ex. 29) compared to the averaged base fuel results (Comp. F, G), namely Total tailpipe emissions in EDC tests, EUDC test and ECE test, the reductions being respectively 2.8%, 2.7% and 2.8%. The Fuel Consumptions averaged over the 5 cars were lower with the triptane fuel (Ex. 29) compared to the averaged base results (Comp. F, G) in those same tests, the reductions being respectively, 0.6%, 0.6% and 0.5%. The tailpipe emissions results for THC, CO and $NO_x$ in at least some parts of the total EDC cycle showed trends towards triptane giving lower emissions than the base fuel, but the differences may or may not be confirmed in view of the limited number of vehicles tested.

The ECE tests simulates city driving and has 4 identical repeats of a specified speed profile, which profile has 3 progressively higher speed sections interspersed by zero speed sections (the average speed being 19 km/hr). The first profile corresponds to driving from a cold start. In a cold engine, the effects of friction, lubricants and the nature of the fuel among others, differ from those with a hot engine in an unpredictable way, and it is with cold engines that most tailpipe emissions are produced, because the catalytic converter becomes increasingly effective at reducing emissions when it becomes hot. In addition a Lambda sensor upstream of the converter controls the fuel/air ratio entering the engine, but this is not effective with a cold engine (resulting in an unregulated fuel/air ratio); after cold start the sensor quickly becomes effective, (resulting in a regulated fuel/air ratio), even when the catalyst is not yet hot enough to be effective. Thus cold start operations are different from hot running operations and yet contribute to a large amount of tailpipe emissions.

The out of engine results from the first profile ECE tests (simulating cold start) with the above fuels (Ex. 29 and Comp. F, G) were the same as the tailpipe emissions as the catalyst was not effective then. The results in these cold start tests for $CO_2$, HC, CO and $NO_x$ averaged over the Golf, Corsa, Peugeot and Mitsubishi, and also averaged over the Golf, Corsa and Peugeot showed trends toward triptane giving lower emissions than the base fuel, but the differences may or may not be confirmed in view of the limited number of vehicles tested.

This period of cold start simulated as above may correspond in real life to a period of time or distance, which may vary, depending on how the car is driven and/or ambient conditions e.g. up to 1 km or 4 or 2 min, or a temperature of the engine coolant (e.g. radiator water temperature) of up to 50° C. The car engine may also be deemed cold if it has not been operated for the previous 4 hr before start, usually at least 6 hr before start.

Thus part (a) of the present invention also provides of method of reducing emissions of exhaust gases in the combustion of unleaded gasoline fuels of MON of at least 80 e.g. 80 to less than 98 from cold start of a spark ignition combustion engine, which comprises having a compound of formula I present in the fuel which is a gasoline of part (a) of the invention.

Example 30

An unleaded aviation gasoline was made by mixing 2,2,3 trimethylbutane of 99% purity with iso-pentane and iso-octane to give a composition consisting of 2,2,3 trimethylbutane 40%, isopentane 12%, and iso-octane 48% expressed in volume percentages of the total gasoline.

The motor octane number (MON) of the gasoline was 99.9 as determined by ASTM D2700-92 and the Reid Vapour Pressure was 33 kPa.

Example 31

An unleaded aviation gasoline contained the gasoline of Ex. 30 with 8 mg/l of a mixture of 75% 2,6-ditertiary, butyl phenol and 25% tertiary and tri tertiary, butyl phenols, as antioxidant.

Example 32

An unleaded aviation gasoline was made from a crude triptane fraction. A cracked residue from the distillation of crude oil was distilled to give a $C_4$ fraction containing olefin and saturates. The fraction was alkylated (i.e. self reacted) to form a crude $C_8$ saturate which was distilled to give a fraction boiling 95-120° C., which contained 223 and 233 trimethyl pentane. This fraction was demethylated by reduction to give a first fraction containing about 17% triptane and 83% iso $C_6$-$C_9$ with a majority of iso $C_7$ and iso $C_8$ hydrocarbons. This first fraction was redistilled to produce a second fraction of 87% triptane and 13% iso $C_7$ and $C_8$.

90 parts by volume of this second fraction was mixed with 10 parts of isopentane to give an unleaded aviation gasoline of MON value 99.1. Addition of 8 mg/l of the phenol mixture of Ex. 31 gave an oxidation stabilized unleaded aviation gasoline fuel.

Example 33

The process of Example 32 was repeated with the first fraction containing the 17% triptane redistilled to give a third fraction containing 37% triptane and 63% iso $C_7$ and $C_8$. 82 parts by volume of this third fraction were mixed with 18 parts of isopentane to give an unleaded aviation gasoline of MON value 98.0. Addition of the phenol mixture as in Ex. 32 gave an oxidation stabilised aviation gasoline fuel.

Examples 34-38

In these Examples 2,2,3 trimethylbutane (triptane) 99% purity was mixed with iso-pentane and butane, and optionally toluene and/or methyl tertiary butyl ether, to produce a series of gasoline blends, for making unleaded aviation gasolines.

The formulated gasolines were made by mixing each blend with a phenolic antioxidant (as described in Ex. 1-6) (DEF STAN 91-90 RDE/A/610).

In each case the gasolines were tested for Motor Octane Number, and their Reid Vapour Pressure at 37.8° C. and their calorific value, and their distillation properties and freezing point. In addition for Example 38 the Indicated Mean Effective Pressure (IMEP) was determined (according to ASTM D909) to give the Supercharge Performance Number. The results are shown in Table 6.

TABLE 6

| | Example | | | | |
|---|---|---|---|---|---|
| | 34 | 35 | 36 | 37 | 38 |
| Composition % v/v | | | | | |
| Triptane | 85.0 | 73.0 | 53.0 | 87.8 | 87.0 |
| Isopentane | 12.0 | 14.0 | 14.0 | 12.0 | 11.8 |
| Butane | 3.0 | 3.0 | 3.0 | 0.2 | 1.2 |
| Toluene | — | 10.0 | 10.0 | — | — |
| MTBE | — | — | 20.0 | — | — |
| Antioxidant mg/l | 15 | 15 | 24 | 17 | 15 |
| Distillation ° C. | | | | | |
| Initial Boiling Point | 43.0 | 41.0 | 36.5 | 47.5 | 46.5 |
| T10% | 63.5 | 63.5 | 57.0 | 68.0 | 67.0 |
| T40% | 77.0 | 79.0 | 69.9 | 76.5 | 77.0 |
| T50% | 78.5 | 81.5 | 73.8 | 78.5 | 79.0 |
| T90% | 80.5 | 87.5 | 88.4 | 80.5 | 81.0 |
| Final Boiling Point | 115.0 | 116.0 | 107.7 | 80.5 | 90.0 |
| Reid Vapour Pressure kPa | 51.3 | 52.5 | 58.3 | 40.4 | 46.3 |
| MON | 99.8 | 98.3 | 98.0 | 99.7 | 99.8 |
| Freezing point ° C. | −54 | <−80 | <−80 | −49 | −51.5 |

TABLE 6-continued

| | Example | | | | |
|---|---|---|---|---|---|
| | 34 | 35 | 36 | 37 | 38 |
| Supercharge (IMEP) | — | — | — | — | >160 |
| Specific energy MJ/kg | 44.5 | 44.1 | 42.1 | 44.5 | 44.5 |

T 10% means the temperature at which 10% by volume of the composition has distilled.

Examples 39-41 and Comparative Ex. H, J

Blends for use in making unleaded aviation gasolines were made with the composition as shown in Table 7 below in which Ex. 39 and 40 are repeats of Ex. 9 and 1 respectively. To make the formulated unleaded aviation gasolines, the blends were mixed in the amounts of the antioxidant, as described in Ex. 1-6 above. The gasolines were compared with commercial UK market leaded aviation gasolines (Comp. Ex. H and J) All the gasolines met Def. Standard 91-90.

| Composition | Comp. H | Ex. 39 | Comp. J | Ex. 40 | Ex. 41 |
|---|---|---|---|---|---|
| Triptane % v/v | | 87.0 | | 40.0 | 60.0 |
| Isopentane % v/v | | 11.8 | | 12.0 | |
| Iso-octane % v/v | | | | 48.0 | |
| Alkylate 95 to 125° C. cut | | | | | 28.0 |
| Isomerate % v/v | | | | | 12.0 |
| Butane | | 1.2 | | | |
| Anti-oxidant mg/l | | 15 | | 9 | 17 |
| Distillation | | | | | |
| IBP ° C. | 33.5 | 46.5 | 37.5 | — | 54.2 |
| T10% Evap. ° C. | 64.3 | 67.0 | 63.5 | — | 74.9 |
| T40% Evap. ° C. | 97.6 | 77.0 | 98.0 | — | 83.4 |
| T50% Evap. ° C. | 103.4 | 79.0 | 102.5 | — | 85.2 |
| T90% Evap. ° C. | 120.8 | 81.0 | 119.0 | — | 97.0 |
| FBP ° C. | 150.7 | 90.0 | 150.0 | — | 114.7 |
| Temp. E10% + E50% | 167.7 | 146.0 | 166.0 | — | 160.1 |
| RVP kPa | 45.1 | 46.3 | 47.6 | 33.0 | 32.9 |
| Calorific value MJ/kg | 44.117 | 44.493 | 43.711 | 44.442 | 44.429 |
| Lead gPb/l | 0.51 | 0.00 | 0.48 | 0.00 | 0.00 |
| MON ON | 102 | 99 | 101 | 99 | 98 |

The emission characteristics of the gasolines were compared. The gasolines were tested in a single cylinder research engine at a number of settings and under conditions corresponding to take off full power (42 rps/36 Nm at Lambda 0.85) and cruise 42 rps/22 Nm at Lambda 1.15 with optimised ignition settings. The emissions of THC (total hydrocarbons), CO, $NO_x$, $CO_2$ were measured on the exhaust gases, and also the fuel consumption (FC) expressed in g/kWhr. Tables 8 and 9 below show the changes in levels with the gasolines of part (a) of the invention compared to the commercial aviation gasoline, Ex. 39 being compared to Comp. Ex. H in Table 8, and Ex. 40 and 41 being compared to Comp. Ex. J in Table 9. The tests for Table 9 were done in triplicate and the results averaged.

TABLE 8

Change for Ex. 39 compared to base gasoline (Comp. H)

| Conditions | $CO_2$ % | CO % | THC % | $No_x$ % | FC % |
|---|---|---|---|---|---|
| Take off | −7.2 | −4.0 | −15.6 | −11.2 | −5.2 |
| Cruise | −2.6 | −0.9 | −14.0 | −4.2 | −1.4 |

TABLE 9 change for Ex. 40 and 41 compared to gasoline Comp. J.

| Conditions | | $CO_2$ % | CO % | THC % | $No_x$ % | FC % |
|---|---|---|---|---|---|---|
| Take off | Ex. 40 | −4.2 | −1.8 | −4.8 | −8.7 | −1.8 |
| | Ex. 41 | −3.3 | −3.9 | −6.8 | −5.1 | −1.8 |
| Cruise | Ex. 40 | −3.8 | 1.0 | −5.8 | −17.2 | −2.1 |
| | Ex. 41 | −4.1 | 0.4 | −8.1 | −12.1 | −2.3 |

The results in Tables 8 and 9 show the reduction in emissions of THC, $CO_2$, $NO_x$, and Fuel Consumption, for the aviation gasolines of part (a) of the invention compared to the commercial leaded aviation gasolines.

Example 42

An unleaded aviation gasoline blend was made by mixing 55% by volume of 223 trimethyl butane of 99% purity with 10% by volume of isomerate, (containing 54.8% isopentane 14.1% 2,2 dimethylbutane, 19.1% of 2 and 3 methylpentanes and the remainder other hydrocarbons of 5-10 carbons), 3% of volume of butane, 20% of isooctane (224 trimethyl pentane) and 12% of an alkylate fraction (bp 90-135° C. containing 51% isooctane, 21% other trimethyl pentanes and 22% mixed isomeric hydrocarbons.

The MON of the gasoline was 99.3 as determined by ASTMD 2700-92, the Reid Vapour Pressure was 40.9 kPa, the Supercharge Performance Number greater than 133 (determined from the Indicated Mean Effective Pressure IMEP/reference fuels—see ASTM D909), and the freezing point less than −80° C.

A formulated unleaded aviation gasoline contained the above gasoline blend and 15 mg/l of a phenol antioxidant 55% minimum 2,4 dimethyl-6-tertiary butyl phenol 15% minimum 4 methyl-2,6-ditertiary-butyl phenol with the remainder as a mixture of monomethyl and dimethyl-tertiary butyl phenols (DEF STAN 91-90 RDE/A/610). The gasoline analysis is given in Table 10.

The gasoline was also tested for carbon dioxide, carbon monoxide. $No_x$ and total hydrocarbon emissions against a standard leaded aviation gasoline in a research engine operating at 42 rps/20.5 Nm and Lambda 1.15 (representing aircraft cruise conditions) with the ignition setting optimised for the standard gasoline. The emissions were reduced, the changes being 4.1% $CO_2$, −1.1% CO, −3.9% COX, −8.7% $NO_x$, −6.2% THC. The exhaust gas temperatures were an average of 617° C. for the standard leaded fuel and 609° C. for the gasoline of part (a) of the invention.

TABLE 10

| | | |
|---|---|---|
| Antioxidant | mg/l | 15 |
| Visual appearance | | Pass |
| Density @ 15 Deg C. | kg/l | 0.6914 |
| Distillation | | |
| IBP | Deg C. | 41.0 |
| T10% | Deg C. | 71.8 |
| T40% | Deg C. | 83.9 |
| T50% | Deg C. | 85.6 |
| T90% | Deg C. | 94.9 |
| FBP | Deg C. | 112.0 |
| Temp E10%+E50% | Deg C. | 157.0 |
| Recovery | % v/v | 97.6 |
| Residue | % v/v | 0.9 |
| Loss | % v/v | 1.5 |
| RVP | kPa | 40.9 |
| Freezing point | Deg C. | <−80 |
| Sulphur | % w/w | <0.01 |
| Copper corrosion 2 h 100 Deg C. | | 1A |

TABLE 10-continued

| | | |
|---|---|---|
| Oxidation stability 16 h | | |
| Potential gum | mg/100 ml | 7 |
| Lead precipitate | mg/100 ml | 0 |
| Volume change | | 0 |
| Carbon:Hydrogen Ratio | | 1:2.288 |
| Specific energy | MJ/kg | 44.431 |
| Octane | | |
| MON | | 99.3 |
| Super charge | PN | >133 |

Examples 43-57

Unleaded aviation gasoline blends 1-15 were made by mixing the ingredients shown in Table 12.

A corresponding series of formulated unleaded aviation gasolines contained the individual blends and 10 mg/l of the phenol antioxidant used in Example 42. The gasolines are tested for emissions on combustion and give reduced emissions compared to the standard leaded gasoline as in Ex. 42.

In the Table cut alkylate is an alkylate fraction boiling at 95-105° C. containing a majority of isooctane and also 7-10 carbon alkanes, cut reformate is a reformate fraction boiling at 105-135° C. and consisting of aromatics, in particular toluene and xylene and isomerate contains a majority of isopentane and also other 4-10 carbon alkanes. The physical properties of the cut alkylate cut reformate and isomerate are given in Table 11.

TABLE 11

| COMPONENT DATA | Cut alkylate 95-105 C. | Cut reformate 105 to 135 C. | Isomerate |
|---|---|---|---|
| MON | 96 | 99.3 | 87.2 |
| RVP kPa | 14.1 | 8.5 | 94.2 |
| IBP ° C. | 90.6 | 103.2 | 31.8 |
| FBP | 124.9 | 153.6 | 83.6 |
| E75 ° C. % | 0 | 0 | 97.7 |
| E105 ° C. % | 80 | 2.1 | 99.3 |
| E135 ° C. % | 99 | 91.6 | 99.3 |

TABLE 12

| | BLENDS | | | | | | |
|---|---|---|---|---|---|---|---|
| | Blend 1 % v/v | Blend 2 % v/v | Blend 3 % v/v | Blend 4 % v/v | Blend 5 % v/v | Blend 6 % v/v | Blend 7 % v/v |
| Cut alkylate | | | | | 4 | 9 | |
| Cut reformate | 5 | | 9.2 | | 10 | | 7 |
| Isomerate | | 7.13 | | | 5 | 6 | 8 |
| Triptane | 80 | 89.84 | 73.42 | 85 | 75 | 80 | 80 |
| Isopentane | 15 | | 17.38 | 15 | | | |
| Butane | | 3.03 | | | 6 | 5 | 5 |
| Iso-octane | | | | | | | |
| Anti-oxidant mg/l | 10 | 10 | 10 | 10 | 10 | 10 | 10 |
| Properties | | | | | | | |
| MON | 99.8 | 100 | 99.5 | 99.9 | 99.5 | 99.4 | 99.5 |
| Supercharge | >130 | >130 | >130 | >130 | >130 | >130 | >130 |
| RVP kPa | 36.4 | 38 | 38 | 37.1 | 44.4 | 42.8 | 44 |
| E75 C. % v/v | 15 | 10 | 17.4 | 15 | 10.9 | 10.9 | 12.8 |
| E105 C. % v/v | 95.1 | 100 | 91 | 100 | 89.4 | 98.2 | 93.1 |
| E135 C. % v/v | 99.6 | 100 | 99.2 | 100 | 99.1 | 99.9 | 99.4 |
| Density kg/l | 0.7008 | 0.6861 | 0.7077 | 0.6926 | 0.7006 | 0.685 | 0.695 |
| Benzene % v/v | 0.01 | 0 | 0.02 | 0 | 0.02 | 0 | 0.01 |

| | BLENDS | | | | | | | |
|---|---|---|---|---|---|---|---|---|
| | Blend 8 % v/v | Blend 9 % v/v | Blend 10 % v/v | Blend 11 % v/v | Blend 12 % v/v | Blend 13 % v/v | Blend 14 % v/v | Blend 15 % v/v |
| Cut alkylate | 2.82 | | | | 10 | 10 | | 17 |
| Cut reformate | 7.04 | | 7.71 | 10 | | 5 | 5 | |
| Isomerate | 6 | 9.71 | 9.29 | | | | | |
| Triptane | 80 | 80 | 80 | 75 | 75 | 65 | 80 | 70 |
| Isopentane | | | | 10 | 10 | 15 | 13 | 10 |
| Butane | 4.13 | 3 | 3 | 5 | 5 | 5 | 2 | 3 |
| Iso-octane | | 7.29 | | | | | | |
| Anti-oxidant mg/l | 10 | 10 | 10 | 10 | 10 | 10 | 10 | 10 |
| Properties | | | | | | | | |
| MON | 99.7 | 99.5 | 99.5 | 99.6 | 99.3 | 98.7 | 99.8 | 99.9 |
| Supercharge | >130 | >130 | >130 | >130 | >130 | >130 | >130 | >130 |
| RVP kPa | 39.5 | 38.6 | 38.3 | 47.3 | 47.9 | 51.8 | 41 | 40.0 |
| E75 C. % v/v | 10 | 12.5 | 12.1 | 15 | 15 | 20 | 15 | 12.8 |
| E105 C. % v/v | 92.5 | 99.9 | 92.4 | 90.2 | 98 | 93.1 | 95.1 | 97.0 |
| E135 C. % v/v | 99.3 | 99.9 | 99.3 | 99.2 | 99.9 | 99.5 | 99.6 | 99.9 |
| Density kg/l | 0.6972 | 0.6852 | 0.6978 | 0.7035 | 0.6877 | 0.6958 | 0.6986 | 0.695 |
| Benzene % v/v | 0.01 | 0 | 0.01 | 0.02 | 0 | 0.01 | 0.01 | 0 |

Examples 58-69

Unleaded aviation gasoline blends 1-11 were made by mixing the ingredients shown in Tables 13 and 14 and had properties as shown in the Tables; all were essentially free of benzene (<0.1% w/w). A corresponding series of formulated unleaded aviation gasolines containing the blends and 10 mg/l of the phenol antioxidant of Ex. 42 were made. The gasolines are tested for emissions on combustion and give reduced emissions compared to the standard leaded avgas used in Example 42.

TABLE 13

| | | Blend 1 | Blend 2 | Blend 3 | Blend 4 | Blend 5 |
|---|---|---|---|---|---|---|
| Density | kg/l | 0.7186 | 0.7144 | 0.7039 | 0.711 | 0.7495 |
| RVP | kPa | 47.6 | 45.6 | 44.2 | 43.9 | 42.5 |
| Initial boiling point | Deg C. | 37.8 | 39.5 | 40.5 | 38.1 | 38 |
| T10% | Deg C. | 72.2 | 71.2 | 74.7 | 71.6 | 84.3 |
| T40% | Deg C. | 83.6 | 84.5 | 83.8 | 82.6 | 101.8 |
| T50% | Deg C. | 84.5 | 86.3 | 84.4 | 83.7 | 102.8 |
| T90% | Deg C. | 124.5 | 121.1 | 123.0 | 125.6 | 124.1 |
| T10% + T50% | Deg C. | 156.7 | 157.5 | 159.1 | 155.3 | 187.1 |
| Final boiling point | Deg C. | 180.2 | 181 | 185.1 | 181.1 | 184.9 |
| Loss | % v/v | 1.4 | 0.7 | 1.7 | 1.8 | 1.3 |
| Residue | % v/v | 0.6 | 0.6 | 0.6 | 0.6 | 0.7 |
| MON | ON | 100.6 | 100.2 | 101.3 | 100.7 | 98.1 |
| Freeze Point | Deg C. | | | <−60 | <−60 | <−60 |
| C4 butanes | % v/v | 5 | 4 | 5 | 5 | 5 |
| Isopentane | % v/v | 2 | 5 | | | 5 |
| 2,2,3-Trimethylbutane (triptane) | % v/v | 76 | 65 | 79 | 60 | |
| 2,2,4-Trimethylpentane | % v/v | | 11 | 2 | 5 | 55 |
| Toluene | % v/v | 7 | 5 | 4 | 5 | 25 |
| ETBE | | | | | 15 | |
| tert-butylbenzene | % v/v | 10 | 10 | 10 | 10 | 10 |

TABLE 14

| | | Blend 6 | Blend 7 | Blend 8 | Blend 9 | Blend 10 | Blend 11 |
|---|---|---|---|---|---|---|---|
| Tert-butylbenzene | % v/v | 25 | 15 | 15 | 20 | 10 | 10 |
| Butanes | % v/v | 7 | 6 | 6 | 6 | 6 | 6 |
| Isopentane | % v/v | | | | 5 | 5 | 5 |
| Iso-octanes | % v/v | 68 | 64 | 64 | 69 | 69 | 50 |
| Toluene | % v/v | | | | | 5 | 5 |
| Xylenes | % v/v | | | | | 5 | 10 |
| MTBE | % v/v | | 15 | | | | |
| ETBE | % v/v | | | 15 | | | 14 |
| MON | | 101.4 | 101 | 101 | 100.6 | 99.8 | 99.9 |
| RVP | kPa | 43 | 48 | 42 | 45 | 46 | 48 |
| Density | kg/l | 0.7287 | 0.7196 | 0.7213 | 0.7178 | 0.7177 | 0.7344 |
| Freeze point | Deg C. | <−60 | <−60 | <−60 | <−60 | <−60 | <−60 |
| Benzene | % w/w | <1.0 | <1.0 | <1.0 | <1.0 | <1.0 | <1.0 |
| Anti-oxidant | mg/l | 10 | 10 | 10 | 10 | 10 | 10 |

Part (b)

Unleaded Motor gasolines have been discovered producing low emissions on combustion.

In a first aspect of part (b) the present invention provides use of component (a'), which is at least one of (i') a substantially aliphatic hydrocarbon refinery stream of MON value of at least 85, at least 70% in total of said stream being branched chain alkanes, said stream being obtainable or obtained by distillation from a refinery material as a cut having Initial Boiling Point of at least 15° C. and a Final Boiling Point of at most 160° C., said Boiling Points being measured according to ASTMD2892, and (ii') at least one branched chain alkane of MON value of at least 90 and boiling point in the range 15-160° C., especially apart from 2,2,3-trimethylbutane and 2,2,3-trimethylpentane, in an unleaded gasoline of MON at least 80 to reduce the emission levels on combustion of said gasoline.

In a second aspect of part (b) the present invention provides a method of reducing emissions of exhaust gases in the combustion of an unleaded gasoline fuel of MON at least 80 which comprises having present in said gasoline at least 10% of component (a') as defined above.

In a third aspect of part (b) the present invention provides use in a spark ignition combustion engine of an unleaded gasoline fuel of MON at least 80 which comprises at least 10% of component (a') as defined above to reduce emissions of exhaust gases.

In a fourth aspect of part (b) the present invention provides an unleaded composition having a Motor Octane Number (MON) of at least 80 comprising at least 2 or at least 5%, in particular at least 10%, such as 5-70% (by volume of the total composition) of component (a'), which is a substantially aliphatic hydrocarbon refinery stream, of MON value of at least 85, at least 70% in total of said stream being branched chain alkanes, said stream being obtainable or obtained by distillation from a refinery material as a cut having Initial Boiling Point of at least 15° C. and Final Boiling Point of at most 160° C., said Boiling Points being measured according to ASTMD2892, and as component (g') at least 5% of at least one paraffin, aromatic hydrocarbon compound or olefinic hydrocarbon of bp60-160° C., with not more than 5% of the total composition, e.g. less than 1%, of hydrocarbon of bp more than 160° C., especially compounds with at least 2 hydrocarbyl rings such as naphthenes, and preferably less than 5% e.g. less than 4% of triptane or 2,2,3 trimethyl pentane. All boiling points quoted herein are at atmospheric pressure.

In a fifth aspect of part (b) the present invention also provides an unleaded composition having a Motor Octane Number (MON) of at least 80 comprising at least 5% in particular at least 10%, such as 5-70% (by volume of the total composition) of component (a'), which is at least one branched chain alkane of MON value of at least 90 and of boiling point in the range 15-160° C. e.g. 15-100° C., said alkane being preferably present in amount of at least 10, 20 or 30% (especially 10-50%) of the total saturated content of said composition, and as component (g') at least 5% of at least one paraffin, aromatic hydrocarbon compound or olefinic hydrocarbon of bp60-160° C., with not more than 5% of the total composition, e.g. less than 3%, of hydrocarbon of bp more than 160° C., especially naphthenes and preferably less than 5% e.g. less than 4% of triptane or 223 trimethyl pentane.

In a sixth aspect of part (b) the present invention provides an unleaded blend composition having a Motor Octane Number (MON) of at least 81 or 85 and Research Octane Number (RON) of at least 91 or 94 which comprises component (a') a total of at least 15% by volume of the blend composition of at least one branched chain hydrocarbon, which is an alkane of 8-12 carbon atoms with 3 methyl or ethyl branches (hereinafter called a compound (A)) there being a minimum of at least 10% by volume (of the blend composition), of at least one individual compound (A) and component (g') at least one liquid hydrocarbon (e.g. paraffin, aromatic hydrocarbon or olefin) or mixture thereof of bp60-160° C. having a MON value of at least 70 and RON value of at least 90, the total amount of component (g') being at least 20%, with the preferred proviso that the blend composition contains less than 5% of 223 trimethyl pentane, and especially less than 1 or 0.5%, and especially less than 0.5%, in total of 223 trimethyl butane and 223 trimethyl pentane.

In a seventh aspect of part (b) the present invention provides an unleaded blend composition of MON value of at least 81 or 85 and RON value of at least 91 or 94 which comprises component (a') as defined in the previous paragraph and as component (g') at least 20% in total of one or more refinery streams (e.g. such as those described below in relation to any of (b') to (e') below)), such that the blend composition contains in total at least 70% of saturated hydrocarbons.

In the first aspect of part (b) the substantially aliphatic refinery stream contains at least 90% aliphatic hydrocarbons (e.g. at least 95%) and at most 10% in total (e.g. at most 5%) of nonaliphatic hydrocarbons, such as cycloaliphatics e.g. cyclopentane, cyclohexane, alkenes such as linear or branched, ones e.g. butenes, pentenes, hexenes, heptenes and octenes, and possibly, but preferably not, aromatic hydrocarbons such as benzene and toluene. The MON value of said stream is at least 85, e.g. at least 87, or 90 or 92, in particular less than 100, e.g. 85-96 or 87-95, such as 87-90 or 90-95. The RON value of said stream may be 0.5-3.5 especially 1.0-3.5 or 0.5-2.5 units above its MON value, such as RON values of 88-98, or 89.5-96. In said stream at least 70% in total are branched chain alkanes, there being 1 or at least 2 e.g. 2-10 of such alkanes; especially present are 2-4 such alkanes, each in amount of at least 10% or especially 20% e.g. 20-60% in said stream. Thus the stream may contain at least 70% isopentane, or at least 10% (e.g. 10-40%) of each of 2,3dimethyl butane (e.g. 20-40%), isopentane, 2,3 dimethyl pentane (e.g. 20-40%) and 2,4 dimethyl pentane (e.g. 20-40%), or at least 10% (e.g. 10-40%) of each of 2,3 dimethyl butane, 23 and 24 dimethyl pentanes (e.g. 20-40%), and isooctane (e.g. 20-40%). Streams containing less than 30% isopentane e.g. 5-25% isopentane may be preferred, especially if the composition contains at least 5% of triptane or 2,2,3 trimethyl pentane. The total of branched chain alkanes in said stream is at least 70% such as 70-85%, the remainder if any being linear alkanes such as n-butane, n-pentane and/or non aliphatics as described above.

The aliphatic refinery stream is usually derived from a refinery material which is an alkane conversion product, made by reacting one or more alkanes or alkenes, e.g. of 3-5 carbon atoms, especially branched compounds, such as reaction of an alkane and an alkene e.g. isobutane and isobutene. Examples of such a conversion product are alkylates, which may be made by such a reaction. Alkylates are known refinery products, see e.g. Our Industry Petroleum, by British Petroleum Co., London, 4th Ed. Publ. 1970 page 187. Acid catalysts are usually used in such reactions. These may be soluble catalysts such as protic acids e.g. hydrogen fluoride or sulphuric or phosphoric acids, or insoluble catalysts such as zeolites or heteropoly acids from Mo or W. The alkylates usually have a boiling range with IBP of at least 15° C. and FBP in the range 170-210° C., e.g. 175-190 or 185-205° C. The refinery stream for use in the compositions of part (b) of the invention is preferably made as a distillation cut from said material e.g. alkylate, the cut being at 15-60 (e.g. 30-60), 60-80, 80-90, 90-95, 95-100, 100-103, 103-106, 106-110, 110-115, 115-125, 125-140 or 140-160° C.; a blend of different cuts may be used e.g. 15-60, with at least one of 60-80, 80-90, 90-95 and 95-100 or 60-80 with at least one of 80-90, 90-95, 95-100, 100-103 or 103-106° C. or a combination e.g. 80-106 or 90-106° C. Preferably the cut is of product distilled from alkylate over a temperature range of 15-160° or 15-140° C., especially 15-100 or 30-100° C. or 60-160° C., 60-140 e.g. 60-100 or 90-125° C. Cuts with temperatures in the range 15-160° C. especially 90-125° C. or 15-100° C. such as 60-100° C. have been found to give unleaded gasolines which on combustion gave reduced total hydrocarbon emissions and reduced carbon oxide, e.g. $CO_2$ emissions, compared to those from whole alkylate or in particular cuts above 160° C. The cut from alkylate above 160° C. can be used in jet fuel, diesel or kerosene, while the cut from alkylate from 160° C. or 100° C. downwards can be used in gasolines. Cuts of 60-160° C. can be used in summer gasolines because of their reduced Reid Vapour Pressure. Cuts below 100° C. can also be used to boost the volatility of unleaded gasolines e.g. to help provide gasolines with % evaporated at 100° C. values of at least 46.

Advantageously the cut has a boiling range of at least part of 90-106° C., e.g. 90-95, 95-100, 100-103 or 103-106° C., as these give optimum octane rating coupled with good emissions. These cuts may be used as such in the compositions and gasolines of part (b) of the invention but may be mixed with at least one cut of higher bp e.g. 106-110, 110-115, 115-125 or 125-140° C. such as 106-125° C. (preferably in proportion of 5:1 to 1:30 or at least one cut of lower bp e.g. 60-80 or 80-90, such as 60-90° C. (preferably in proportions of 9:1 to 1:9 such as 5:1-1:1).

Preferably however the cut in at least part of bp 90-106° C. is used as sole or main component (a') in the compositions, gasolines and uses of part (b) of this invention with component (g'); these can provide clean high octane unleaded gasolines, in particular ones free of oxygenate, with RON value of at least 97 and MON value at least 86 with low emissions.

Example of such compositions and gasolines are those with RON, 97-99.5 or 97.5-99, MON 86.5-89, RVP 55-65 kPa e.g. 55-60 kPa, % evaporated at 70° C., 12-35%, % evaporated at 100° C. 46-62%, % evaporated at 150° C. 95-100%, % evaporated at 180° C. 97.5-100%, density 0.715 to 0.74 e.g. 0.72-0.738 kg/l, benzene 0.5-1.5% e.g. 0.5-1%, aromatics 16-28% e.g. 16-23%, olefins 3-14% such as 4-12%. They may be made from mixtures of butane 0 or 0.5-6.6%, full boiling range alkylate 1-25% e.g. 5-20%, light hydrocrackate 0 or 15-25%, full range steam cracked spirit 10-45% naphtha 0 or 0.5-5%, full range catalytically cracked spirit 0 or 1-5% 2,2,4 trimethylpentane 0 or 0.5-25% such as 0.5-5%, and alkylate cut(s) usually in total amount 25-45%. The amounts of the latter may be cut bp (90-95, 95-100, 100-103, 103-106° C.) used alone 25-45%, or blends of one or more of those cuts 1-40% (in total in overall composition) and 5-40% of cuts bp 15-60, 60-80 (especially 3-15%) bp 106-110, 110-115, 115-125° C. (especially 7-40%, e.g. 7-20%).

In addition the remaining cuts i.e. those above and below the 90-106° C. cut especially those boiling in part of the 15-80° C. range and those boiling in part of the 106-125° C. range, can be combined e.g. in proportion 5:1-1:5, and the combination used as component (a') in composition, gasolines and uses of part (b) of this invention with component (g'); these can provide clean lower octane unleaded gasolines, in particular ones free of oxygenates, with RON values of at least 92 and MON values of at least 80 also with low emissions. Example of such compositions and gasolines made from a blend of high and low bp cuts are those with RON 92-98 e.g. 92-95 or 95-98, MON 80-88 e.g. 80-84 or 84-88, RVP 50-65 kPa e.g. 50-55 or 55-60 kPa, % evaporated at 70° C., 12-35%, % evaporated at 100° C. 46-62%, % evaporated at 150° C. 94-100%, % evaporated at 180° C. 97.5-100%, density 0.715 to 0.74 e.g. 0.72-0.738 kg/l, benzene 0.5-1.5% e.g. 0.5-1%, aromatics 13-28% e.g. 13-20%, olefins 3-14% such as 3-10%. They may be made from mixtures of butane 0 or 0.5-3%, full boiling range alkylate 10-40% e.g. 15-30%, full range steam cracked spirit 15-50% e.g. 15-35%, naphtha 0 to 10-20%, and alkylate cut(s) usually in total amount 25-45%. The amounts of the latter may be 5-25% (in total of the overall composition) of one or more of cuts of 15-60, 60-80 and 80-90° C. and 10-30% in total (of the overall composition) of cuts of 106-110, 110-115, 115-125° C. especially 110-125° C. By this means, substantially all the alkylate can be converted into 2 clean fuel products of higher and lower octane level.

Thus in a further aspect of part (b) the present invention also provides a process for preparing at least 2 clean compositions suitable for production of gasolines, which comprises fractionating a reaction product comprising a majority of isoalkanes e.g. isomerization or alkylation product e.g. of bp 15-160° C. to produce a first cut boiling in at least part of the range 90-106° C., and a second cut boiling at a temperature lower than said first cut and third cut boiling at a temperature above said first cut, blending said first cut as component (a') with component (g') as defined above to produce a first high octane unleaded gasoline composition of RON at least 97 and MON value at least 86 with low emissions on combustion, and incorporating said second and third cuts as component (a') with component (g') as defined above to produce at least one second high octane unleaded gasoline composition of RON at least 92 and MON value at least 80 with low emissions on combustion. In both cases these gasolines can be obtained without the need of oxygenate octane booster.

Part (b) of the present invention also provides a method of producing fuels which comprises distilling said reaction product e.g. alkylate to produce a first cut above 160° C. and a second cut below 160° C., and mixing said first cut with other liquid hydrocarbon blend ingredients to form a jet fuel, diesel or kerosene, and mixing said second cut with other liquid gasoline blend ingredients to form motor gasoline.

Component (g') present in the compositions of part (b) of the invention is usually at least one paraffin, aromatic and/or olefinic hydrocarbon of bp less than 160° C. Examples of said components are components (b')-(f') below, each of which or 2 or more of which may be present.

In the second aspect of part (b) of the invention, examples of the branched chain alkane (usually of 4-12 e.g. 4-8 carbons) which is component (a') are iso alkanes of 4-8 carbons, in particular isobutane, isopentane and isooctane, and dimethyl alkanes, such as 2,3-dimethyl butane. The branched chain alkane usually has at least one, preferably two methyl groups on carbon atom 2 in the alkane chain. The branched alkane usually provides at least 30% e.g. 30-80%, such as 50-80% of the total saturated content of the composition or of the total saturated content of the alkylation cut, the remainder being substantially other branched chain alkanes not meeting the specified definition e.g. of bp of 100-160° C., or lower MON value and/or linear hydrocarbons e.g. of 4-8 carbons as described above. Small amounts of cycloalkanes as described above may also be present in the saturate content.

The compositions of part (b) of the invention usually contain less than 5% triptane or 223 trimethyl pentane, especially less than 4.9% or 1%, and in particular are substantially free of triptane and 223 trimethyl pentane (e.g. with less than 0.5% or 0.1% in total of both if present). However, if desired and especially with cuts boiling above 60° C. e.g. 60-160 or 60-100° C., triptane and/or 223 trimethyl pentane may be present in amount of at least 5 or 8% such as 5-20% in the composition.

In the composition of part (b) of the invention, component (g') may be component (b') which is at least one saturated liquid aliphatic hydrocarbon having 4 to 12, 4-10 such as 5-10 e.g. 5-8 carbon atoms. In another embodiment component (b') is contained in at least one of isomerate, full range alkylate with FBP more than 170° C., straight run gasoline, light reformate, light hydrocrackate and aviation alkylate. Preferably the composition comprises at least one of an olefin (e.g. in amount of 1-30% e.g. 8-18%) and/or at least one aromatic hydrocarbon (e.g. in amount of 1-50%, especially 3-35%) and/or less than 5% of benzene. The composition may preferably comprise 5-40% component (a'), less than 1% benzene and have a Reid Vapour Pressure at 37.8° C. measured according to ASTMD323 of 30-120 kPa. The composition is usually an unleaded motor gasoline base blend composition.

The branched chain alkanes e.g. compounds A may be alkanes of 8-12 carbon atoms (especially 8-10 or 8 or 10 carbons) with 3 methyl and/or ethyl branches. Methyl branches are preferred. The compounds usually have their longest chain of carbon atoms, hereinafter called their backbone chain, with 4-6 chain carbon atoms (especially 4 or 5) to which the methyl, and/or ethyl branches are attached. Advantageously, especially in relation to the first to tenth groupings as described further below, there are no branched groups constituting the branches other than methyl or ethyl, and, in the backbone chain of carbon atoms, there are especially no linear alkyl groups of more than 2 carbons nor 1,2 ethylene or 1,3 propylene groups in the chain, and especially no methylene groups in the chain except as part of an ethyl group; thus there are especially no n-propyl or n-butyl groups forming part of the backbone chain. Preferably, when in the composition there is at least one compound (A) alkane of 9-12 e.g. 9 or 10 carbons, there is usually as well less than 50% or 10% of an 8 carbon alkane compound (A).

The compounds can have 1 or 2 methyl or ethyl groups attached to the same carbon atom of the backbone chain, especially 1 or 2 methyl groups and 0 or 1 ethyl groups. The carbon atom in the backbone at which the branching occurs is non-terminal i.e. is an internal carbon in the backbone chain, especially the 2, 3 and/or 4 numbered carbon in the backbone. Thus advantageously the compound has geminal methyl substituents on position 2, 3 or 4 carbon atom, especially position 2, but in particular position 3.

In a first grouping of compounds A, there is one pair of geminal methyl branch substituents, and they are on position 2.

In a second grouping of the compounds A there is 1 pair of geminal methyl branch substituents on a 4-6 carbon chain backbone. The compounds of the second grouping advantageously have a MON value of at least 100.

In a third grouping of the compounds, there is one geminal methyl branch grouping i.e. —$CMe_2$- on the backbone, while on one of the adjacent carbon atoms of the backbone, there is a methyl or ethyl branch, especially a methyl branch.

In a fourth grouping of the compounds there is one pair of geminal methyl branches on the 2 position backbone carbon and there is a methyl branch on the 3 position backbone carbon. Such compounds usually have a RON value of at least 111. Advantageously the compounds are of 8 or 10 carbon atoms.

In a fifth grouping the compound A has 3 methyl or ethyl substituents on different back bone carbon atoms, especially on vicinal carbon atoms.

In a sixth grouping the compounds have a linear backbone chain of 4 or 6 carbons and have 3 methyl branches one pair of which is one geminal group ($CMe_2$) especially in the absence of a 1,2 ethyl group in the backbone.

In a seventh grouping, the compounds have a linear backbone chain of 5 or 6 carbons and have 3 branches one pair of which is in one geminal group, are usually liquid at 25° C. and generally have a RON value of greater than 105. Especially there are only methyl branches; such compounds usually have a MON value of at least 101.

Advantageously in an eighth grouping the compounds A contain 1 chain carbon atoms with geminal methyl branches, with one branch on the vicinal carbon atom to the geminal one, and any ethyl —C— chain group in the backbone chain has 5 carbon atoms i.e. is $(Ethyl)_2CH$ or Ethyl $CMe_2$-.

A particularly preferred sub-class (ninth grouping) for the compound A is alkanes with 3 methyl or ethyl substituents which are (i) on vicinal internal carbon atoms, with a total of 4, 5 or 6 carbon atoms in said substituents.

Or (ii) with a total of 3 carbon atoms in said substituents and a one terminal $CHMe_2$ group.

Or (iii) with a total of 3 carbon atoms in said substituents and contain only secondary internal carbon atoms in the longest carbon atom chain.

Among this sub-class are preferred (i) and (ii) and especially with geminal methyl groups on an internal chain carbon atom.

In another aspect of part (b) of the invention there is provided an unleaded blend composition having a MON value of at least 81 or 85 and RON value of at least 91 or 94, which comprises component (a') a total of at least 15% of one or more branched alkane compounds $A^1$ of 8-12 carbons (especially with 4-6 backbone carbon atoms), with 3 methyl or ethyl branches and at least 2 backbone carbon atom which are secondary and/or tertiary carbon atoms, (subject of course to there being not more than one tertiary backbone carbon atom) with the proviso that if there are only 2 such carbon atoms, then one is tertiary, there being a minimum of at least 10% (by volume of the composition) of at least one individual compound $A^1$, and component (b') of nature and in amount as described herein, with the preferred proviso as described above. In the above component $A^1$, which may be the same or different from A, there may thus in a tenth grouping be in the backbone internal (i.e. non-terminal) carbon atoms which are (i) 1 tertiary and 1 sec, in particular (ii) with the tert and a sec. carbon vicinal or (iii) 1 tertiary 1 sec. and 1 primary especially with vicinal tert and sec. carbons or vicinal or non-vicinal sec. carbons or (iv) 3 sec. carbons, with at least 2 e.g. 3 vicinal. The compounds $A^1$ usually are free from 2 primary internal backbone carbon atoms on vicinal carbons i.e. as in 1,2-ethylene group. Preferably any primary internal backbone carbon atoms are not between, e.g. adjacent on both sides to, a tert. and/or sec. carbon on the one hand and a sec. carbon on the other hand. Especially at least the said 2 backbone carbon atoms above in compounds $A^1$ are vicinal.

In another category, the eleventh grouping is of compounds $A^1$ which contain (with proviso that they only have 3 branched groups) (i) as one end of the backbone a group of formula $CHR^1R^2$ where each of $R^1$ and $R^2$, which are the same or different is a methyl or ethyl group or (ii) as one end of the backbone a group of formula $CR^1R^2R^3$ where $R^1$ and $R^2$ are as defined above and $R^3$ is methyl or ethyl. Preferred are such compounds $A^1$ which have both (i) and (ii), especially when the $CHR^1R^2$ group is $CHMe_2$ when the compound has 8 carbons or a backbone of 5 carbons and when all internal carbon atoms in the backbone chain are secondary or tertiary (subject to a total of 3 branched groups).

The compounds A or $A^1$ may have a boiling point at 1 bar pressure of 129-150° C. 110-129° C., or 90-109° C. In particular the boiling point is preferably at least 105° C. e.g. 105-175° C., with the proviso that compound A or $A^1$ is Not 223 trimethyl pentane or is at least 112° C. such as 112-175° C.

In another category the compounds A or $A^1$ may have 3 methyl and/or ethyl branches on a 4-6 carbon backbone, and especially a ratio of carbon atom in branches to carbon atoms in the backbone chain of at least 0.55:1 e.g. 0.55-0.9:1 such as 0.63-0.9:1. The compounds usually have 9 carbons, unless the above ratio is at least 0.63 or 0.75.

Preferred compounds are 223 trimethyl pentane (A3), 224 trimethyl pentane (isooctane) (A4) 22 $Me_2$ 3 ethyl pentane (A5), 233 trimethyl pentane (A6) 24 dimethyl 3 ethyl pentane (A8), and 234 trimethyl pentane (A9). The branched hydrocarbon may also not be 224 trimethyl pentane and/or 223 trimethyl pentane.

The compounds A and $A^1$ are either known compounds and may be made according to the published literature, or are novel and may be made by conventional methods known per se in the literature (e.g. as described in Kirk Othmer Encyclopaedia of Chemical Technology 3rd Ed. Publ. Wiley). Examples of suitable methods of preparation are known carbon-carbon coupling techniques for making alkanes. The technique may involve reactions of one or more usually 1 or 2 alkyl chlorides, bromides or iodides with an elemental metal of Group IA, IIA, IB or IIB of the Periodic Table in Advanced Inorganic Chemistry by F. A. Cotton+G. wilkinson, Pub. Interscience New York 2nd Ed. 1966, especially sodium, magnesium, or zinc. The alkyl halide is usually a branched chain one of 3-6 carbons, in particular with methyl or ethyl branches, and especially with the halogen atom attached to a $CMe_2$ group in one of the alkyl halides. Preferably a halide is of formula $MeCMe_2X$ or $EtCMe_2X$, where X is Cl, B or I and the other halide is a secondary halide e.g. of formula $RR^1CH$—X where each of R and $R^1$ is methyl or ethyl, such as isopropyl or sec butyl or sec amyl halide or a primary branched alkyl halide e.g. of formula $R^{11}CH_2X$, where $R^{11}$ is a branched alkyl group 3-5 carbons with methyl or ethyl branches, such as isopropyl, isobutyl or isoamyl. Alternatively both halides can be secondary e.g. of formula $RR^1CHX$, as defined above and $R^{111}R^{IV}CHX$ where $R^{111}$ is methyl or ethyl and $R^{IV}$ is as defined for $R^{11}$, such as isopropyl or one can be secondary (as above) and one can be primary e.g. methyl or ethyl halide. The methods of coupling optimum for any particular compound A or $A^1$ depend on availability of the precursor alkyl halide(s) so that in addition to the above kinds, coupling via methyl or ethyl halides with branched alkyl halides of 6-9 carbons may also be used. The alkyl halide(s) can react together in the presence of the metal (as in a Wurtz reaction with sodium), or one can react first with the metal to form an organometallic compound e.g. a Grignard reagent or organo zinc, followed by reaction of the organometallic with the other alkyl halide. If desired the Grignard reagent reaction can be in the presence of a metal of Group IB or IIB, such as silver, zinc or copper (especially high activity copper). If desired the Grignard reagent from one or both alkyl halides can be reacted with the latter metal to form other alkyl metallic species e.g. alkyl silver or alkyl copper compounds, which can disproportionate to the coupled alkane. The Grignard reagent(s) can also react with a cuprous halide to form alkyl copper species for disproportionation. Finally an organometallic compound, wherein the metal is of Group IA or IIA e.g. Li or Mg can be coupled by reaction with a cuprous complex to give a coupled alkane.

The above organometallic reactions are usually conducted under inert conditions, i.e. anhydrous and in the absence of oxygen e.g. under dry nitrogen. They are usually performed in an inert solvent e.g. a dry hydrocarbon or ether. At the end of the reaction any residual organometallic material is decomposed by addition of a compound with active hydrogen e.g. water or an alcohol, and the alkanes are distilled off, either directly or after distribution between an organic and aqueous phase.

Examples of preparations of highly branched alkanes are described in F L Howard et al, J Res. Nat. Bur. Standards Research Paper RP1779, Vol 38 Mar. 1947 pp 365-395. The disclosures of is document is incorporated herein by reference.

The crude alkanes made by the above processes may be used as such in the blends of part (b) of the invention or may be purified further e.g. by distillation first.

If desired the compounds, especially of 8 carbon atoms may be obtained by fractional distillation of refinery streams e.g. straight run gasolines, or alkylation products e.g. of isoalkanes of 3-5 carbons with alkanes of 3-5 carbons (as described above)

Other known methods of making the alkanes A or $A^1$, are reaction of alkyl metallic compounds e.g. Grignard reagents with carbonyl compounds such as aldehydes, ketones, esters, or anhydrides to form branched chain carbinols, which are dehydrated to the corresponding olefin, which is hydrogenated to the alkane. Thus 2,3,4-trimethyl pentane may be made from isopropyl magnesium bromide and methyl isopropyl ketone (followed by dehydration and hydrogenation), and 2,2-dimethyl 3 ethyl pentane, from ethyl magnesium chloride and diisopropyl ketone.

Part (b) of the present invention also provides an unleaded formulated motor gasoline which comprises said composition of the first to seventh aspects of part (b) of the invention and at least one gasoline additive e.g. motor or aviation gasoline additive.

The component (a') may be present in amount of 5-95% or 8-90% such as 10-90%, or 15-65% e.g. 20-55% or 10-40% such as 20-35% by volume or 40-90% such as 40-55% or 55-80% or 8-35% such as 8-20% by volume. Unless otherwise stated all percentages in this specification are by volume, and disclosures of a number of ranges of amounts in the composition or gasoline for 2 or more ingredients includes disclosures of all sub-combinations of all the ranges with all the ingredients.

Part (b) of the invention in its first to fourth aspects will be further described with alkylate cuts exemplifying the refinery stream component (a') but others may be used instead or as well.

The composition of part (b) of the invention may also contains as component (b') at least one liquid saturated hydrocarbon of 5-10 carbons especially predominantly branched chain $C_7$ or $C_8$ compounds e.g. iso $C_7$ or iso $C_8$. This hydrocarbon may be substantially pure e.g. n-heptane, isooctane or isopentane or a mixture e.g. a distillation product or a reaction product from a refinery reaction e.g. alkylate. The hydrocarbon may have a Motor Octane Number (MON) of 0-60 but preferably has a MON value of 60-96 such as isomerate (bp 25-80° C.). Research Octane Number RON may be 80-105 e.g. 95-105, while the ROAD value (average of MON and RON) may be 60-100.

Component (b') which is different from component (a') may comprise a hydrocarbon component having boiling point (preferably a final boiling point) of at least 82° C., such as 85-150° C. but less than 225° C. e.g. less than 170° C. or 160° C. and usually is of Motor Octane Number of at least 92 e.g. 92-100; such components are usually alkanes of 7-10 carbons especially 7 or 8 carbons, and in particular have at least one branch in their alkyl chain, in particular 1-3 branches, and preferably on an internal carbon atom and especially contain at least one —$C(CH_3)_2$— group.

The volume amount of the component (b') in total (or the volume amount of mixtures comprising component (b'), such as the total of each of the following (if present) (i)-(iv)) (i) catalytic reformate, (ii) heavy catalytic cracked spirit, (iii) light catalytic cracked spirit and (iv) straight run gasoline in the composition is usually 10-80% e.g. 25-70%, 40-65% or 20-40%, the higher percentages being usually used with lower percentages of component (a').

Component (b') may be a mixture of the liquid saturated hydrocarbons e.g. a distillation product e.g. naphtha or straight run gasoline or a reaction product from a refinery reaction e.g. alkylate including full range alkylate (bp 30-190° C.) isomerate (bp 25-80° C.), light reformate (bp 20-79° C.) or light hydrocrackate. The mixture may contain at least 60% or at least 70% w/w e.g. 60-95 or 70-90% w/w liquid saturated aliphatic hydrocarbon.

The compositions of part (b) of the invention may contain mixtures of component (a') e.g. alkylate cut of 15-100° C. with full range boiling alkylate (i.e. of FBP greater than 170° C. e.g. 190° C.) in a ratio of 9:1 to 1:9 in particular 5-9:5-1 or 1-3:9-7. If desired such mixtures may be made by dividing the full range alkylate into first and second portions, a first portion being distilled to provide the desired cut and then the cut mixed with the second portion. The residue from the cut can be used elsewhere as described above.

Volume amounts in the composition of part (b) of the invention of the component (b') mixtures (primarily saturated liquid aliphatic hydrocarbon fractions e.g. the total of isomerate, full range alkylate, naphtha and straight run gasoline (in each case (if any) present in the composition) may be 4-60%, such as 4-25% or preferably 10-55% such as 25-45%. Full range alkylate or straight run gasoline are preferably present for component (b'), optionally together but preferably in the absence of the other, in particular in amount of 2-50% such as 10-45 e.g. 10-25%, 25-45% or 25-40%. The compositions of part (b) of the invention may also comprise naphtha e.g. in volume amount of 0-25% such as 2-25%, 10-25% or 2-10%.

The compositions may comprise as component (c') a hydrocarbon component which is a saturated aliphatic hydrocarbon of 4-6 carbons and which has a boiling point of less than 80° C. under atmospheric pressure, such as 20-50° C., and especially is itself of Motor Octane Number greater than 88 in particular at least 90 e.g. 88-93 or 90-92. Examples of the hydrocarbon component include alkanes of 4 or 5 carbons in particular iso-pentane, which may be substantially pure or crude hydrocarbon fraction from reformate or isomerate containing at least 30% e.g. 30-80% such as 50-70%, the main contaminant being up to 40% mono methyl pentanes and up to 50% dimethyl butanes. The hydrocarbon component may be an alkane of boiling point (at atmospheric pressure) −20° C. to +20° C. e.g. n and/or iso butane optionally in blends with the $C_5$ alkane of 99.5:0.5 to 0.5:99.5, e.g. 88:12 to 75:25. n Butane alone or mixed with isopentane is preferred, especially in the above proportions, and in particular with a volume amount of butane in the composition of up to 20% such as 1-15% e.g. 1-8, 3-8 or 8-15%.

Cycloaliphatic hydrocarbons e.g. of 5-7 carbons such as cyclopentane or cyclohexane may be present but usually in amounts of less than 15% of the total e.g. 1-10%.

Volume amounts in the composition of the total of isomerate, full range alkylate, naphtha, straight run gasoline, 4-6 carbon liquid aliphatic hydrocarbon (as defined above) and cycloaliphatic hydrocarbon (in each case if present) may be 5-60%, such as 8-25%, 15-55% such as 30-50%.

The compositions of part (b) of the invention also preferably contain as component (d') at least one olefin, (in particular with one double bond per molecule) which is a liquid alkene of 5-10 e.g. 6-8 carbons, such as a linear or branched alkene e.g. pentene, isopentene hexene, isohexene or heptene or 2 methyl 2 pentene, or a mixture comprising alkenes which may be made by cracking e.g. catalytically or thermally cracking a residue from crude oil, e.g. atmospheric or vacuum residue; the mixture may be heavy or light catalytically cracked spirit (or a mixture thereof). The cracking may be steam assisted. Other examples of olefin containing mixtures are "C6 bisomer", catalytic polymerate, and dimate. The olefinic mixtures usually contain at least 10% w/w olefins, such as at least 40% such as 40-80% w/w. Preferred mixtures are (xi) steam cracked spirit (xii) catalytically cracked spirit (xiii) C6 bisomer and (xiv) catalytic polymerate, though the optionally cracked catalytically spirits are most advantageous. Amounts in the total composition of the olefinic mixtures especially the sum of (xi)-(xiv) (if any present) maybe 0-55, e.g. 10-55 or 18-37 such as 23-35 or 20-55 such as 40-55% or 23-40% Amounts of (xi) and (xii) (if present) in total in the composition are preferably 18-55, such as 18-35, 18-30 or 35-55% (by volume).

The olefin or mixture of olefins usually has an MON value of 70-90, usually a RON value of 85-95 and a ROAD value of 80-92.

The volume amount of olefin(s) in total in the gasoline composition of part (b) of the invention may be 0% or 0-30%, e.g. 0.1-30% such as 1-30% in particular 2-25, 5-30, (especially 3-10), 5-18.5, 5-18 or 10-20%. Preferably the composition contains at least 1% olefin and a maximum of 18% or especially a maximum of 14%, but may be substantially free of olefin.

The compositions may also contain as component (e') at least one aromatic compound, preferably an alkyl aromatic compound such as toluene or o, m, or p xylene or a mixture thereof or a trimethyl benzene. The aromatics may have been added as single compounds e.g. toluene, or may be added as an aromatics mixture containing at least 30% w/w aromatic compounds such as 30-100% especially 50-90%. Such mixtures may be made from catalytically reformed or cracked gasoline obtained from heavy naphtha. Example of such mixtures are (xxi) catalytic reformate and (xxii) heavy reformate. Amounts of the single compounds e.g. toluene in the composition may be 0-35%, such as 2-33% e.g. 10-33%, while amounts of the aromatics mixtures especially the total of the reformates (xxi) & (xxii) (if any) in the composition may be 0-50%, such as 1-33% e.g. 2-15% or 2-10% or 15-32% v/v, and total amount of reformates (xxi), (xxii) and added single compounds (e.g. toluene) may be 0-50% e.g. 0.5-20% or 5-40, such as 15-35 or 5-25% v/v.

The aromatics usually have a MON value of 90-110 e.g. 0.100-110 and a RON value of 100-120 such as 110-120 and a ROAD value of 95-110. The volume amount of aromatic compounds in the composition is usually 0% or 0-50% such as less than 40% or less than 28% or less than 20% such as 1-50%, 2-40%, 3-28%, 4-25%, 5-20% (especially 10-20%), 4-10% or 20-35% especially of toluene. The gasoline composition may also be substantially free of aromatic compound. Amounts of aromatic compounds of less than 42%, e.g. less than 35% or especially less than 30% are preferred. Preferably the amount of benzene is less than 5% preferably less than 1.5% or 1% e.g. 0.1-1% of the total volume or less than 0.1% of the total weight of the composition.

The compositions may also contain as component (f") at least one oxygenate octane booster, usually of Motor Octane Number of at least 96-105 e.g. 98-103. The oxygenate may be any organic liquid molecule containing and preferably consisting of, CH and at least one oxygen atom e.g. 1-5 of bp less than 225° C. The octane booster is usually an ether e.g. a dialkyl ether, in particular an asymmetric one, preferably wherein each alkyl has 1-6 carbons, in particular one alkyl being a branched chain alkyl of 3-6 carbons in particular a tertiary alkyl especially of 4-6 carbons such as tert-butyl or tert-amyl, and with the other alkyl being of 1-6 e.g. 1-3 carbons, especially linear, such as methyl or ethyl. Examples of such oxygenates include methyl tertiary butyl ether (MTBE), ethyl tertiary butyl ether and methyl tertiary amyl ether. The oxygenate may also be an alcohol of 1-6 carbons e.g. ethanol. The oxygenate may also be an organic carbonate e.g. a dialkyl carbonate with 1-3 carbon atoms in each alkyl e.g. dimethyl carbonate.

The volume amount of the oxygenate may be 0 or 0-25% such as 1-25%, 2-20%, 2-10% or 5-20% especially 5-15%, but advantageously less than 3% such as 1-3% (especially of MTBE and/or ethanol). The oxygenate may also be substantially absent from the composition or gasoline of part (b) of the invention.

Thus part (b) of the present invention produces an unleaded blend composition of MON value at least 81 or 85 and RON value at least 91 or 94 which comprises (a') a total of at least 15% of one or more branched hydrocarbon compound A or $A^1$ there being a minimum of at least 5% of at least one individual compound A or $A^1$ and (b') at least 20% of at least one different liquid hydrocarbon of bp60-160° C. having a MON value of at least 70 and RON value at least 90 especially when (b') is not within the definition of A or $A^1$, in particular when (a') is a trimethyl pentane. Examples of the liquid hydrocarbons are paraffins, such as linear or branched chain alkanes of 4-8 carbons, such as isobutane, butane, isopentane, dimethyl alkanes such as 23 dimethyl butane, cycloalkanes, such as cyclopentane and cyclohexane, aromatics and olefins.

Another unleaded blend composition of part (b) of the invention of MON value of at least 81 or 85 and RON value of at least 91 or 94 comprises component (a') as above and component (b') at least 20% of at least one of a straight run naphtha, alkylate isomerate (bp25-80° C.) heavy reformate, light reformate (bp20-79° C.), hydrocrackate, aviation alkylate (bp30-190° C.), straight run gasoline, cracked spirit, such as heavy or light catalytic cracked spirit or steam cracked spirit. The straight run products are produced directly from crude oil by atmospheric distillation. The naphtha may be light naphtha of bp30-90° C. or medium naphtha of bp90-150° or heavy naphtha of bp150-220° C.

In the blends of part (b) of the invention, the amount of at least one individual compounds A or $A^1$ is usually at least 5%, or at least 10 or 15%, such as 5-60%, e.g. 15-60%, or 8-25%, 20-35% or 30-55% or 2-10%. The amount of compound A4 if present is usually at least 10% of the composition. Total amounts of trimethyl pentanes in the blend are preferable less than 69% of the blend, but advantageously at least 26% (especially when the amount of aromatics is less than 17%. If a 9 or 10 carbon alkane is (a'), then the amount of 2,2,4-trimethyl pentane is especially less than 70 or 50%. More than one such compound A or $A^1$ may be present e.g. of higher and lower RON in weight ratios of 9:1 to 0.5:99.5, such as 0.5:1 to 5:1 or 5:95 to 20:80, particularly for mixtures of compounds with higher or lower boiling points (atmospheric pressure) e.g. those in which the compounds A and/or $A^1$ have boiling points differing by at least 10° C. e.g. at least 40° C. such as 10-70° C. or 20-50° C. the relative amounts being as described above. Total amounts of all compounds A and $A^1$ (if any) in the blend may be 15-70 e.g. 15-60, 15-40 or 30-55% or 40-60%.

The blend may also comprise predominantly aliphatic refinery streams such as naphtha, straight run gasoline (also known as light naphtha bp 25-120° C.), alkylate and isomerate. Amounts in total of these may be 10-70%, such as 10-30, 30-70 or 35-65%. Amounts of naphtha may be 0-70% or 1-70% such as 10-30, 30-70 or 35-65%, while amounts of light naphtha may be 0 or 1-70 such as 1-20 or especially 30-65%, and amounts of medium naphtha may be 0 or 1-55, such as 3-20 or 15-55%. The volume ratio of light to medium naphtha may be 50:1 to 1:50, such as 0.5-20:1 or 1:0.5-50. Amounts of alkylate or isomerate (if present) may be 0.5-20% such as 1-10%, while amounts of hydrocrackate may be 0.5-30% e.g. 10-30%.

The blends of part (b) of the invention usually contain in total at least 70% of saturates, such as 70-98% or 70-90% or 90-98%.

If desired and especially for aviation gasoline, the blends may contain a hydrocarbon component which is a saturated aliphatic hydrocarbon of 4-6 carbons and which has a boiling point of less than 80° C. under atmospheric pressure, such as 20-50° C., and especially is itself of Motor Octane Number greater than 88 in particular at least 90 e.g. 88-93 or 90-92. Examples of the hydrocarbon component include alkanes of 4 or 5 carbons in particular iso-pentane, which may be substantially pure or crude hydrocarbon fraction from reformate or isomerate containing at least 30% e.g. 30-80% such as 50-70%, the main contaminant being up to 40% mono methyl pentanes and up to 50% dimethyl butanes. The hydrocarbon component may be an alkane of boiling point (at atmospheric pressure) −20° C. to +20° C. e.g. n and/or iso butane optionally in blends with the $C_5$ alkane of 99.5:0.5 to 0.5:99.5, e.g. 88:12 to 75:25. n Butane alone or mixed with isopentane is preferred, especially in the above proportions, and in particular with a volume amount of butane in the composition of up to 20% such as 1-15% e.g. 1-8, 3-8 or 8-15%, especially 1-3.5%.

The hydrocarbon component boiling less than 80° C., in particular isopentane, may also be present in compositions of part (b) of the invention which contain at least one compound A or $A^1$ of at least 10 carbon atoms. Relative amounts of these compounds A or $A^1$ to the low boiling component e.g. isopentane, may be 1-9:9-1 such as 5-9:5-1, especially with less than 20% of A or $A^1$ in the composition.

Cycloaliphatic hydrocarbons e.g. of 5-7 carbons such as cyclopentane or cyclohexane may be present but usually in amounts of less than 15% of the total e.g. 1-10%.

The blend of part (b) of the invention contains at least one component (a') and component (g') and, (optionally (c') to (f'), as well, and the formulated unleaded gasoline also contains at least one gasoline additive e.g. a motor gasoline or aviation gasoline additive, for example as listed in ASTM D-4814 the contents of which is herein incorporated by reference or specified by a regulatory body, e.g. US California Air Resources Board (CARB) or Environmental Protection Agency (EPA). These additives are distinct from the liquid fuel ingredients, such as MTBE. Such additives may be the lead free ones described in Gasoline and Diesel Fuel Additives, K Owen, Publ. By J. Wiley, Chichester, UK, 1989, Chapters 1 and 2, U.S. Pat. No. 3,955,938, EP 0233250 or EP 288296, the contents of which are herein incorporated by reference. The additives maybe pre-combustion or combustion additives. Examples of additives are anti-oxidants, such as one of the amino or phenolic type, corrosion inhibitors, anti-icing additives e.g. glycol ethers or alcohols, engine detergent additives such as ones of the succinic acid imide, polyalkylene amine or polyether amine type and anti-static additives such as ampholytic surface active agents, metal deactivators, such as one of thioamide type, surface ignition inhibitors such as organic phosphorus compounds, combustion improvers such as alkali metal salts and alkaline earth metal salts of organic acids or sulphuric acid monoesters of higher alcohols, anti valve seat recession additives such as alkali metal compounds, e.g. sodium or potassium salts such as borates or carboxylates e.g. sulpho succinates, and colouring agents, such as azodyes. One or more additives (e.g. 2-4) of the same or different types may be used, especially combinations of at least one antioxidant and at least one detergent additive. Antioxidants such as one or more hindered phenols e.g. ones with a tertiary butyl group in one or both ortho positions to the phenolic hydroxyl group are preferred in particular as described in Ex. 1 hereafter. In particular the additives may be present in the composition in amounts of 0.1-100 ppm e.g. 1-20 ppm of each, usually of an antioxidant especially one or more hindered phenols. Total amounts of additive are usually not more than 1000 ppm e.g. 1-1000 ppm.

The compositions and gasolines are free of organolead compounds, and usually of manganese additives such as manganese carbonyls.

The compositions and gasolines may contain up to 0.1% sulphur, e.g. 0.000-0.02% such as 0.002-0.01% w/w.

The motor gasoline compositions of part (b) of the invention in particular those based on the distillation cuts e.g. alkylate cuts usually have a MON value of 80 to less than 98, such as 80-95, 83-93, 85-90 or 93-98. The RON value is usually 90-115 e.g. 102-115 or preferably 90-102 preferably 90-100 e.g. 90-99, such as 90-93 e.g. 91, or 93-98 e.g. 94.5-97.5, or 97-101 while the ROAD value is usually 85-107 e.g. 98-106 or preferably 85-98 such as 85-95 e.g. 85-90, or 90-95 or 95-98. Preferred gasoline compositions have MON 80-83, RON 90-93, and ROAD 85-90, or MON 83-93, RON 93-98 and ROAD 85-95 or MON 85-90, RON 97-101 and ROAD 91-96. The Net calorific value of the gasoline (also called the Specific Energy) is usually at least 18000 Btu/lb e.g. at least 18500, 18700 or 18,900 such as 18500-19500, such as 18700-19300 or 18900-19200; the calorific value may be at least 42 MJ/kg e.g. at least 43.5 MJ/kg such as 42-45 or 43-45 such as 43.5-44.5 MJ/kg. The gasoline usually has a boiling range (ASTM D86) of 20-225° C., in particular with at most 5% e.g. 0-5% or 1-3% boiling in the range 161-200° C. The gasoline is usually such that at 70° C. at least 10% is evaporated while 50% is evaporated on reaching a temperature in the range 77-120° C. preferably 77-116° C. and by 185° C., a minimum of 90% is evaporated. The gasoline is also usually that 8-50% e.g. 10-50% may be evaporated at 70° C., 40-74% at 100° C., 70-99.5% e.g. 70-97% at 150° C. and 90-99% may be evaporated at 180° C.; preferably at least 46% e.g. 46-65% has been evaporated by 100° C. The Reid Vapour Pressure of the gasoline at 37.8° C. measured according to ASTM D323 is usually 30-120, e.g. 40-100 such as 61-80 or preferably 50-80, 40-65, e.g. 40-60 or 40-50 Kpa.

The unleaded motor gasolines of part (b) of the invention preferably comprise the component (a') and have a RON value of at least 98, MON value of at least 87.8, an RVP of less than 60 K Pa e.g. 40-60 kPa less than 35% aromatics, less than 15% olefins, 10-45% evaporated at 70° C., 46-60% evaporated at 100° C., and more than 88% evaporated at 150° C. Their density is preferably at least 0.71 e.g. 0.71 to 0.78 such as at least 0.7122 or at least 0.72 such as 0.7122 to 0.7264 kg/l.

The gasoline compositions of part (b) of the invention in particular those based the branched chain alkanes for component (a') in particular in its fifth to seventh aspects usually have a MON value of 80 to 94 such as 85-90, or 90-94-. The RON value is usually 90-105 e.g. 98-102, or 93-98 e.g. 94.5-97.5, or 97-101 while the ROAD value is usually 85-102 e.g. 98-102 or 85-95. Preferred gasoline compositions have MON 83-93, RON 93-98 and ROAD 85-95 or MON 85-90, RON 94-101 and ROAD 89-96. The Net calorific value of the gasoline (also called the Specific Energy is usually as described above as are the boiling ranges measured according to ASTM D86 and the RVP.

The gasoline compositions, when free of any oxygenates usually have a H:C atom ratio of at least 1.8:1 e.g. at least 2.0:1 or at least 2.1 or 2.2:1, such as 1.8-2.3:1 or 2.0-2.2:1. Advantageously the gasoline composition meets the following criteria.

$$\text{Atom H:C} \times [1 + \text{oxy}] \times [\text{Net } \frac{\text{Heat of}}{200} \text{ Combustion} + ROAD] \geq y,$$

wherein Atom H:C is the fraction of hydrogen to carbon in the hydrocarbons in the composition, oxy means the molar fraction of oxygenate, if any in the composition, Net Heat of Combustion is the energy derived from burning 1 lb (454 g) weight of fuel (in gaseous form) in oxygen to give gaseous water and carbon dioxide expressed in Btu/lb units [MJ/kg times 430.35], and y is at least 350, 380, 410 or 430, in particular 350-440 e.g. 380-420 especially 400-420.

Preferably the motor gasoline of part (b) of this invention comprises 10-90% of component (a'), 10-80% of component (b'), 0-25% naphtha, 0-15% of butane, 5-20% of olefin, 3-28% aromatics and 0-25% oxygenate, in particular with 5-20% aromatics and 5-15% olefins.

In a preferred embodiment of part (b) of this invention the motor gasoline of part (b) of this invention contains 8-65% of component (a') (especially 15-35%), 0.1-30% such as 2-25% olefins, especially 3-14% and 0-35% aromatics such as 0-30% e.g. 5-35, 5-20 (especially 5-15%) or 20-30%, and 5-50% component (b') mixtures e.g. 10-45% such as 20-40%. Such gasolines may also contain oxygenates, such as MTBE especially in amount of less than 3% e.g. 0.1-3% and especially contain less than 1.0% benzene e.g. 0.1-1% and especially olefins less than 18% e.g. 0.1-15%. Such gasolines preferably have RON of 96-99, MON 86-90 and ROAD values of 91-94.5.

Examples of motor gasolines of part (b) of the invention are ones with 5-25% component (a'), 5-15% olefins, 15-35% aromatics and 40-65% component (b'), in particular 15-25% component (a'), 7-15%, olefins 15-25% aromatics and 45-52% component (b') mixture of RON value 96.5-97.5, or 5-15% component (a'), 7-15% olefins, 15-25% aromatics and 55-65% compound (b') of RON value 94.5-95.5.

Examples of motor gasolines of part (b) of the invention are ones having 1-15% e.g. 3-12% butane, 0-20% e.g. 5-15% ether e.g. MTBE, 20-80 e.g. 25-70% of refinery mixed liquid (usually $C_6$-$C_9$) streams (apart from naphtha) (such as mixtures of (i)-(iv) above), 0-25% e.g. 2-25% naphtha, 5-70% e.g. 15-65% component (a'), with RON 93-100 e.g. 94-98, MON 80-98 e.g. 83-93 or 93-98, and RVP 40-80 such as 40-65 Kpa. Such gasolines usually contain 1-30% e.g. 2-25% olefins and 2-30% e.g. 4-25% aromatics. Amounts of olefins of 15-25% are preferred for RON values of 94-98 e.g. 94-96 and 2-15% e.g. 2-7% for RON values of 96-100 such as 96-98.

Other examples of fuel compositions of part (b) of the invention contain 8-18% component (a'), 10-50% e.g. 25-40% of total component (b') mixture, 5-40% e.g. 20-35% of total aromatics mixture 15-60, e.g. 15-30% or 40-60% of total olefinic mixture and 0-15% total oxygenate e.g. 3-8% or 8-15%. Especially preferred compositions have 8-18% component (a'), 25-40% total mixed component (b') mixture, 20-35% total aromatics, and 15-30% total olefinics, or 8-18% component (a'), 15-40% total mixed component (b') mixture, 3-25% total aromatics mixture, and 40-60% total olefinic mixture.

Further examples of fuel compositions contain 20-40% component (a'), 8-55% of the total component (b') mixture, e.g. 5-25% or 35-55%, and 0 or 5-25% e.g. 18-25% total aromatics mixture, 0-55 especially 10-55 or 40-55% total olefin mixture, especially preferred compositions having 20-40% component (a'), 5-25% total component (b') mixtures, 3-25% total aromatics mixture and 40-60% total olefinic mixture, or 20-40% component (a'), 35-55% total component (b') mixture 15-30% total aromatics mixture and 0-15% e.g. 5-15% total olefin mixture, or in particular 20-40% component (a'), 25-45% or 30-50% total component (b') mixture, 2-15% total aromatics mixture 18-35% total olefins mixture, and especially 3-10% or 5-18% olefins, and 10-35% such as 10-20% aromatics (e.g. 10-18%).

Other examples of fuel compositions contain 30-55% e.g. 40-55% component (a'), 5-30% total component (b') mixture, 0-10% total aromatic mixture, 10-45% olefinic mixture and 0-15% oxygenates especially with the total of oxygenates and olefinic mixture of 20-45%. Other examples of fuel compositions contain 55-70% component (a'), 10-45% total component b', e.g. 10-25% or 35-45%, and 0-10% e.g. 0 or 0.5-5% total aromatics Mixture, and 0-30% total olefinics mixtures, e.g. 0 or 15-30%, especially 55-70% component (a'), 10-25% total component (b') 0 or 0.5-5% total aromatics mixture and 15-30% total olefinic mixture.

Particularly preferred examples of fuel composition comprise 15-35% e.g. 20-35% component (a'), 0-18.5% e.g. 2-18.5% olefin, 540% e.g. 5-35% aromatics 25-65% saturates and less than 1% benzene, and 18-65% e.g. 40-65% component (a'), 0-18-5% e.g. 5-18.5% olefins, 5-42% e.g. 5-28% aromatics, 35-55% saturates and less than 1% benzene.

Another fuel composition may comprise 25-40% e.g. 30-40% such as 35% of alkylate (especially full bp range alkylate with IBP 30° C. or more and FBP greater than 165° C.), 10-25% e.g. 15-25% such as 20% of isomerate, 10-25% e.g. 15-25% such as 20% of light hydrocrackate and 20-35% e.g. 20-30% such as 25% of component (a') and optionally 0-5% butane. Such a composition is preferably substantially paraffinic and is substantially free of olefins and aromatics.

A further gasoline composition which provides a specific aspect of part (b) of the present invention comprises 2-20% e.g. 5-15% component (a') especially an alkylate cut at 15-100° C., 20-40% e.g. 25-35% full boiling range alkylate e.g. of FBP 175-200° C. (especially with a sum of component (a') and alkylate of 35-45%) 25-40% olefinic mixtures such as steam cracked spirit, 5-20% e.g. 7-15% reformate, 10-25% e.g. 12-20% toluene and 0.1-3% e.g. 0.5-2.0% butane. A preferred gasoline of part (b) of the invention e.g. the last one usually RON 98-101, MON 86-89 E100° C. (% evaporated at 100° C.) 45-55 e.g. 48-52, aromatics 30-40% such as 30-35%, olefins 3-15% e.g. 5-10%, and total saturates of 50-65% e.g. 55-60%. Such a composition is free of added oxygenates. The toluene may be replaced by an equal volume of heavy reformate.

A further gasoline composition of particular value comprises 0.5-5% e.g. 2-4% butane, 10-30% e.g. 15-25% full range alkylate (e.g. of FBP 175-200° C.), 10-40% such as 20-35%) component (a'), especially of alkylate cut 110-115, 115-125, 15-160, or 15-100° C. (in particular with the total of alkylate and component (a') of 35-60% e.g. 40-55%, catalytic reformate 30-50%, and bisomer 5-15%, MON 87-90, RON 98-101 and ROAD 93-95. Such a composition is also free of oxygenate.

Other motor fuel compositions of part (b) of the invention may have different ranges of the Antiknock Index (also known as The ROAD Index), which is the average of MON and RON.

For ROAD Indexes of 85.5-88.5, the compositions may comprise 8-30% component (a') e.g. 15-30%, and 10-50% e.g. 20-40% total component (b') mixture, 5-30%, e.g. 5-20% total olefins and 10-40 e.g. 15-35% total aromatics, or 8-30% component (a'), 10-50% total component (b') mixture, 5-40% total aromatic mixtures e.g. 20-30% and 10-60% e.g. 30-55% total olefinic mixtures.

For ROAD Indexes of 88.5-91.0 the compositions may comprise 5-25% (or 5-15%) components (a'), 20-45% total component (b') mixture, 0-25% e.g. 1-10 or 10-25% 10 total olefins, and 10-35% e.g. 10-20% or 20-35% total aromatics or 5-25% (5-15%) component (a'), 20-45% total component (b') mixture, 0-35% total aromatic mixtures e.g. 1-15 or 15-35%, and 5-65% e.g. 5-30 or 30-65% total olefinic mixtures.

For ROAD Indexes of 91.0-94.0 the fuel compositions of part (b) of the invention may comprise 5-65% e.g. 5-20, 20-30, 30-65 or 40-65% component (a') and 5-40% (5-35%) e.g. 5-12 or 12-40% (12-30%) total component (b') mixture 1-30% e.g. 1-10 or 10-25% total olefins and 5-55% e.g. 5-15 or 15-35 or 35-55% total aromatics, or the above amounts of component (a') with 0-55 e.g. 0.5-25% e.g. 10-25% or 25-55% of aromatic fractions and 0 or 10-60% e.g. 10-30% or 35-60% total olefin fractions.

For ROAD values of 94-97.9, the fuel compositions may comprise 20-65% component (a') e.g. 40-65% component (a'), 0-15% e.g. 5-15% total olefins, 0-20% e.g. 5-20% total aromatics and 5-50 e.g. 30-50% total component (b') mixture, or the above amounts of component (a') and total component (b') mixture with 0-30% e.g. 10-30% aromatic fractions and 0-30 e.g. 5-30% olefinic fraction, or the above amounts of component (a') e.g. 20-40% component (a'), total component b' mixture, total olefins and total aromatics, with 2-15% aromatic fractions and 18-35% olefinic fractions.

Among preferred blends of part (b) of the invention especially for the fifth to seventh aspects are unleaded blends comprising as component (a') at least 10% of at least one individual compound A or $A^1$ and component (b') as defined above, with the provisos that (i) when the compound A or $A^1$ is a trimethylpentane, then the blend contains 10-65% of total trimethyl pentanes, and at least 10% of an alkane of 6 or 7 carbons and MON value of at least 70 and RON value of at least 90, and preferably contains less than 5% of 2,2,3-trimethylpentane and 2,2,3-trimethyl butane, and (ii) when the compound A or $A^1$ is an alkane of 9 or 10 carbon atoms, then blend contains at least 10% of an alkane of 6 or 7 carbons of MON at least 70 and RON at least 90, and preferably contains less than 5% in total of 2,2,3-trimethyl pentane and 2,2,3-trimethyl butane. In the case of proviso (i) this blend preferably comprises at least 26% (or 30%) in total of alkanes of 7 or 8 carbons of MON at least 70 and RON at least 90, and/or contains less than 17% in total of aromatics.

Preferred formulated unleaded gasolines of part (b) of the invention comprise at least one gasoline additive and the preferred unleaded blend in the previous paragraph with the proviso (iii) when the compound A or $A^1$ is a trimethyl pentane, then the blend contains 10-65% of total trimethyl pentanes and less than 5% of 2,2,3-trimethyl pentane and 2,2,3-trimethyl butane, and (iv) when the compound A or $A^1$ is an alkane of 9 or 10 carbon atoms, the blend preferably contains less than 5% in total of 2,2,3-trimethyl pentane and 2,2,3-trimethyl butane.

Preferred blends and gasolines of part (b) of the invention especially in the fifth to seventh aspects can have MON values of 80-94 e.g. 80-85 or 90-94, RON values of 90-105 e.g. 90-95 or 97-105, ROAD values of 85-102, compound A or $A^1$ contents of 30-60% e.g. 40-60% (comprising 1 or 2 compounds A or $A^1$), total naphtha contents of 35-65% (e.g. 35-55%) and 1-5% butane, the blends containing 1-8% e.g. 2-6% aromatics, 0-1% olefins and 91-99% (e.g. 94-98%) saturates. These are substantially aliphatic blends and gasolines of high octane numbers, without the use of oxygenates such as MTBE, and also substantially saturated.

Other high octane blends and gasolines of part (b) of the invention especially in the fifth to seventh aspects can have MON values of 80-95 e.g. 85-95, RON values of 90-100 e.g. 95-100, ROAD values of 85-97, compound A or $A^1$ contents of 30-60% e.g. 30-50% (comprising 1 or 2 compounds A or $A^1$, medium naphtha contents of 5-30% and contents of total olefinic fraction such as steam cracked spirit of 30-50% and 1-5% butane, the blends containing 10-25% aromatics e.g. 12-18% aromatics, 4-14% olefins e.g. 6-12%, and 60-90% such as 70-80% saturates. These high octane materials are obtained without the use of oxygenates.

Further blends and gasolines of part (b) of the invention can have MON values of 84-90, RON values of 93-98, ROAD values of 86-94, and contain compound A or $A^1$ in amount of 15-35%, total naphtha of 40-65% and olefinic fractions such as steam cracked spirit of 15-45% and 0 or 1-5% butane, with aromatic contents of 5-25% such as 10-18% olefin contents of 2-14% and saturate contents of 70-90%.

Other blends and gasolines of part (b) of the invention can contain 10-35% compound A or $A^1$, and naphtha 30-50%, hydrocrackate 10-30% alkylate and/or isomerate 2-10%, and reformate 3-12%.

Part (b) of the present invention also provides a blend comprising component (a') and usually at least one motor gasoline additive, e.g. as described above, in particular with the blend comprising not more than 5% in total e.g. less than 1% of hydrocarbon of bp more than 160° C., and preferably less than 5%, e.g. less than 4% of triptane or 223 trimethyl pentane. Examples of component (a') are described above, but it is preferably an alkylate cut, in particular a cut of 15-100° C.

Part (b) of the invention can provide gasolines e.g. motor or aviation gasoline, in particular of 91, 95, 97, 98 RON values, with desired high Octane Levels but low emission values on combustion in particular of at least one of total hydrocarbons, NOx, carbon monoxide, and carbon dioxide, especially of both total hydrocarbons and carbon dioxide. Thus part (b) of the invention also provides the use of a component (a') (particularly a compound A or $A^1$ e.g. A3, 4, 6 or 9 or an alkylate cut of 15-160° C. e.g. bp15-100° C. especially 15-60° C. or 90-106 in unleaded gasoline e.g. motor or aviation gasoline of MON at least 80 e.g. 80 to less than 98, e.g. as an additive to or component therein, to reduce the emission levels on combustion, especially of at least one of total hydrocarbons, NOx, carbon monoxide and carbon dioxide especially both of total hydrocarbons and carbon dioxide. Part (b) of the invention also provides a method of reducing emissions of exhaust gases in the combustion of unleaded gasoline e.g. motor or aviation gasoline fuels of MON of at least 80 which comprises having at least 10% component (a'), in particular a compound A or $A^1$ e.g. A3, 4, 6 or 9 or an alkylate cut of bp 15-160° C. or 15-100° C. especially 15-60° C. or 90-106° C. present in the fuel which is a gasoline of part (b) of the invention. Part (b) of the invention also provides use of an unleaded gasoline of part (b) of the invention in a spark ignition combustion engine to reduce emissions of exhaust gases. The compositions of part (b) of the invention may be used in supercharged or turbocharged engines, or in normally aspirated ones. The component (a'), preferably a compound A or an alkylate cut of bp 15-160° C. or bp 15-100° C. especially 15-60° C. or 90 to 106° C. can reduce one or more of the above emission levels better than amounts of alkylate or a mixture of aromatics and oxygenate at similar Octane Number and usually decrease the fuel consumption as well.

Automobile exhaust emissions vary very much depending on the vehicle technology and whether the engine is hot or cold, even with engines whose exhaust gases pass through a catalytic converter before reaching the outside environment. In a cold engine, the effects of friction, lubricants and the nature of fuel vapourisation among others, differ from those with a hot engine in an unpredictable way, and it is with cold engines that most tailpipe emissions are produced, because of enriched fuelling and, for those vehicles with catalytic converters, because the catalytic converter becomes increasingly effective at reducing emissions when it becomes hot. For the latter vehicles as well, a Lambda sensor upstream of the converter controls the fuel/air ratio entering the engine, but this is not effective with a cold engine (resulting in an unregulated fuel/air ratio). It is only after the cold start period that the sensor quickly becomes effective, (resulting in a regulated fuel/air ratio), even when the catalyst is not yet hot enough to be effective. Thus cold start operations are different from hot running operations and yet contribute to a large amount of tailpipe emissions. The period of cold start relates to a period of time or distance, which may vary, depending on how the car is driven and/or ambient conditions e.g. up to 2 km or 4 or 2 min, or a temperature at which the engine coolant (e.g. radiator water temperature) is below 50° C. The car engine may also be deemed cold if it has not been operated for the previous 4 hr before start, usually at least 6 hr before start.

Gasolines of part (b) of the invention with component [a'], especially one which is a stream obtained by or obtainable by distillation as a cut of B.Pt. 15-100 C, give reduced emissions on cold start compared to base fuel.

Thus part (b) of the present invention also provides of method of reducing emissions of exhaust gases in the combustion of unleaded gasoline fuels of MON of at least 80 e.g. 80 to less than 98 from cold start of a spark ignition combustion engine, which comprises having a component [a'] present in the fuel which is a gasoline of part (b) of the invention. In the compositions, gasolines, methods and uses of part (b) of the invention the component (a') is preferably used in an emission-reducing effective amount, in particular at cold start.

The gasolines of part (b) of the invention may be used in internal combustion spark ignition engines. They may be used to power moving vehicles on land and/or sea and/or in the air; part (b) of the invention also provides a method of moving such vehicles by combustion of a gasoline of part (b) of the invention. The vehicle usually has a driver and especially means to carry at least one passenger and/or freight.

The engine sizes for motor gasoline use are usually at least 45 cc e.g. 45-10000 cc e.g. at least 200 cc, such as 500-10000 cc, in particular 950-2550, such as 950-1550, or 1250-1850 cc, or 2500-10000 cc such as 2500-5000 or 5000-9000 cc. The engines have at least 1 cylinder, but preferably at least 2 or 3 cylinders, e.g. 3-16, especially 4-6 or 8 cylinders; each cylinder is usually of 45-1250 cc e.g. 200-1200 cc, in particular 240-520 cc or 500-1000 cc. The engines may be 2 stroke engines, but are preferably 4 stroke. Rotary engines e.g. of the Wankel type may be used. The motor engines may be used to power vehicles with at least 2 wheels e.g. 2-4 powered wheels, such as motor bicycles, tricycles, and 3 wheeled cars, vans and motor cars, in particular those vehicles legislated for use on a public highway but also off road e.g. 4 wheeled drive vehicles, sports cars for highway use, and racing cars, including drag racing cars and track racing cars. Power from the engine will preferably be connected to the driving wheels via a gearbox and clutch system, or other form of drive train system, to achieve the transition from a stationary to a mobile state. The engine and drive train will best allow a range of actual vehicle road speed of between 1-350 km/h, preferably between 5-130 km/h and allow for continuous variation of speed thereof. The road speed of the vehicle is usually reduced by a braking mechanism fitted to the vehicle, the braking being generally applied by friction. The engine may either by air or water cooled, the air motion induced by a moving vehicle being used to directly, or indirectly cool the engine. The vehicle comprises a means to facilitate a change of vehicle direction, e.g. a steering wheel or stick. Usually at least 10% of the vehicle distance traveled is carried out at greater than 5 km/h.

The engines using aviation gasoline are usually in piston driven aircraft, i.e. with at least one engine driving a means for mechanically moving air such as at least one propeller. Each engine usually drives at least one propeller driving shaft with 1 or 2 propellers. The aircraft may have 1-10 propellers e.g. 2-4. The aircraft engines usually have at least 2 cylinders, e.g. 2 to 28 cylinders, each of which is preferably greater than 700 cc in volume, such as 700-2000 cc e.g. 1310 cc. The total engine size is usually 3700-50000 cc e.g. 3700 to 12000 cc for single or twin engined passenger light aircraft, 12000 to 45000 cc for 2 or 4 engined freight or airline use (e.g. 15-200 passengers, such as 50 to 150 passengers). The engines may have an engine power to weight ratio of at least 0.3 Hp/lb wt of engine, e.g. 0.3-2 Hp/lb, and may have a power to cylinder volume of at least 0.5 (Hp/cu.in) e.g. 0.5-2. Cylinders may be arranged in rows, V formation, H formation, flat ('horizontally opposed') or radially around a common propeller drive shaft. One or more rows/circles of cylinders may be used, e.g. flat 2, flat 4, flat 6, V12, 2 or 3 circles of 7 cylinders etc. Every cylinder has one and more preferably at least two spark plugs. A gear system may optionally be used to drive the propeller and or a supercharger. Alternatively, an exhaust turbo charger may also be present. Exhaust outlets may be individual or run into a common manifold and preferably point in the opposite direction to forward flight. Fins may be present on the exterior of the engine for air cooling. Greater than 90% of the distance traveled by the engine, when in use, is usually spent at 500 feet or more above ground level. Typically, during greater than 90% of the time when the engine is running, the engine operates at above 1000 rpm e.g. between 1000 to 3500 rpm.

The aircraft usually has at least one tank having a capacity of at least 100 l, especially with a total capacity of at least 1000 l.

The gasolines of part (b) of the invention may be made in a refinery by blending the ingredients to produce at least 200,000 l/day of gasoline such as 1-10 million l/day. The gasoline may be distributed to a plurality of retail outlets for motor gasoline, optionally via wholesale or bulk outlets e.g. holding tanks, such as ones of at least 2 million l capacity e.g. 5-15 million 1. The distribution may be by pipeline or in tanks transported by road, rail or water, the tanks being of at least 5000 l capacity. At the retail sites e.g. filling station, the motor gasoline is dispensed to a plurality of users, i.e. the drivers of the vehicles, e.g. at a rate of at least 100 or 1000 different users per day. For aviation use, the gasoline is usually made in a refinery to produce at least 1000 barrels per day (or 100,000 l/day) such as 0.1-2 million l/day. The avgas is usually distributed by tanker by road, rail or water, or pipelines directly to the airport distribution or holding tanks, e.g. of at least 300,000 l capacity, from whence it is distributed by pipeline or tanker (e.g. a mobile refuelling bowser to fuel a plurality of aircraft, e.g. at least 5/day per tank; the aircraft may have one or more on-board tank each of at least 100 l capacity.

The aviation gasolines of part (b) of the invention comprising component (a') preferably have RVP of 38-49 kPa, 10-40% evaporated at 75° C., at least 50% evaporated at 105° C. at least 90% evaporated at 135° C. and the sum of temperature of 10% evaporated with that of 50% evaporation greater than 135° C.

EXAMPLES OF PART (b)

Part (b) of the present invention is illustrated in the following Examples.

Example 58

An alkylate of IBP 31.9° C. and FBP 191.3° C. was a refinery grade product obtained commercially by HF catalysed reaction of refinery grade isobutene and isobutane. This alkylate was then distilled according to ASTMD2892 to give a series of cuts at the temperatures below in Table 15 with the analyses give in % w/w for their main components (present in at least 1% w/w).

TABLE 15

| | A | B | C | D | E | F | G |
|---|---|---|---|---|---|---|---|
| Temp | 15-60 | 60-80 | 80-90 | 90-95 | 95-100 | 100-103 | 103-106 |
| | H | J | K | L | M | N | |
| Temp | 106-110 | 110-115 | 115-125 | 125-140 | 140-160 | 160-FBP | |

Analyses

A. Butane 9.1, isopentane 74.8, n-pentane 5.9, 2,3-Dimethyl butane 5.6, 2-Methyl pentane 1.8.
B. Isopentane 12.9, n-Pentane 3.8, 2,3-dimethyl pentane 20.7, 2-methyl pentane 7.4, 3-methyl pentane 3.8, 2,4-dimethyl pentane 26.8, Benzene 1, 2,3-dimethyl pentane 12.2, isooctane 8.0.

TABLE 15-continued

C. Isopentane 2.3, 2,3-dimethyl butane 10.4, 2-Methyl pentane 3.8, 3-Methyl pentane 2.1, 2,4-dimethyl pentane 23.4, 2,3-dimethyl pentane 20.4, isooctane 31.5.
D. 2,3-dimethyl butane 3.5, 2-Methyl pentane 1.3, 2,4-dimethyl pentane 16.5, 2,3-dimethyl pentane 19.9, isooctane 51.5.
E. 2,4-dimethyl pentane 7.2, 2,3-dimethyl pentane14.3, isooctane 67.1, 2,5-dimethyl hexane 1.8, 2,4-dimethyl hexane 2.0, 2,3,4-trimethyl pentane 2.1, toluene 1.2, 2,3,3-trimethyl pentane 1.0.
F. 2,4-dimethyl pentane 1.8, 2,3-dimethyl pentane 7.5, isooctane 68.2, 2,5-dimethyl hexane 4.1, 2,4-dimethyl hexane 4.7, 2,3,4-trimethyl pentane 6.0, toluene 1.4, 2,3,3-trimethyl pentane 3.1, high boilers 1.3
G. 2,3-dimethyl pentane 4.5, isooctane 57.8, 2,5-dimethyl hexane 6.0, 2,2,3-trimethyl pentane 1.3, 2,4-dimethyl hexane 7.0, 2,3,4-trimethyl pentane 11.4, toluene 1.3, 2,3,3-trimethyl pentane 6.3, higher boilers 3.0.
H. 2,3-dimethyl pentane 1.3, isooctane 39.5, 2,5-dimethyl hexane 7.9, 2,2,3-trimethyl pentane 1.7, 2,4-dimethyl hexane 9.2, 2,3,4-trimethyl pentane 20.1, toluene 1.1, 2,3,3-trimethyl pentane 12.1, high boilers 6.9.

| | Isoparaffin | n-Paraffins | Aromatics | Others |
|---|---|---|---|---|
| J | 92% $C_8$<br>7% $C_9$ | — | 0.6% $C_7$ | |
| K | 58.8% $C_8$<br>38.8% $C_9$ | — | 1.7% $C_8$ | |
| L | 7.8% $C_8$<br>72.8% $C_9$<br>5.6% $C_{10}$ | —<br>—<br>— | 11.8% $C_8$ | Total 1.9 |
| M | 28.0% $C_9$<br>46.5% $C_{10}$<br>12.4% $C_{11}$ | Total 1.2 | 6.8% $C_8$<br>4.9% $C_9$ | |
| N | 8.0% $C_{10}$<br>37.5% $C_{11}$ | Total 1.2 | 1.2% $C_8$<br>1.6% $C_9$ | Total 49.9% higher boilers > $C_{11}$ |

Examples 59 and 60

A base Fuel was blended from 3.0 parts butane, 22.0 parts full range alkylate (as used as feed in Ex. 58) 40 parts catalytic reformates 10 parts bisomer 75 parts of this base fuel were blended with 25 parts of alkylate cut J to give blend Ex. 59, and also separately with 25 parts of alkylate cut K to give blend Ex. 60, and 25 parts of heavy reformate to give Comp. Blend.

3 Formulated gasolines were made, each containing one of the above blends and a 15 mg/l of a phenolic antioxidant 55% minimum 2,4 dimethyl-6-tertiary butyl phenol 15% minimum 4 methyl-2,6-ditertiary-butyl phenol with the remainder as a mixture of monomethyl and dimethyl-tertiary butyl phenols. The gasolines of Ex. 59 and 60 meet the European 2005 specification without use of oxygenates.

In each case the gasolines were tested for MON and RON, and their Reid Vapour Pressure at 37.8° C. The results are shown in table 16, which also shows these properties for alkylate cuts A-M. The distillation properties of the blend Ex. 59, 60, 3 and comp. Blend were tested according to ASTM D86 and shown in Table 17.

TABLE 16

| | Boiling Point C. | RVP kPa | RON | MON | Cal Val. Btu/lb | Benz % w/w |
|---|---|---|---|---|---|---|
| Comp. Blend | 35-185 | 59.7 | 102.2 | 89.4 | 18339 | 1.86 |
| Blend Ex. 59 | 34-172 | 57.2 | 99.6 | 89 | 18734 | 1.95 |
| Blend Ex. 60 | 32-172 | 57.4 | 99.7 | 88.5 | 18733 | 1.94 |
| Cut A | 15 to 60 | — | 90.8 | 87.8 | 19433 | 0.14 |
| Cut B | 60 to 80 | — | 88.8 | 86.3 | 19088 | 1.07 |
| Cut C | 80 to 90 | — | 91.2 | 89.7 | 19044 | 0.67 |
| Cut D | 90 to 95 | — | 93.5 | 92.6 | 19010 | 0.33 |
| Cut E | 95 to 100 | — | 95.5 | 94.8 | 18968 | 0.08 |

TABLE 16-continued

| | Boiling Point C. | RVP kPa | RON | MON | Cal Val. Btu/lb | Benz % w/w |
|---|---|---|---|---|---|---|
| Cut F | 100 to 103 | — | 95.7 | 94.8 | 18935 | 0.01 |
| Cut G | 103 to 106 | — | 94.9 | 93.6 | 18958 | 0.00 |
| Cut H | 106 to 110 | — | 94.2 | 92.0 | 19010 | 0 |
| Cut J | 110 to 115 | — | 91.8 | 87.8 | 19156 | 0.01 |
| Cut K | 115 to 125 | — | 92.2 | 85.8 | 19157 | 0.01 |
| Cut L | 125 to 140 | — | — | — | 18949 | 0 |
| Cut M | 140 to 160 | — | — | — | 18898 | 0 |
| Cut N | 160 to FBP | — | — | — | 19005 | 0 |

TABLE 17

| | Comp. Blend | Ex. 59 | Ex. 60 | |
|---|---|---|---|---|
| Initial Boiling Point ° C. | 34.7 | 34.2 | 31.6 | deg C. |
| 05% Recovered | 56.4 | 57.9 | 57.1 | deg C. |
| 10% Recovered | 68.6 | 68.7 | 68.6 | deg C. |
| 20% Recovered | 87.4 | 84.4 | 85.1 | deg C. |
| 30% Recovered | 101.8 | 94.7 | 96.0 | deg C. |
| 40% Recovered | 113.8 | 101.5 | 103.5 | deg C. |
| 50% Recovered | 124.9 | 107.1 | 109.3 | deg C. |
| 60% Recovered | 135.5 | 111.6 | 114.1 | deg C. |
| 70% Recovered | 145.1 | 116.1 | 118.8 | deg C. |
| 80% Recovered | 154.5 | 122.1 | 124.8 | deg C. |
| 90% Recovered | 165.0 | 137.8 | 137.5 | deg C. |
| 95% Recovered | 173.9 | 155.4 | 154.2 | deg C. |
| Final Boiling Point ° C. | 185.2 | 171.9 | 171.6 | deg C. |
| Loss % Vol | 2.3 | 1.4 | 1.3 | % vol |
| Recovery % Vol | 96.6 | 97.3 | 97.5 | % vol |
| Residue % Vol | 1.1 | 1.3 | 1.2 | % vol |
| Evaporated Volume @ 70° C. | 12.7 | 11.9 | 11.9 | — |
| Evaporated Volume @ 100° C. | 30.5 | 38.5 | 36.1 | — |
| Evaporated Volume @ 150° C. | 77.1 | 94.9 | 95.2 | — |
| RVP kPa | — | 57.2 | 57.4 | — |
| Density kg/l | — | 0.7415 | 0.7423 | |

Example 61

The emission characteristics on combustion of the formulated gasolines of comp. Blend, Ex. 59 and 60, and the cuts A-N were compared.

The fuels were tested in a single cylinder research engine at a speed/load of 50/14.3 rps/Nm with a LAMBDA setting of 1.01, and the ignition setting was optimized for the comparative blend. The emissions of CO, $CO_2$, total hydrocarbons, Nox, were measured from the exhaust gases. The results were averaged. The results were as follows as shown in Table 18 expressed as the change in emissions compared to comp. Blend and in addition the percentage gravimetric change in the Fuel Consumption.

TABLE 18

| Ex. | CO | $CO_2$ | THC | Nox | Consumption |
|---|---|---|---|---|---|
| Comp | 0.0% | 0.0% | 0.0% | 0.0% | 0.0% |
| 59 | −3.1% | −4.1% | −4.0% | −3.7% | −2.3% |
| 60 | −3.0% | −3.1% | −3.1% | −2.5% | −2.1% |
| A | −38.6% | −10.8% | −33.1% | −11.3% | −7.2% |
| B | −31.4% | −9.1% | −17.7% | −14.5% | −6.1% |
| C | −21.9% | −9.7% | −10.5% | −18.2% | −5.7% |
| D | −18.4% | −8.9% | −8.1% | −19.3% | −5.3% |
| E | −9.4% | −9.2% | −4.0% | −22.1% | −4.9% |
| F | −4.1% | −9.3% | −1.7% | −22.2% | −4.8% |
| G | −5.1% | −9.7% | 0.6% | −20.7% | −5.5% |
| H | 2.0% | −9.3% | 0.9% | −18.7% | −5.0% |
| J | −3.0% | −9.0% | −5.0% | −18.0% | −5.4% |

TABLE 18-continued

| Ex. | CO | $CO_2$ | THC | Nox | Consumption |
|---|---|---|---|---|---|
| K | −3.2% | −9.2% | 1.4% | −16.7% | −5.5% |
| L | 0.2% | −6.1% | 3.0% | −15.0% | −3.6% |
| M | −3.5% | −7.2% | 3.1% | −18.5% | −4.2% |
| N | −1.3% | −4.8% | 43.7% | −18.2% | −1.9% |

As the research engines were not fitted with catalysts in their exhausts, the reductions in emissions provide an indication of the benefits of reduced emissions downstream of the exhaust catalyst before any exhaust catalyst has heated up and became operable; this corresponds to cold start condition.

Examples 62 and 63

Blends are made in the manner of Ex. 59 and 60 from the base Fuel (75 parts) and cut A (25 parts) to give Ex. 62 and separately with combined cuts B-E (25 parts) to give Ex. 63. Formulated gasolines are made as in Ex. 59 and 60. They give reduced emissions compared to the Comp. Blend.

Example 64

A blend is made up with the following ingredients, steam cracked spirit 32.0%, full range alkylate (as the feed to Ex. 58) 30%, cut A-E 10%, Reformate 11.0%, toluene 16.0%, butane 1.0%. A formulated gasoline also contains 15 mg/l of the antioxidant of Ex. 59/60. The properties of the fuel are as follows in Table 19

TABLE 19

| | |
|---|---|
| RON | 99.8 |
| MON | 87.9 |
| Cal Val. Btu/lb | 18616 |
| S ppm | 7.3 |
| RVP kPa | 56.8 |
| Benz % w/w | 0.75 |
| E 70° C. | 18.9 |
| E 100° C. | 50.0 |
| E 150° C. | 93.5 |
| E 180° C. | 98.0 |
| Aromatics | 34.2 |
| Olefins | 8.2 |
| Saturates | 57.6 |
| Oxygenates | 0.0 |

This gasoline also gives reduced emissions.

Examples 65-68 and Comparative Ex. K

Various unleaded blends were made up with each of compounds A4, A6, A9, 225 trimethyl hexane in each case blended with various refinery streams as shown in Table 19, as well as Comp Ex. K with heavy reformate.

6 formulated gasolines were made, each containing one of the above blends and 15 mg/l of the phenolic antioxidant used in Ex. 59-60.

In each case the gasolines were tested for MON and RON, and their Reid Vapour Pressure at 37.8° C. The results are shown in table 19, which also shows their analyses and distillation profile (according to ASTM D86).

The emission characteristics on combustion of the formulated gasolines of Ex. 65-68 and Comp. K were determined.

The fuels were tested as in Ex. 61 in a single cylinder research engine at a speed/load of 20/7/2 rps/Nm with LAMBDA setting of 1.01, and the ignition setting was optimised for the comparative blend K. The emissions of CO, $CO_2$ total carbon oxides, total hydrocarbons, $No_x$ were measured from the exhaust gases as was the Fuel Consumption (expressed in $g/h^1Whr$). The results were averaged and compared to the comparative Ex. K. The degrees of change were as given in Table 20.

TABLE 19

| Formulation % v/v | Comp K Base Fuel | 65 | 66 | 67 | 68 |
|---|---|---|---|---|---|
| Butane | 3 | 3 | 3 | 3 | 3 |
| Full range catalytically cracked spirit | 20 | 20 | 20 | 20 | 20 |
| Alkylate | 40 | 40 | 40 | 40 | 40 |
| Light hydrocracked spirit | 7 | 7 | 7 | 7 | 7 |
| Full range steam cracked spirit | 10 | 10 | 10 | 10 | 10 |
| Heavy reformate | 20 | | | | |
| 2,2,5-Trimethylhexane (A17) | | 20 | | | |
| 2,2,4-Trimethylpentane (A4) | | | 20 | | |
| 2,3,3-Trimethylpentane (A6) | | | | 20 | |
| 2,3,4-Trimethylpentane (A9) | | | | | 20 |
| Density kg/l | 0.7487 | 0.7159 | 0.7122 | 0.7192 | 0.7176 |
| C:H | 1:1.889 | 1:2.085 | 1:2.090 | 1:2.091 | 1:2.091 |
| C % w/w | 86.4 | 85.2 | 85.17 | 85.16 | 85.16 |
| H % w/w | 13.6 | 14.8 | 14.83 | 14.84 | 14.84 |
| RON | 97.0 | | 96.6 | 97.8 | 97.1 |
| MON | 86.3 | | 87.0 | 86.9 | 86.2 |
| RVP kPa | 54.7 | | 57.1 | 56.1 | 56.1 |
| T10% C. | 52.9 | | 56.3 | 57.2 | 57.2 |
| T50% C. | 107.0 | | 93.6 | 97.7 | 97.4 |
| T90% C. | 166.1 | | 146.3 | 146.3 | 146.3 |
| Benzene % v/v | 0.6 | 0.6 | 0.6 | 0.6 | 0.6 |
| Aromatics % v/v | 29.4 | 9.4 | 9.4 | 9.4 | 9.4 |
| Olefins % v/v | 9.0 | 9.0 | 9.0 | 9.0 | 9.0 |

| Example | CO | CO2 | COx | THC | NOx | Fuel Economy |
|---|---|---|---|---|---|---|
| Comp K | 0% | 0.0% | 0.0% | 0.0% | 0.0% | 0.0% |
| 67 | 11.8% | −2.8% | −2.4% | −13.0% | −7.7% | −1.4% |
| 68 | 14.0% | −3.0% | −2.6% | −15.4% | −4.1% | −1.5% |
| 65 | 21.9% | −2.8% | −2.2% | −9.0% | −4.6% | 1.3% |
| 66 | 14.0% | −4.4% | −4.0% | −14.4% | −4.8% | −1.8% |

Figures denote % change relative to base (Fuel (Comp. K)

Examples 69-80

Blends were made up from the following ingredients, butane, full boiling range alkylate (as used in the feed in Ex. 58) catalytic reformate, light hydrocrackate full boiling range steam cracked spirit, naphtha, straight run gasoline full range catalytically cracked spirit and 2,2,4 trimethyl pentane. In addition most of the blends contained one or more alkylate cuts as described in Ex. 59 and 60. The analyses of the blends and their properties were as shown in Table 21.

TABLE 21

| | EXAMPLE | | | | | |
|---|---|---|---|---|---|---|
| | 69 | 70 | 71 | 72 | 73 | 74 |
| Butane | 0.99 | 1.87 | 4.09 | 2.68 | 5.37 | 5.66 |
| Full range alkylate | 20 | 20 | 9.35 | 10 | 10 | 10 |
| Catalytic reformate | 16.72 | 4.5 | 12.83 | 17.44 | 21.16 | 15.38 |
| Light hydrocrackate | | | | | | |
| Full range stream cracked spirit | 47.69 | 53.63 | 35.1 | 42.52 | 16.05 | 20 |
| Naphtha | | | | | 3.39 | 0.76 |
| Straight run gasoline | | | | | | 0.97 |
| Full range catalytically cracked spirit | | | | | | 2.93 |
| 224 Trimethylpentane | 14.6 | 20 | | | 1.26 | |
| Alkylate cut 15 to 60° C. | | | | | | |
| Alkylate cut 60 to 80° C. | | | | | | |
| Alkylate cut 80 to 90° C. | | | | | | |
| Alkylate cut 90 to 95° C. | | | 38.63 | | | |
| Alkylate cut 95 to 100° C. | | | | 27.36 | | |
| Alkylate cut 100 to 103° C. | | | | | 42.77 | |
| Alkylate cut 103 to 106° C. | | | | | | 44.3 |
| Alkylate cut 106 to 110° C. | | | | | | |
| Alkylate cut 110 to 115° C. | | | | | | |
| Alkylate cut 115 to 125° C. | | | | | | |
| Properties | | | | | | |
| RON | 99.2 | 99.1 | 98 | 98.8 | 98 | 98 |
| MON | 87 | 87 | 87 | 87 | 88.4 | 87.9 |
| RVP kPa | 60 | 60 | 60 | 60 | 60 | 60 |
| Evap @ 70° C. % v/v | 30.2 | 32.4 | 28.7 | 28.2 | 16.5 | 16.3 |
| Evap @ 100° C. % v/v | 52.5 | 56.5 | 60 | 54.4 | 49 | 49 |
| Evap @ 150° C. % v/v | 93.7 | 94.8 | 98.5 | 96.3 | 100 | 99.8 |
| Evap @ 180° C. % v/v | 97.9 | 98 | 98.6 | 98.2 | 100 | 99.8 |

TABLE 21-continued

| | | | | | | |
|---|---|---|---|---|---|---|
| Density kg/l | 0.7404 | 0.7301 | 0.7254 | 0.7376 | 0.726 | 0.7236 |
| Benzene % vv | 1 | 0.51 | 0.76 | 1 | 1 | 0.78 |
| Aromatics % vv | 27.8 | 22.2 | 20.8 | 26.4 | 19.9 | 17.9 |
| Olefins % vv | 12.4 | 13.9 | 9.1 | 11.1 | 4.7 | 6.4 |

| | EXAMPLE | | | | | |
|---|---|---|---|---|---|---|
| | 75 | 76 | 77 | 78 | 79 | 80 |
| Butane | 4.56 | 3.03 | 4.06 | 1.13 | | |
| Full range alkylate | 17.54 | 22.35 | 19.93 | | 1.76 | 5.29 |
| Catalytic reformate | 8.51 | 17.18 | 12.17 | 18.06 | 21.03 | 1.81 |
| Light hydrocrackate | | | | | | 19.75 |
| Full range stream cracked spirit | 32.85 | 30.29 | 29.8 | 38.12 | 17 | 26.15 |
| Naphtha | | | | | 0.79 | |
| Straight run gasoline | | | | | | |
| Full range catalytically cracked spirit | | | | | 2.98 | |
| 224 Trimethylpentane | | | | | | |
| Alkylate cut 15 to 60° C. | | | | 5 | 12.34 | |
| Alkylate cut 60 to 80° C. | | | | 5 | 5 | |
| Alkylate cut 80 to 90° C. | | | | | | |
| Alkylate cut 90 to 95° C. | | 5 | 5 | | | 32 |
| Alkylate cut 95 to 100° C. | | 5 | 5 | 32.69 | 39.1 | |
| Alkylate cut 100 to 103° C. | | 5 | 9.04 | | | |
| Alkylate cut 103 to 106° C. | 3.44 | 2.15 | 5 | | | |
| Alkylate cut 106 to 110° C. | 33.1 | | | | | |
| Alkylate cut 110 to 115° C. | | 10 | | | | 15 |
| Alkylate cut 115 to 125° C. | | | 10 | | | |
| Properties | | | | | | |
| RON | 98 | 98 | 98 | 98.7 | 98 | 98 |
| MON | 87 | 87 | 87 | 87 | 87.9 | 87 |
| RVP kPa | 60 | 60 | 60 | 60 | 60 | 60 |
| Evap @ 70° C. % v/v | 20.5 | 22.6 | 21.4 | 30.4 | 27.8 | 22.1 |
| Evap @ 100° C. % v/v | 49 | 49 | 49 | 59.3 | 59.4 | 54.4 |
| Evap @ 150° C. % v/v | 98.4 | 96.4 | 97.3 | 98 | 100 | 99.7 |
| Evap @ 180° C. % v/v | 100 | 99.2 | 99.7 | 98.5 | 100 | 99.8 |
| Density kg/l | 0.725 | 0.731 | 0.7253 | 0.7334 | 0.7219 | 0.7295 |
| Benzene % vv | 0.56 | 0.92 | 0.7 | 1 | 1 | 1 |
| Aromatics % vv | 17.2 | 21.8 | 18.5 | 25.2 | 20.3 | 22 |
| Olefins % vv | 8.5 | 7.9 | 7.7 | 9.9 | 5.6 | 6.8 |

The blends give reduced emissions on combustion.

Examples 81-85

Blends were made up from the following ingredients, butane, full boiling range alkylate (as used in the feed in Ex. 58) catalytic reformate, full boiling range steam cracked spirit, naphtha. In addition the blends contained two or more alkylate cuts as described in Ex. 59 and 60. The analyses of the blends and the properties were as shown in Table 22.

TABLE 22

| | Example | | | | |
|---|---|---|---|---|---|
| | 81 | 82 | 83 | 84 | 85 |
| Butane | | 0.14 | 1.76 | | |
| Full range alkylate | 37.7 | 28.47 | 17.19 | 23.81 | |
| Catalytic reformate | 11.12 | 12.64 | 19.4 | 8.97 | 2.03 |
| Full range stream cracked spirit | 23.57 | 28.75 | 28.59 | 24.17 | 44.56 |
| Naphtha | | | | 13.05 | 13.41 |
| Alkylate cut 15 to 60 C. | 5 | 5 | | | 5 |
| Alkylate cut 60 to 80 C. | 5 | 5 | 5 | 5 | 5 |
| Alkylate cut 80 to 90 C. | | | 10 | 10 | 10 |
| Alkylate cut 90 to 95 C. | | | | | |
| Alkylate cut 95 to 100 C. | | | | | |
| Alkylate cut 100 to 103 C. | | | | | |
| Alkylate cut 103 to 106 C. | | | | | |
| Alkylate cut 106 to 110 C. | | | | | |
| Alkylate cut 110 to 115 C. | 17.61 | 15 | 3.06 | | 5 |
| Alkylate cut 115 to 125 C. | | 5 | 15 | 15 | 15 |

TABLE 22-continued

| | Example | | | | |
|---|---|---|---|---|---|
| | 81 | 82 | 83 | 84 | 85 |
| Properties | | | | | |
| RON | 96.7 | 96.9 | 97.3 | 93 | 93 |
| MON | 86.3 | 85.8 | 85.7 | 83 | 81.2 |
| RVP kPa | 60 | 60 | 60 | 52.8 | 56.8 |
| Evap @ 70 C. % v/v | 24.1 | 24.9 | 22.9 | 20.9 | 30.2 |
| Evap @ 100 C. % v/v | 49 | 49 | 49 | 49 | 56.5 |
| Evap @ 150 C. % v/v | 95.5 | 95.2 | 95.3 | 95.1 | 95.3 |
| Evap @ 180 C. % v/v | 99.5 | 100 | 100 | 100 | 100 |
| Density kg/l | 0.72 | 0.7257 | 0.7336 | 0.7254 | 0.7293 |
| Benzene % vv | 0.62 | 0.71 | 1 | 0.53 | 0.35 |
| Aromatics % vv | 15.6 | 18.4 | 22.6 | 15.6 | 18.6 |
| Olefins % vv | 6.1 | 7.5 | 7.5 | 6.3 | 11.5 |

The blends give reduced emissions on combustion.

Part (c)

Unleaded gasolines have been discovered having high Octane Number but producing low emissions on combustion.

Part (c) of the present invention provides an unleaded blend composition having a Motor Octane Number (MON) of at least 81 or 85 and Research Octane Number (RON) of at least 91 or 94 which comprises component (a") a total of at least 10% or 15% by volume of the blend composition of at least one branched chain hydrocarbon, which is an alkane of 8-12 carbon atoms with at least 4 methyl or ethyl branches (hereinafter called a compound (A") there being a minimum of at least 1, 2, 5 or 10% by volume (of the blend composition), of at least one individual compound (A") and component (b") at least one liquid hydrocarbon or mixture thereof of bp60-160° C. having a MON value of at least 60 preferably at least 70 and RON value of at least 70 preferably at least 80 and especially at least 90, the total amount of component (b") being at least 20%, with the preferred proviso that the blend composition contains less than 5% of 223 trimethyl pentane, and especially less than 1 or 0.5%, and especially less than 0.5%, in total of 223 trimethyl butane and 223 trimethyl pentane.

In another aspect part (c) of the present invention provides an unleaded blend composition of MON value of at least 81 or 85 and RON value of at least 91 or 94 which comprises component (a") as defined above and as component (b") at least 20% in total of one or more refinery streams, such that the blend composition contains in total at least 70% of saturated hydrocarbons.

Unless otherwise stated all percentages in this specification are by volume, and disclosures of a number of ranges of amounts in the composition or gasoline for 2 or more ingredients includes disclosures of all sub-combinations of all the ranges with all the ingredients.

The compounds A" are alkanes of 8-12 carbon atoms (especially 8 or 10 carbons) with at least 4 methyl and/or ethyl branches, e.g. 4-6 branches, preferably 4 or 5 or especially 4 branches. Methyl branches are preferred. The compounds usually have their longest chain of carbon atoms, hereinafter called their backbone chain, with 4-7 e.g. 4-6 chain carbon atoms (especially 4 or 5) to which the methyl, and/or ethyl branches are attached. Advantageously, especially in relation to the first to tenth groupings as described further below, there are no branched groups constituting the branches other than methyl or ethyl, and, in the backbone chain of carbon atoms, there are especially no linear alkyl groups of more than 2 carbons nor 1,2 ethylene or 1,3 propylene groups in the chain, and especially no methylene groups in the chain except as part of an ethyl group; thus there are especially no n-propyl or n-butyl groups forming part of the backbone chain. Preferably there is at least one compound (A") alkane of 9-12 e.g. 9 or 10 carbons, and in this case there is usually less than 50% or 10% of an 8 carbon alkane compound e.g. with 3 methyl branches.

The compounds can have 1 or 2 methyl or ethyl groups attached to the same carbon atom of the backbone chain, especially 1 or 2 methyl groups and 0 or 1 ethyl groups. The carbon atom in the backbone at which the branching occurs is non-terminal i.e. is an internal carbon in the backbone chain, especially the 2, 3 and/or 4 numbered carbon in the backbone. Thus advantageously the compound has geminal methyl substituents on position 2, 3 or 4 carbon atoms, especially position 2, but in particular position 3.

In a first grouping of compounds A", there is at least one pair of geminal methyl branch substituents, and they are on position 2, or there are 2 or 3 pairs of geminal branches at least 2 pairs being on vicinal (ie adjacent) carbon atoms, as in a group —$CMe_2$-$CMe_2$-.

In a second grouping of the compounds A" there are 1, 2 or 3 pairs of geminal methyl branch substituents on a 4-6 carbon chain backbone, and, if any Ethyl $CMe_2$-structure is present, then there are 2 Ethyl $CMe_2$ groups in the compound. The compounds of the second grouping advantageously have a MON value of at least 100.

In a third grouping of the compounds, there is one geminal methyl branch grouping i.e. —$CMe_2$- on the backbone, while on one or both of the adjacent carbon atoms of the backbone, there is/are one or two methyl or ethyl branches/especially 1 or 2 methyl branches.

In a fourth grouping of the compounds there are one, two or three pairs of geminal methyl branches. If there are 2 or 3 pairs then at least 2 pairs are on adjacent backbone carbon atoms, and if there is only one pair, then they are preferably on the 2 position backbone carbon and there is a methyl branch at least on the 3 position backbone carbon. Such compounds usually have a RON value of at least 111. Advantageously the compounds are of 8 or 10 carbon atoms.

In a fifth grouping the compound A" has 2 or 3 pairs of geminal methyl branches at least 2 pairs being on adjacent backbone carbon atoms, and the compound has a symmetrical structure. Such compounds usually have RON value of at least 120, and especially are of 8 or 10 carbon atoms.

In a sixth grouping the compounds have a linear backbone chain of 4 or 6 carbons and have 4-6 e.g. 4, 5 or 6 especially 4 methyl branches, in at least one geminal group ($CMe_2$) especially in the absence of a 1,2 ethyl group in the backbone.

In a seventh grouping, the compounds have a linear backbone chain of 5 or 6 carbons and have 4-6 e.g. 4, 5 or 6 especially 4 branches in at least one geminal group, with the proviso that if there are 4 methyl branches and the compound contains an Ethyl $CMe_2$ group, then the compound contains two such Ethyl $CMe_2$ groups. Such compounds are usually liquid at 25° C. and generally have a RON value of greater than 105. Especially there are only methyl branches; such compounds usually have a MON value of at least 101.

Advantageously in an eighth grouping the compounds A" contain 1, 2 or 3 carbon atoms with geminal methyl branches, and if there is only one such carbon atom with geminal branches, then there is/are one or two branches on a vicinal carbon atom to the geminal one, and any ethyl —C— chain group in the backbone chain has 5 carbon atoms i.e. is $(Ethyl)_2CH$ or Ethyl $CMe_2$-. Especially there are 2 or 3 vicinal carbon atoms in the backbone, each carrying 2 methyl branches.

A particularly preferred sub-class (ninth grouping) for the compound A" is alkanes with alkyl substituents on vicinal internal carbon atoms, with a total of 4, 5 or 6 carbon atoms in said substituents.

Among this sub-class are preferred ones especially with geminal methyl groups on internal chain carbon atoms. Particularly preferred sub-class compounds A have 4 or 5 methyl substituents on the carbon backbone, especially with at least 2 on the same backbone carbon atom (in particular in two —$CMe_2$- groups) especially in a —$CMe_2$-$CMe_2$ group.

In another aspect of part (c) of the invention there is provided an unleaded blend composition having a MON value of at least 81 or 85 and RON value of at least 91 or 94, which comprises component (a") a total of at least 10 or 15% of one or more branched alkane compounds A'" of 8-12 carbons (especially with 4-7 or 4-6 backbone carbon atoms), with at least 4 methyl or ethyl branches and with at least 2 backbone carbon atoms which are secondary and/or tertiary carbon atoms, with the proviso that if there are only 2 such carbon atoms, then both are tertiary, there being a minimum of at least 1, 2, 5 or 10% (by volume of the composition) of at least one individual compound A'", and component (b") of nature and in amount as described herein, with the preferred proviso as described above. In the above component A'", which may be the same or different from A", there may thus in a tenth grouping be in the backbone internal (i.e. non-terminal) carbon atoms which are (i) 2 or 3 tertiary carbons, (ii) especially vicinal ones, or (iii) 2 tertiary and one sec. carbon or (iv) 2 tertiary and one or 2 primary carbon, or (iv) 1 or 2 tertiary and 1 or 2 sec subject to at least 4 branches, in particular (vi) with the tert and a sec. carbon vicinal and (vii) when there are 2 tert, these are vicinal or non-vicinal and (viii) with 1 or 2 vicinal tert and sec. carbons subject to at least 4 branches. The compounds A'" usually are free from 2 primary internal backbone carbon atoms on vicinal carbons i.e. as in 1,2-ethylene group. Preferably any primary internal backbone carbon atoms are not between, e.g. adjacent on both sides to, a tert and/or sec, carbon on the one hand and a tert and/or sec. carbon on the other hand. Especially at least the said 2 backbone carbon atoms above in compounds A'" are vicinal.

In another category, the eleventh grouping is of compounds A'" which contain, with the proviso of at least 4 branched groups, (i) as at least one end of the backbone a group of formula $CHR^1R^2$ where each of $R^1$ and $R^2$, which are the same or different is a methyl or ethyl group or (ii) as at least one end of the backbone a group of formula $CR^1R^2R^3$ where $R^1$ and $R^2$ are as defined above and $R^3$ is methyl or ethyl. Preferred are such compounds A'" which have both (i) and (ii), especially when the $CHR^1R^2$ group is $CHMe_2$ when the compound has 8 carbons or a backbone of 5 carbons and when all internal carbon atoms in the backbone chain are secondary or tertiary.

The compounds A" or A'" may have a boiling point at 1 bar pressure of 150-175° C., 130-140° C., 110-129° C., or 90-109° C. In particular the boiling point is preferably at least 105° C. e.g. 105-175° C., with the preferred proviso that it is at least 112° C. such as 112-175° C. unless the compound A" or A'" has 4 alkyl branches.

In another category the compounds A" or A'" may have 4-6 methyl and/or ethyl branches on a 4-7 or 4-6 carbon backbone, and especially a ratio of carbon atom in branches to carbon atoms in the backbone chain of at least 0.63:1 e.g. 0.63-1.6:1 such as 0.63-1.0:1. The compounds usually have 9 or 10 carbons, unless the above ratio is at least 0.63, 0.75 or 0.9.

Preferred compounds are 3344 tetramethyl hexane (A1), 2233 tetramethyl butane (A2), 2233 tetramethyl pentane (A7), 22334 pentamethyl pentane (A12) 22344 pentamethyl pentane (A13) 2334 tetramethyl pentane (A14) 2234 tetramethyl pentane (A15) 223344 hexamethyl pentane (A16) 22446 pentamethyl heptane. Of these (A1) and (A2) are most preferred with (A7) being also very valuable.

The compounds A" and A'" are either known compounds and may be made according to the published literature, or are novel and may be made by conventional methods known per se in the literature (e.g. as described in Kirk Othmer Encyclopaedia of Chemical Technology 3rd Ed. Publ. Wiley). Examples of suitable methods of preparation are known carbon-carbon coupling techniques for making alkanes. The technique may involve reactions of one or more usually 1 or 2 alkyl chlorides, bromides or iodides with an elemental metal of Group IA, IIA, IB or IIB of the Periodic Table in Advanced Inorganic Chemistry by F. A. Cotton+G. wilkinson, Pub. Interscience New York 2nd Ed. 1966, especially sodium, magnesium, or zinc. The alkyl halide is usually a branched chain one of 3-6 carbons, in particular with methyl or ethyl branches, and especially with the halogen atom attached to a $CMe_2$ group in at least one of the alkyl halides. Preferably the halide is of formula $MeCMe_2X$ or $EtCMe_2X$, where X is Cl, B or I, and the other halide, if any, is a tertiary alkyl halide or a secondary one e.g. of formula $RR^1CHX$, wherein at least one of R and $R^1$ is a branched alkyl group e.g. of 3-5 carbons such as isopropyl or t-butyl, and the other (if any) is methyl or ethyl or a primary branched alkyl halide e.g. of formula $R^{11}CH_2X$, where $R^{11}$ is a branched alkyl group 4-5 carbons with methyl or ethyl branches, such as isobutyl or isoamyl. Alternatively both halides can be secondary e.g. of formula $RR^1CHX$, as defined above and $R^{111}R^{IV}CHX$ where $R^{111}$ is methyl or ethyl and $R^{IV}$ is as defined for R, such as isopropyl or one can be secondary (as above) and one can be primary e.g. methyl or ethyl halide. The methods of coupling optimum for any particular compound A or $A^1$ depend on availability of the precursor alkyl halide(s) so that in addition to the above kinds, coupling via methyl or ethyl halides with branched alkyl halides of 6-9 carbons may also be used e.g. pentamethyl ethyl bromide and methyl magnesium bromide to form A2. The alkyl halide(s) can react together in the presence of the metal (as in a Wurtz reaction with sodium), or one can react first with the metal to form an organometallic compound e.g. a Grignard reagent or organo zinc, followed by reaction of the organometallic with the other alkyl halide. If desired the Grignard reagent reaction can be in the presence of a metal of Group IB or IIB, such as silver, zinc or copper (especially high activity copper). If desired the Grignard reagent from one or both alkyl halides can be reacted with the latter metal to form other alkyl metallic species e.g. alkyl silver or alkyl copper compounds, which can disproportionate to the coupled alkane. The Grignard reagent(s) can also react with a cuprous halide to form alkyl copper species for disproportionation. Finally an organometallic compound, wherein the metal is of Group IA or IIA e.g. Li or Mg can be coupled by reaction with a cuprous complex to give a coupled alkane. Use of only 1 alkyl halide gives a symmetrical alkane, while use of a mixture of alkyl halides gives a mixture of alkanes, usually each of the symmetrical dimers and an unsymmetrical alkane formed from both alkyl halides.

The above organometallic reactions are usually conducted under inert conditions, i.e. anhydrous and in the absence of oxygen e.g. under dry nitrogen. They are usually performed in an inert solvent e.g. a dry hydrocarbon or ether. At the end of the reaction any residual organometallic material is decomposed by addition of a compound with active hydrogen e.g. water or an alcohol, and the alkanes are distilled off, either directly or after distribution between an organic and aqueous phase.

Examples of the above processes are the coupling of tert-butyl chloride in the presence of Mg and diethyl ether to form compound A(2) (as described by D. T. Flood et al, J. Amer Chem. Soc. 56, (1934) 1211, or R. E. Marker et al, J. Amer Chem. Soc. 60, (1938) 2598 or F. C. Whiteman et al, J. Amer Chem. Soc. 55, (1933) 380), and the corresponding coupling of $EtCMe_2$ halides to form compound A1. Other preparations of highly branched alkanes are described in M Tamura and J. Kochi, J. Amer. Chem. Soc. Vol. 93, Part 6 (Mar. 24, 1971) and F. O. Ginah et al, J. Org. Chem. Vol. 199, 55 pp 584-589 and R. Y. Levina & V. K. Daukshas, Zhur. Obschei Khim. Vol. 29 (1959) and F L Howard et al, J Res. Nat. Bur. Standards Research Paper RP1779, Vol 38 Mar. 1947 pp 365-395. The disclosures of these documents is incorporated herein by reference.

The crude alkanes made by the above processes, especially the symmetrical ones, may be used as such in the blends of part (c) of the invention or may be purified further e.g. by distillation first. The crude unsymmetrical alkanes may be also purified, but are preferably used as such as the by-product alkanes are often useful hydrocarbons for the blend, e.g. coupling of t BuX and $EtCMe_2$× as described above produces a mixture of alkanes containing A1, A2 and A7.

Other known methods of making the alkanes A" or A'", are reaction of alkyl metallic compounds e.g. Grignard reagents with carbonyl compounds such as aldehydes, ketones, esters, or anhydrides to form branched chain carbinols, which are dehydrated to the corresponding olefin, which is hydrogenated to the alkane. Thus 2,2,3,4-tetra methyl pentane may be made from isopropyl magnesium bromide and methyl t-butyl ketone (followed by dehydration and hydrogenation), Thus part (c) of the present invention produces an unleaded blend composition of MON value at least 81 or 85 and RON value at least 91 or 94 which comprises (a") a total of at least 10 or 15% of one or more branched hydrocarbon compound A" or A'" there being a minimum of at least 1, 2 or 5% of at least one individual compound A" or A'" and (b") at least 20% of at least one different liquid hydrocarbon of bp60-160° C. having a MON value of at least 70 and RON value at least 90 especially when (b") is not within the definition of A" or A'". Examples of the liquid hydrocarbons are paraffins, such as linear or branched chain alkanes of 4-8 carbons, such as isobutane, butane, isopentane, dimethyl alkanes such as 23 dimethyl butane, cycloalkanes, such as cyclopentane and cyclohexane, aromatics and olefins.

Another unleaded blend composition of part (c) of the invention of MON value of at least 81 or 85 and RON value of at least 91 or 94 comprises component (a") as above and component (b") at least 20% of at least one of a straight run naphtha, alkylate isomerate (bp25-80° C.) heavy reformate, light reformate (bp20-79° C.), hydrocrackate, aviation alkylate (bp30-190° C.), straight run gasoline, cracked spirit, such as heavy or light catalytic cracked spirit or steam cracked spirit. The straight run products are produced directly from crude oil by atmospheric distillation. The naphtha may be light naphtha of bp30-90° C. or medium naphtha of bp90-150° or heavy naphtha of bp150-220° C.

In the blends of part (c) of the invention, the amount of at least one individual compounds A" or A'" is usually at least 1, 2 or 5%, or at least 10 or 15%, such as 5-60%, e.g. 15-60%, or 8-25%, 20-35% or 30-55% or 2-10%. The amount of 2,2,4-trimethyl pentane if present is usually at least 10% of the composition. Total amounts of trimethyl pentanes in the blend are preferable less than 69% of the blend, but advantageously at least 26% (especially when the amount of aromatics is less than 17%). If a 9 or 10 carbon alkane is (a"), then the amount of 2,2,4-trimethyl pentane is especially less than 70 or 50%. More than one such compound A" or A'" may be present e.g. of higher and lower RON in weight ratios of 9:1 to 0.5:99.5, such as 0.5:1 to 5:1 or 5:95 to 20:80, particularly for mixtures of compounds A1 and A2 and/or with higher or lower boiling points (atmospheric pressure) e.g. those in which the compounds A" and/or A'" have boiling points differing by at least 10° C. e.g. at least 40° C. such as 10-70° C. or 20-50° C. the relative amounts being as described above. In the blends amounts of compounds A" or A'" of RON at least 138 e.g. A1 may be 1-40%, such as 2-10 or 20-35%, while those of compounds A" or A'" of RON 120-138 e.g. A2 may be 1-60, such as 5-60, 8-25 or 30-55% (especially when used with the higher RON compound) or 15-50% when used as sole compound A". Total amounts of all compounds A" and A'" (if any) in the blend are at least 10 or 15% such as 15-70 e.g. 15-60, 15-40 or 30-55% or 40-60% or 10-35%.

The blend may also comprise predominantly aliphatic refinery streams which are usually liquid e.g. at 20° C. such as naphtha, straight run gasoline (also known as light naphtha bp 25-120° C.), alkylate and isomerate. Amounts in total of these may be 10-70%, such as 10-30, 30-70 or 35-65%. Amounts of naphtha may be 0-70% or 1-70% such as 10-30, 30-70 or 35-65%, while amounts of light naphtha may be 0 or 1-70 such as 1-20 or especially 30-65%, and amounts of medium naphtha may be 0 or 1-55, such as 3-20 or 15-55%. The volume ratio of light to medium naphtha may be 50:1 to 1:50, such as 0.5-20:1 or 1:0.5-50. Amounts of alkylate or isomerate (if present) may be 0.5-20% such as 1-10%, while amounts of hydrocrackate may be 0.5-30% e.g. 10-30%. A preferred blend comprises 20-60% compound A" or A'" and conversely 80-40% straight run gasoline, the sum of these being substantially 100%.

The blends of part (c) of the invention usually contain in total at least 70% of saturates, such as 70-98% or 70-90% or 90-98%.

If desired and especially for aviation gasoline, the blends may contain a hydrocarbon component which is a saturated aliphatic hydrocarbon of 4-6 carbons and which has a boiling point of less than 80° C. under atmospheric pressure, such as 20-50° C., and especially is itself of Motor Octane Number greater than 88 in particular at least 90 e.g. 88-93 or 90-92. Examples of the hydrocarbon component include alkanes of 4 or 5 carbons in particular iso-pentane, which may be substantially pure or crude hydrocarbon fraction from reformate or isomerate containing at least 30% e.g. 30-80% such as 50-70%, the main contaminant being up to 40% mono methyl pentanes and up to 50% dimethyl butanes. The hydrocarbon component may be an alkane of boiling point (at atmospheric pressure) −20° C. to +20° C. e.g. n and/or iso butane optionally in blends with the $C_5$ alkane of 99.5:0.5 to 0.5:99.5, e.g. 88:12 to 75:25. n Butane alone or mixed with isopentane is preferred, especially in the above proportions, and in particular with a volume amount of butane in the composition of up to 20% such as 1-15% e.g. 1-8, 3-8 or 8-15%, especially 1-3.5%.

The hydrocarbon component boiling less than 80° C., in particular isopentane, may also be present in compositions of part (c) of the invention which contain at least one compound A" or A"', of at least 10 carbon atoms, in particular those boiling at 160° C. or above, such as A1, and A12-14. Relative amounts of these compounds A" or A"' to the low boiling component e.g. isopentane, may be 1-9:9-1 such as 5-9:5-1, especially with less than 20% of A" or A"' in the composition.

Cycloaliphatic hydrocarbons e.g. of 5-7 carbons such as cyclopentane or cyclohexane may be present but usually in amounts of less than 15% of the total e.g. 1-10%.

The compositions of part (c) of the invention also preferably contain as component (d") at least one olefin, (in particular with one double bond per molecule) which is a liquid alkene of 5-10 e.g. 6-8 carbons, such as a linear or branched alkene e.g. pentene, isopentene hexene, isohexene or heptene or 2 methyl 2 pentene, or a mixture comprising alkenes which may be made by cracking e.g. catalytically or thermally cracking a residue from crude oil, e.g. atmospheric or vacuum residue; the mixture may be heavy or light catalytically cracked spirit (or a mixture thereof). The cracking may be steam assisted. Other examples of olefin containing mixtures are "C6 bisomer", catalytic polymerate, and dimate. The olefinic mixtures usually contain at least 10% w/w olefins, such as at least 40% such as 40-80% w/w. Preferred mixtures are (xi) steam cracked spirit (xii) catalytically cracked spirit (xiii) C6 bisomer and (xiv) catalytic polymerate, though the optionally cracked catalytically spirits are most advantageous. Amounts in the total composition of the olefinic mixtures especially the sum of (xi)-(xiv) (if any present) maybe 0-55, e.g. 10-55 or 18-37 such as 23-35 or 20-55 such as 40-55% Amounts of (xi) and (xii) (if present) in total in the composition are preferably 18-55, such as 18-35, 18-30 or 35-55% (by volume).

The olefin or mixture of olefins usually has an MON value of 70-90, usually a RON value of 85-95 and a ROAD value of 80-92.

The volume amount of olefin(s) in total in the gasoline composition of part (c) of the invention may be 0% or 0-30%, e.g. 0.1-30% such as 1-30% in particular 2-25 e.g. 2-14% (especially 3-10). Usually the composition contains at least 1% olefin and a maximum of 18% or especially a maximum of 14%, but may be substantially free of olefin.

The compositions may also contain as component (e") at least one aromatic compound, preferably an alkyl aromatic compound such as toluene or o, m, or p xylene or a mixture thereof or a trimethyl benzene. The aromatics may have been added as single compounds e.g. toluene, or may be added as an aromatics mixture containing at least 30% w/w aromatic compounds such as 30-100% especially 50-90%. Such mixtures may be made from catalytically reformed or cracked gasoline obtained from heavy naphtha. Example of such mixtures are (xxi) catalytic reformate and (xxii) heavy reformate or heavy steam cracked spirit. Amounts of the single compounds e.g. toluene in the composition may be 0-35%, such as 2-33% e.g. 10-33%, while amounts of the aromatics mixtures especially the total of the reformates (xxi) & (xxii) (if any) in the composition may be 0-50%, such as 1-33% e.g. 2-15% or 2-10% or 15-32% v/v, and total amount of reformates (xxi), (xxii) and added single compounds (e.g. toluene) may be 0-50% e.g. 0.5-20% or 5-40, such as 15-35 or 5-25% v/v.

The aromatics usually have a MON value of 90-110 e.g. 100-110 and a RON value of 100-120 such as 110-120 and a ROAD value of 95-110. The volume amount of aromatic compounds in the composition is usually 0% or 0-50% such as less than 40% or less than 28% or less than 20% such as 1-50%, 2-40%, 3-28%, 4-25%, 5-20% (especially 10-20%), 4-10% or 20-35% especially of toluene. The gasoline composition may also be substantially free of aromatic compound. Amounts of aromatic compounds of less than 42%, e.g. less than 35% or especially less than 30% or 18% are preferred. Preferably the amount of benzene is less than 5% preferably less than 1.5% or 1% e.g. 0.1-1% of the total volume or less than 0.1% of the total weight of the composition.

The compositions may also contain as component (f") at least one oxygenate octane booster, usually of Motor Octane Number of at least 96-105 e.g. 98-103. The oxygenate may be any organic liquid molecule containing and preferably consisting of, CH and at least one oxygen atom e.g. 1-5 of bp less than 225° C. The octane booster is usually an ether e.g. a dialkyl ether, in particular an asymmetric one, preferably wherein each alkyl has 1-6 carbons, in particular one alkyl being a branched chain alkyl of 3-6 carbons in particular a tertiary alkyl especially of 4-6 carbons such as tert-butyl or tert-amyl, and with the other alkyl being of 1-6 e.g. 1-3 carbons, especially linear, such as methyl or ethyl. Examples of such oxygenates include methyl tertiary butyl ether (MTBE), ethyl tertiary butyl ether and methyl tertiary amyl ether. The oxygenate may also be a cyclic ether, in particular with 5 or 6 ring atoms in the or each ring, such as furan or tetrahydrofuran and its lower alkyl e.g. methyl derivatives. The oxygenate may also be an alcohol of 1-6 carbons e.g. ethanol. The oxygenate may also be an organic carbonate e.g. a dialkyl carbonate with 1-3 carbon atoms in each alkyl e.g. dimethyl carbonate.

The volume amount of the oxygenate may be 0 or 0-25% such as 1-25%, 2-20%, 2-10% or 5-20% especially 5-15%, but advantageously less than 3% such as 1-3% (especially of MTBE and/or ethanol). The oxygenate may also be substantially absent from the composition or gasoline of part (c) of the invention, which is thus a substantially hydrocarbon fuel.

Part (c) of the present invention also provides a formulated unleaded gasoline comprising a blend composition of part (c) of the invention comprising component (a") and (b") and usually at least one gasoline additive, e.g. as described above, in particular with the gasoline comprising less than 5%, e.g. less than 4% of triptane or 223 trimethyl pentane.

The blend of part (c) of the invention contains at least one component (a") and component (b") and, (optionally (c") to (f"), as well, and the formulated unleaded gasoline also contains at least one gasoline additive e.g. a motor gasoline or aviation gasoline additive, for example as listed in ASTM D-4814 the contents of which is herein incorporated by reference or specified by a regulatory body, e.g. US California Air Resources Board (CARB) or Environmental Protection Agency (EPA). These additives are distinct from the liquid fuel ingredients, such as MTBE. Such additives may be the lead free ones described in Gasoline and Diesel Fuel Additives, K Owen, Publ. By J. Wiley, Chichester, UK, 1989, Chapters 1 and 2, U.S. Pat. No. 3,955,938, EP 0233250 or EP 288296, the contents of which are herein incorporated by reference. The additives maybe pre-combustion or combustion additives. Examples of additives are anti-oxidants, such as one of the amino or phenolic type, corrosion inhibitors, anti-icing additives e.g. glycol ethers or alcohols, engine detergent additives such as ones of the succinic acid imide, polyalkylene amine or polyether amine type and anti-static additives such as ampholytic surface active agents, metal deactivators, such as one of thioamide type, surface ignition inhibitors such as organic phosphorus compounds, combustion improvers such as alkali metal salts and alkaline earth metal salts of organic acids or sulphuric acid monoesters of higher alcohols, anti valve seat recession additives such as alkali metal compounds, e.g. sodium or potassium salts such as borates or carboxylates e.g. sulpho succinates, and colouring agents, such as azodyes. One or more additives (e.g. 2-4) of the same or different types may be used, especially combinations of at least one antioxidant and at least one detergent additive. Antioxidants such as one or more hindered phenols e.g. ones with a tertiary butyl group in one or both ortho positions to the phenolic hydroxyl group are preferred in particular as described in Ex. 1 hereafter. In particular the additives may be present in the composition in amounts of 0.1-100 ppm e.g. 1-20 ppm of each, usually of an antioxidant especially one or more hindered phenols. Total amounts of additive are usually not more than 1000 ppm e.g. 1-1000 ppm.

The compositions and gasolines are free of organolead compounds, and usually of manganese additives such as manganese carbonyls.

The compositions and gasolines may contain up to 0.1% sulphur, e.g. 0.000-0.02% such as 0.002-0.01% w/w.

The gasoline compositions of part (c) of the invention usually have a MON value of 80 to 105 such as 85-105, 85-90, 90-105 or 93-105 e.g. but especially 94-102. The RON value is usually 90-115 e.g. 102-115 such as 98-112 or 105-112, or 93-98 e.g. 94.5-97.5, or 97-101 while the ROAD value is usually 85-110 or 85-107 e.g. 98-106 or 102-108 or 85-95. Preferred gasoline compositions have MON 83-93, RON 93-98 and ROAD 85-95 or MON 85-90, RON 94-101 and ROAD 89-96 but especially MON 93-98, RON 102-108, ROAD 98-106, or MON 95-105, RON 102-115 e.g. 108-115 and ROAD 98-106. The Net calorific value of the gasoline (also called the Specific Energy) is usually at least 18000 Btu/lb e.g. at least 18500, 18700 or 18,900 such as 18500-19500, such as 18700-19300 or 18900-19200; the calorific value may be at least 42 MJ/kg e.g. at least 43.5 MJ/kg such as 42-45 or 43-45 such as 43.5-44.5 MJ/kg. The gasoline usually has a boiling range (ASTM D86) of 20-225° C., in particular with at most 5% e.g. 0-5% or 1-3% boiling in the range 161-200° C. is usually such that at 70° C. at least 10% is evaporated while 50% is evaporated on reaching a temperature in the range 77-120° preferably 77-116° C. and by 185° C., a minimum of 90% is evaporated. The gasoline is also usually such that 8-50% e.g. 10-40% may be evaporated at 70° C., 40-74% at 100° C., 70-99.5% at 150° C. and 90-100% may be evaporated at 180° C.; preferably 46-65% has been evaporated by 100° C. The Reid Vapour Pressure of the gasoline at 37.8° C. measured according to ASTM D323 is usually 30-120, e.g. 40-100 such as 61-80 or preferably 50-80, 40-65, e.g. 45-65, 40-60 or 40-50 Kpa. Especially the gasoline or blend has RON value of 90-115, MON value of 85-105, aromatics content of less than 35%, olefins content of less than 0.14%, benzene less than 1%, % evaporated at 70° C. 10-40%, % evaporated at 100° C. 40-74%, % evaporated at 150° C. 70-99.5% and RVP of 40-60 kPa.

The gasoline compositions, when free of any oxygenates usually have a H:C atom ratio of at least 1.8:1 e.g. at least 2.0:1 or at least 2.1 or 2.2:1, such as 1.8-2.3:1 or 2.0-2.2:1. Advantageously the gasoline composition meets the following criteria.

$$\text{Atom H:C} \times [1 + \text{oxy}] \times [\text{Net } \frac{\text{Heat of}}{200} \text{ Combustion} + ROAD] \geq y,$$

wherein Atom H:C is the fraction of hydrogen to carbon in the hydrocarbons in the composition, oxy means the molar fraction of oxygenate, if any in the composition, Net Heat of Combustion is the energy derived from burning 1 lb (454 g) weight of fuel (in gaseous form) in oxygen to give gaseous water and carbon dioxide expressed in Btu/lb units [MJ/kg times 430.35], and y is at least 350, 380, 410 or 430, in particular 350-440 e.g. 380-420 especially 400-420.

Among preferred blends of part (c) of the invention are unleaded blends comprising as component (a") at least 5 or 10% of at least one individual compound A" or A'" and component (b") as defined above, with the proviso that when the compound A" or A'" is an alkane of 9 or 10 carbon atoms, then blend contains at least 10% of an alkane of 6 or 7 carbons of MON at least 70 and RON at least 90, and preferably contains less than 5% in total of 2,2,3-trimethyl pentane and 2,2,3-trimethyl butane.

Preferred formulated unleaded gasolines of part (c) of the invention comprise at least one gasoline additive and the preferred unleaded blend above, with the proviso when the compound A" or A'" is an alkane of 9 or 10 carbon atoms, the blend preferably contains less than 5% in total of 2,2,3-trimethyl pentane and 2,2,3-trimethyl butane.

Preferred blends and gasolines of part (c) of the invention can have MON values of 94-105 (e.g. 97-105), RON values of 103-115 (e.g. 107-115), ROAD values of 98-110 (e.g. 102-110), compound A" or A'" contents of 30-60% e.g. 40-60% (comprising 1 or 2 compounds A" or A'" especially A1 and/or A2), total naphtha contents of 35-65% (e.g. 35-55%) and 1-5% butane, the blends containing 1-8% e.g. 2-6% aromatics, 0-1% olefins and 91-99% (e.g. 94-98%) saturates. These are substantially aliphatic blends and gasolines of very high octane numbers, without the use of oxygenates such as MTBE, and also substantially saturated.

Other very high octane blends and gasolines of part (c) of the invention can have MON values of 94-102 e.g. 94-99, RON values of 105-115, ROAD values of 99-107, compound A" or A'" contents of 30-60% e.g. 30-50% (comprising 1 or 2 compounds A" or A'" especially A1 and/or A2), medium naphtha contents of 5-30% and contents of total olefinic fraction such as steam cracked spirit of 30-50% and 1-5% butane, the blends containing 10-25% aromatics e.g. 12-18% aromatics, 4-14% olefins e.g. 6-12%, and 60-90% such as 70-80% saturates. These high octane materials are obtained without the use of oxygenates.

Further blends and gasolines of part (c) of the invention can have MON values of 84-90, RON values of 93-98, ROAD values of 86-94, and contain compound A" or A'" in amount of 15-35% (especially of A2), total naphtha of 40-65% and olefinic fractions such as steam cracked spirit of 15-45% and 0 or 1-5% butane, with aromatic contents of 5-25% such as 10-18% olefin contents of 2-14% and saturate contents of 70-90%.

Other blends and gasolines of part (c) of the invention can contain 10-35% compound A" or A'" (especially A2), and naphtha 30-50%, hydrocrackate 10-30% alkylate and/or isomerate 2-10%, and reformate 3-12%.

Other blends and gasolines of part (c) of the invention can contain 10-35% compound A" or A'" (especially A2) and 3-12% reformate, 1-20% light naphtha/straight run gasoline, as well as alkylate and isomerate, the blend and gasoline preferably containing at least 70% of saturates.

Part (c) of the invention can provide motor gasolines, in particular of 91, 95, 97, 98 and 110 RON values, with desired high Octane Levels but low emission values on combustion in particular of at least one of total hydrocarbons, NOx, carbon monoxide, and carbon dioxide, especially of both total hydrocarbons and carbon dioxide. Thus part (c) of the invention also provides the use of a compound A'" particularly A1 or A2 in unleaded gasoline of MON at least 80 e.g. 80 to less than 98, e.g. as an additive to or component therein, to reduce the emission levels on combustion, especially of at least one of total hydrocarbons, NOx, carbon monoxide and carbon dioxide especially both of total hydrocarbons and carbon dioxide. Part (c) of the invention also provides a method of reducing emissions of exhaust gases in the combustion of unleaded gasoline fuels of MON of at least 80 which comprises having at least 10% component (a"), in particular A1 or A2, present in the fuel which is a gasoline of part (c) of the invention. Part (c) of the invention also provides use of an unleaded gasoline of part (c) of the invention in a spark ignition combustion engine to reduce emissions of exhaust gases. In the compositions, gasolines, methods and uses of part (c) of the invention the component (a") is preferably used in an emission-reducing effective amount. The compositions of part (c) of the invention may be used in supercharged or turbocharged engines, or in normally aspirated ones. The compound A", preferably A1 or A2, can reduce one or more of the above emission levels better than a mixture of aromatics and oxygenate at similar Octane Number and usually decrease the fuel consumption as well.

The gasolines of part (c) of the invention may be used in internal combustion spark ignition engines. They may be used to power moving vehicles on land and/or sea and/or in the air; part (c) of the invention also provides a method of moving such vehicles by combustion of a gasoline of part (c) of the invention. The vehicle usually has a driver and especially means to carry at least one passenger, and/or freight.

The engine sizes for motor gasoline use are usually at least 45 cc e.g. 45-10000 cc e.g. at least 200 cc, such as 500-10000 cc, in particular 950-2550, such as 950-1550, or 1250-1850 cc, or 2500-10000 cc such as 2500-5000 or 5000-9000 cc. The engines have at least 1 cylinder, but preferably at least 2 or 3 cylinders, e.g. 3-16, especially 4-6 or 8 cylinders; each cylinder is usually 45-1250 cc e.g. 200-1200 cc, in particular 240-520 cc or 500-1000 cc. The engines may be 2 stroke engines, but are preferably 4 stroke. Rotary engines e.g. of the Wankel type may be used. The motor engines may be used to power vehicles with at least 2 wheels e.g. 2-4 powered wheels, such as motor bicycles, tricycles, and 3 wheeled cars, vans and motor cars, in particular those vehicles legislated for use on a public highway but also off road e.g. 4 wheeled drive vehicles, sports cars for highway use, and racing cars, including drag racing cars and track racing cars. Power from the engine will preferably be connected to the driving wheels via a gearbox and clutch system, or other form of drive train system, to achieve the transition from a stationary to a mobile state. The engine and drive train will best allow a range of actual vehicle road speed of between 1-350 km/h, preferably between 5-130 km/h and allow for continuous variation of speed thereof. The road speed of the vehicle is usually reduced by a braking mechanism fitted to the vehicle, the braking being generally applied by friction. The engine may either by air or water cooled, the air motion induced by a moving vehicle being used to directly, or indirectly cool the engine. The vehicle comprises a means to facilitate a change of vehicle direction, e.g. a steering wheel or stick. Usually at least 10% of the vehicle distance traveled is carried out at greater than 5 km/h.

The engines using aviation gasoline are usually in piston driven aircraft, i.e. with at least one engine driving a means for mechanically moving air such as at least one propeller. Each engine usually drives at least one propeller driving shaft with 1 or 2 propellers. The aircraft may have 1-10 propellers e.g. 24. The aircraft engines usually have at least 2 cylinders, e.g. 2 to 28 cylinders, each of which is preferably greater than 700 cc in volume, such as 700-2000 cc e.g. 1310 cc. The total engine size is usually 3700-50000 cc e.g. 3700 to 12000 cc for single or twin engined passenger light aircraft, 12000 to 45000 cc for 2 or 4 engined freight or airline use (e.g. 15-200 passengers, such as 50 to 150 passengers). The engines may have an engine power to weight ratio of at least 0.3 Hp/lb wt of engine, e.g. 0.3-2 Hp/lb, and may have a power to cylinder volume of at least 0.5 (Hp/cu.in) e.g. 0.5-2. Cylinders may be arranged in rows, V formation, H formation, flat ('horizontally opposed') or radially around a common propeller drive shaft. One or more rows/circles of cylinders may be used, e.g. flat 2, flat 4, flat 6, V12, 1 2 or 3 circles of 7 cylinders etch. Every cylinder has one and more preferably at least two spark plugs. A gear system may optionally be used to drive the propeller and or a supercharger. Alternatively, an exhaust turbo charger may also be present. Exhaust outlets may be individual or run into a common manifold and preferably point in the opposite direction to forward flight. Fins may be present on the exterior of the engine for air cooling. Greater than 90% of the distance traveled by the engine, when in use, is usually spent at 500 feet or more above ground level. Typically, during greater than 90% of the time when the engine is running, the engine operates at above 1000 rpm e.g. between 1000 to 3500 rpm.

The aircraft usually has at least one tank having a capacity of at least 100 l, especially with a total capacity of at least 1000 l. Small and micro-light aircraft may have tanks substantially smaller in capacity but can operate on the unleaded gasoline described.

The gasolines of part (c) of the invention may be made in a refinery by blending the ingredients to produce at least 200,000 l/day of gasoline such as 1-10 million l/day. The gasoline may be distributed to a plurality of retail outlets for motor gasoline, optionally via wholesale or bulk outlets e.g. holding tanks, such as ones of at least 2 million l capacity e.g. 5-15 million 1. The distribution may be by pipeline or in tanks transported by road, rail or water, the tanks being of at least 5000 l capacity. At the retail sites e.g. filling station, the motor gasoline is dispensed to a plurality of users, i.e. the drivers of the vehicles, e.g. at a rate of at least 100 or 1000 different users per day. For aviation use, the gasoline is usually made in a refinery to produce at least 1000 barrels per day (or 100,000 l/day) such as 0.1-2 million l/day. The avgas is usually distributed by tanker by road, rail or water, or pipelines directly to the airport distribution or holding tanks, e.g. of at least 300,000 l capacity, from whence it is distributed by pipeline or tanker (e.g. a mobile refuelling bowser to fuel a plurality of aircraft, e.g. at least 5/day per tank; the aircraft may have one or more on-board tank each of at least 100 l capacity.

EXAMPLES OF PART (c)

Part (c) of the present invention is illustrated in the following Examples.

Examples 86-92

Various unleaded blends are made up with compound A1 and/or A2 and various refinery streams as shown in Table 23.

7 Formulated gasolines are made, each containing one of the above blends and a 15 mg/l of a phenolic antioxidant 55% minimum 2,4 dimethyl-6-tertiary butyl-phenol 15% minimum 4 methyl-2,6-ditertiary-butyl phenol with the remainder as a mixture of monomethyl and dimethyl-tertiary butyl phenols.

In each case the gasolines are tested for MON and RON, and their Reid Vapour Pressure at 37.8° C. The results are shown in table 23, which also shows their analyses and distillation profile (according to ASTM D86).

Example 93

The emission characteristics on combustion of the formulated gasolines of Ex. 86-92 are determined.

The fuels are tested in a single cylinder research engine at a speed/load of 50/14.3 rps/Nm with a LAMBDA setting of 1.01, and the ignition setting is optimised for the comparative blend. The emissions of CO, $CO_2$ total hydrocarbons, Nox, are measured from the exhaust gases. The results are averaged and show a reduction in the emissions compared to a standard unleaded fuel.

Example 94 and Comparative Ex. L

An unleaded blend was made up with 22446 pentamethyl heptane, blended with various refinery streams as shown in Table 24. Comp Ex. L, with heavy reformate meets, the Europe 2005 requirement for high octane fuel with RON 97.0, MON 86.3 RVP at 37.8° C. 54.7 kPa distillation profile according to ASTM D86, 10% evap, at 52.9° C. 50% at 107.0° C. and 90% at 166.1° C.

2 formulated gasolines were made, each containing one of the above blends and 15 mg/l of the phenolic antioxidant used in Ex. 86-92.

In each case the gasolines were analysed. The results are shown in table 24.

The emission characteristics on combustion of the formulated gasolines of Ex. 94 and Comp. L were determined.

The fuels were tested as in Ex. 86-92 in a single cylinder research engine at a speed/load of 20/7/2 rps/Nm with LAMBDA setting of 1.01, and the ignition setting was optimised for the comparative blend 1. The emissions of CO, $CO_2$ total carbon oxides, total hydrocarbons, $NO_x$ were measured from the exhaust gases as was the Fuel Consumption (expressed in g/h$^1$Whr). The results were averaged and compared to the comparative Ex. L. The degrees of change were as given in Table 25.

TABLE 24

| Formulation % v/v | Comp L Base Fuel | 93 |
|---|---|---|
| Butane | 3 | 3 |
| Full range catalytically cracked spirit | 20 | 20 |
| Alkylate | 40 | 40 |
| Light hydrocracked spirit | 7 | 7 |
| Full range steam cracked spirit | 10 | 10 |
| Heavy reformate | 20 | |
| 2,2,4,4,6-Pentamethylheptane | | 20 |
| Density kg/l | 0.7487 | 0.7264 |
| C:H | 1:1.889 | 1:2.076 |
| C % w/w | 86.4 | 85.25 |
| H % w/w | 13.6 | 14.75 |
| Benzene % v/v | 0.6 | 0.6 |
| Aromatics % v/v | 29.4 | 9.4 |
| Olefins % v/v | 9.0 | 9.0 |

TABLE 25

| Example | CO | CO2 | COx | THC | NOx | Fuel Economy |
|---|---|---|---|---|---|---|
| Comp L | 0% | 0.0% | 0.0% | 0.0% | 0.0% | 0.0% |
| 94 | −1.7% | −2.7% | −2.7% | 3.1% | −4.5% | 0.1% |

Figures denote % change relative to base (Fuel (Comp. L)

TABLE 23

| | Ex. | | | | | | |
|---|---|---|---|---|---|---|---|
| | 86 | 87 | 88 | 89 | 90 | 91 | 92 |
| Butane | 47 | 36 | 54 | 28 | 2.9 | | |
| cpd A2 | 20.0 | 10.0 | 49.2 | 28.0 | 41.6 | 24.1 | 20.4 |
| cpd A1 | 27.2 | 26.4 | 4.7 | — | — | | |
| Med Naphtha | 7.4 | 0.07 | 27.3 | 48.0 | 17.9 | | 23.7 |
| Light Naphtha | 43.2 | 60.6 | 13.6 | 1.5 | — | 41.1 | 35.4 |
| Hydrocrackate | | | | | | 21.5 | |
| Reformate | | | | | | 7.8 | |
| Alkylate | | | | | | 5.6 | |
| Steam Crack Spirit | | | | 19.7 | 37.6 | | 20.4 |
| % Aromatics | 4.0 | 4.7 | 3.6 | 11.6 | 15.2 | | 12.3 |
| % Olefins | 0.2 | 0.2 | 0.1 | 5.2 | 9.7 | | 5.5 |
| % Saturates | 95.8 | 95.1 | 96.3 | 83.2 | 75.1 | | 82.2 |
| RON | 110.0 | 104.5 | 110.0 | 95.0 | 110.0 | | 95.0 |
| MON | 100.0 | 95.5 | 100.0 | 86.0 | 96.9 | | 86.0 |
| RVP kPa | 50.0 | 60.0 | 50.0 | 50.0 | 50.0 | | 52.3 |
| ROAD | 105 | 100 | 105 | 90.5 | 103.45 | | 90.5 |
| E70% v/v | 22.8 | 33.4 | 10.5 | 16.7 | 19.0 | | 31.4 |
| E100% v/v | 49.9 | 60.0 | 49.0 | 49.0 | 51.1 | | 53.5 |
| E150% v/v | 78.0 | 78.0 | 99.0 | 96.9 | 99.0 | | 78.0 |
| E180% v/v | 92.8 | 92.6 | 100.0 | 99.8 | 100.0 | | 93.2 |
| Benzene % v/v | 0.3 | 0.03 | 0.3 | 0.12 | 0.23 | | 0.12 |
| Sulphur % w/v | | | | 0.0005 | 0.0005 | | 0.0004 |

Example 95

An unleaded blend was made up with 2,2,3,3-tetramethyl butane (12%), alkylate (45%), reformate (6%), isomerate (20%) and naphtha i.e. a straight sum gasoline (17%). The tetramethyl butane contained 86.6%, 2,2,3,3-tetramethyl butane, 3.6% 2,2,4-trimethyl pentane 3.7%, c is 3 methyl hexene 2 and 6% unknown and high boilers. It was made substantially according to the procedure of Marker and Oakwood J. Amer. Chem. Soc. 1938, 60, 258.

The blend was mixed with 15 mg/l of the phenolic antioxidant used in Ex. 86-88. The formulated gasoline was tested for MON and RON which were found to be 88.7 and 93.0 respectively, ROAD value 90.85.

We claim:

1. A method of reducing emissions of exhaust gases in the combustion of an unleaded gasoline fuel of Motor Octane Number (MON) at least 80 and comprising less than 42% of aromatic compounds, which method comprises including in said gasoline at least 10% of component (a'), wherein component (a') is at least one of:

(i') a substantially aliphatic hydrocarbon refinery stream of MON at least 85, at least 70% in total of said stream being branched chain alkanes, and wherein said stream is obtained from a refinery material as a distillation cut having Initial Boiling Point of at least 15° C. and a Final Boiling Point of at most 160° C., said Boiling Points being measured according to ASTMD2892, and (ii') at least one branched chain alkane of MON at least 90 and boiling point in the range of 15-160° C., wherein said branched chain alkane is not 2,2,3-trimethylbutane or 2,2,3-trimethylpentane.

2. A method of operating a spark ignition combustion engine, which method comprises using an unleaded gasoline fuel of Motor Octane Number (MON) at least 80, wherein said gasoline comprises less than 42% of aromatic compounds, and at least 10% of a component (a'), which is at least one of:

(i') a substantially aliphatic hydrocarbon refinery stream of MON at least 85, at least 70% in total of said stream being branched chain alkanes and wherein said stream is obtained from a refinery material as a distillation cut having Initial Boiling Point of at least 15° C. and a Final Boiling Point of at most 16° C., said Boiling Points being measured according to ASTMD2892, and (ii') at least one branched chain alkane of MON at least 90 and boiling point in the range 15-160° C., wherein said branched chain alkane is not 2,2,3-trimethylbutane or 2,2,3-trimethylpentane.

3. A method as claimed in claim 1, wherein the gasoline is an unleaded motor gasoline.

4. A method as claimed in claim 1, wherein the gasoline is an unleaded aviation gasoline.

5. A method as claimed in claim 1, wherein the gasoline comprises an unleaded composition having an MON of at least 80, comprising:

at least 2% (by volume of the total composition) of component (a')(i'), wherein component (a')(i') is a cut from an alkylation product; and at least 5% of at least one paraffin, aromatic hydrocarbon or olefinic hydrocarbon bp 60-160° C., with not more than 5% of said composition being hydrocarbon of by of more than 160° C., and wherein said composition comprises less than 5% of 2,2,3-trimethylbutane or 223 trimethyl pentane.

6. A method as claimed in claim 5, wherein component (a')(i') is an alkylate cut of Boiling Point of 60-140° C.

7. A method as claimed in claim 1, wherein said gasoline comprises 20-55% of component (a').

8. A method as claimed in claim 1, wherein said branched chain alkane (a')(ii') has 4-12 carbon atoms.

9. A method as claimed in claim 8, wherein said branched chain alkane (a')(ii') has 4-8 carbon atoms and a boiling point of 15-100° C. and is present in at least 5% of said composition.

10. A method as claimed in claim 8, wherein said gasoline comprises at least 15% by volume of said branched chain alkane (a')(ii'), and wherein said branched chain alkane (a')(ii') has 8-12 carbons.

11. A method as claimed in claim 1, wherein said branched chain alkane (a')(ii') has an alkane chain of carbon atoms with two methyl groups on carbon atom 2 in the chain.

12. A method according to claim 11, wherein said branched chain alkane is isooctane.

13. A method according to claim 8, wherein said gasoline comprises at least 15% by volume of at least one branched chain alkane (a')(ii'), which alkane has 8-12 carbons and 3 methyl or ethyl branches, and there being a minimum of at least 10% by volume of at least one of such individual branched chain alkanes.

14. A method according to claim 13, wherein said branched chain alkane has 8-10 carbons.

15. A method as claimed in claim 14, wherein said alkane is isooctane.

16. A method as claimed in claim 14, wherein said alkane is not 2,2,4-trimethylpentane.

17. A method as claimed in claim 8, wherein said gasoline comprises a blend composition with a MON value of at least 81 and RON value of at least 91, said gasoline also comprising at least 20% of a component, which is at least one liquid hydrocarbon or mixture thereof of bp 60-160° C. having a MON value of at least 70 and RON value of at least 90.

18. A method as claimed in claim 8, wherein said gasoline comprises a blend composition of MON value at least 81 and RON value of at least 91, said gasoline further comprising at least one component which is at least 20% in total of one or more refinery streams, such that said blend composition contains in total at least 70% of saturated hydrocarbons.

19. A method as claimed in claim 1, wherein the gasoline has a RON of at least 97, an MON of 85-90, an aromatics content of less than 35%, an olefins content of less than 14%, a benzene content of less than 1%, a percentage evaporated at 70° C. of 10-50%, and a RVP of 60 kPa or less.

20. A formulated unleaded gasoline which comprises at least one motor or aviation gasoline additive, at least one of an unleaded gasoline of Motor Octane Number (MON) at least 80, less than 42% of aromatic compounds, and at least 10% of component (a'), wherein component (a') is at least one of:

(i') a substantially aliphatic hydrocarbon refinery stream of MON at least 85, at least 70% in total of said stream being branched chain alkanes, and wherein said stream is obtainable or obtained from a refinery material as a distillation cut having Initial Boiling Point of at least 15° C. and a Final Boiling Point of at most 160° C., said Boiling Points being measured according to ASTMD2892, and (ii') at least one branched chain alkane of MON at least 90 and boiling point in the range 15-160° C., wherein said branched chain alkane is not 2,2,3-trimethylbutane or 2,2,3-trimethylpentane.

21. A gasoline according to claim 20, which comprises 10-65% of trimethyl pentanes.

22. A gasoline according to claim 20, which is a motor gasoline.

* * * * *

UNITED STATES PATENT AND TRADEMARK OFFICE

CERTIFICATE OF CORRECTION

PATENT NO. : 8,232,437 B2
APPLICATION NO. : 11/980783
DATED : July 31, 2012
INVENTOR(S) : Clark et al.

It is certified that error appears in the above-identified patent and that said Letters Patent is hereby corrected as shown below:

Column 77, line 3, after "C", please delete ".".

Column 77, line 4, after "C", please delete ".".

Column 77, line 7, after "C", please delete ".".

Column 77, line 20, after "C", please delete ".".

Column 77, line 21, please delete "16° C.," and insert --160° C,--.

Column 77, line 24, after "C", please delete ".".

Column 77, line 38, after "C", please delete ".".

Column 77, line 40, after "C", please delete ".".

Column 77, line 51, after "C", please delete ".".

Column 78, line 22, after "C", please delete ".".

Column 78, line 34, after "C", please delete ".".

Column 78, line 45, after "C" (first and second occurrence), please delete ".".

Column 78, line 49, after "C", please delete ".".

Column 77, line 39, after "of" (second occurrence), please delete "by" and insert --bp--.

Signed and Sealed this
Eighteenth Day of September, 2012

David J. Kappos

David J. Kappos
*Director of the United States Patent and Trademark Office*